US009133999B2

(12) United States Patent
Abe et al.

(10) Patent No.: US 9,133,999 B2
(45) Date of Patent: Sep. 15, 2015

(54) VEHICLE HEADLAMP

(71) Applicant: ICHIKOH INDUSTRIES, LTD., Isehara-shi, Kanagawa-ken (JP)

(72) Inventors: Toshiya Abe, Isehara (JP); Kotoka Inoue, Isehara (JP); Yasuhiro Okubo, Isehara (JP)

(73) Assignee: ICHIKOH INDUSTRIES, LTD., Isehara-shi (JP)

( * ) Notice: Subject to any disclaimer, the term of this patent is extended or adjusted under 35 U.S.C. 154(b) by 204 days.

(21) Appl. No.: 13/838,854

(22) Filed: Mar. 15, 2013

(65) Prior Publication Data

US 2013/0242589 A1 Sep. 19, 2013

(30) Foreign Application Priority Data

Mar. 19, 2012 (JP) ..... 2012-062643
Mar. 19, 2012 (JP) ..... 2012-062644
Mar. 19, 2012 (JP) ..... 2012-062665
Mar. 19, 2012 (JP) ..... 2012-062666

(51) Int. Cl.
*F21S 8/10* (2006.01)

(52) U.S. Cl.
CPC ..... *F21S 48/1317* (2013.01); *F21S 48/1159* (2013.01); *F21S 48/1208* (2013.01); *F21S 48/1233* (2013.01); *F21S 48/1305* (2013.01); *F21S 48/1364* (2013.01); *F21S 48/328* (2013.01)

(58) Field of Classification Search
USPC ..... 362/516, 517, 518, 520, 521, 522, 507, 362/545
See application file for complete search history.

(56) References Cited

U.S. PATENT DOCUMENTS

| | | | | |
|---|---|---|---|---|
| 7,311,430 | B2 * | 12/2007 | Tsukamoto et al. | 362/545 |
| 7,736,039 | B2 * | 6/2010 | Nakazawa et al. | 362/544 |
| 2009/0122567 | A1 * | 5/2009 | Mochizuki et al. | 362/509 |
| 2011/0280028 | A1 * | 11/2011 | Uchida | 362/516 |
| 2013/0010488 | A1 * | 1/2013 | Koizumi | 362/517 |

FOREIGN PATENT DOCUMENTS

JP 2008-041558 A 2/2008

* cited by examiner

*Primary Examiner* — Laura Tso
(74) *Attorney, Agent, or Firm* — Foley & Lardnr LLP

(57) ABSTRACT

The present invention provides a semiconductor-type light source 2, a reflector 3, and a lens 4. The semiconductor-type light source 2 has a light emission surface 24. The reflector 3 has a first reflection surface 31 and a second reflection surface 32. The lens 4 has a plurality of convex surfaces (emission surfaces 46 and 47), a first lens portion 41, and a second lens portion 42. As a result, according to the present invention, an appropriate light distribution pattern for low beam LP can be obtained in a lamp unit.

13 Claims, 35 Drawing Sheets

(A)

(B)

VEHICLE HEADLAMP

CROSS REFERENCE TO RELATED APPLICATIONS

This application claims priority of Japanese Patent Applications No. 2012-062643, Japanese Patent Applications No. 2012-062644, Japanese Patent Applications No. 2012-062665 and Japanese Patent Applications No. 2012-062666, filed on Mar. 19, 2012. The contents of the applications are incorporated herein by reference in their entirety.

BACKGROUND OF THE INVENTION

1. Field of the Invention

The present invention relates to a vehicle headlamp that is provided with a semiconductor-type light source, a reflector, and a lens that has a plurality of convex surface. In particular, the present invention relates to a vehicle headlamp that is provided in such a manner that an appropriate (ideal) light distribution pattern for low beam (a light distribution pattern for passing) can be obtained.

2. Description of the Related Art

The vehicle headlamp of such type is conventionally known (for example, Japanese Unexamined Patent Application Publication No. 2008-41558). Hereinafter, a conventional vehicle headlamp will be described. The conventional vehicle headlamp is provided with a light source that is made of a plurality of semiconductor-type light emitting elements, a reflector, and a scattering prism lens. When the light source is illuminated to emit light, the light from the light source is reflected by means of the reflector, the thus reflected light is transmitted through the scattering prism lens, and then, the thus transmitted light is emitted forward of a vehicle as a light distribution pattern having a hot spot that is entirely long in a vehicle widthwise direction and has a hot spot with its high luminous intensity.

In such a vehicle headlamp, it has been important to form an appropriate light distribution pattern for low beam.

SUMMARY OF THE INVENTION

The present invention has been made in order to solve the above described problem that it has been important to enable the light from a semiconductor-type light source to be formed as an appropriate light distribution pattern for low beam by means of a reflection surface and a plurality of convex surfaces of a reflector.

A vehicle headlamp according to first aspect of the present invention, comprising:

a semiconductor-type light source;

a reflector; and a lens, wherein the semiconductor-type light source has a downward or upward light emission surface, the reflector has:

a first reflection surface that is configured to reflect light from the light emission surface of the semiconductor-type light source as a basic light distribution pattern that has an oblique cutoff line; and a second reflection surface that is configured to reflect light from the light emission surface of the semiconductor-type light source as a basic light distribution pattern that has a horizontal cutoff line, and the lens has:

a first lens portion that has a plurality of convex surfaces, and that is configured to emit the basic light distribution pattern that has the oblique cutoff line; and a second lens portion that is configured to scatter the basic light distribution pattern that has the horizontal cutoff line from the second reflection surface and then emit the scattered basic light distribution pattern forward of a vehicle.

The vehicle headlamp according to second aspect of the present invention, wherein in the first aspect, the first lens portion has a convex shaped free curved surface that is the convex surface which is provided in correspondence with the first reflection surface and of which a plane or a curvature radius is large, and the second lens portion has a convex shaped free curved surface that is a convex shaped free curved surface which is provided in correspondence with the second reflection surface and of which a curvature radius is smaller than a curvature radius of the first lens portion.

The vehicle headlamp according to third aspect of the present invention, wherein in the first aspect, the first reflection surface is provided in a predetermined longitude range and in a predetermined latitude range of the reflector, the predetermined longitude range is a range from a longitude of 0 degree leading up to a longitude angle that corresponds to a tilt angle of the oblique cutoff line on a cruising lane side in a state in which a longitude line passing through a cross point between a reference optical axis of the reflector and the reflector is defined as a longitude of 0 degrees, and the predetermined latitude range is a range that is equal to or larger than a latitude angle at which a positional shift in a vertical direction of the light emission surface of the semiconductor-type light source is permissible in a state in which a cross line between a surface that includes the reference optical axis of the reflector and the reflector is defined as a latitude of 0 degree.

The vehicle headlamp according to fourth aspect of the present invention, wherein in the first aspect, the lens tilts from a front side to a rear side of a vehicle from an inside to an outside of the vehicle in a planar view of the vehicle, and a plurality of the convex shaped free curved surface is made by bending a surface of an inside of the vehicle to a side of a light emission direction with respect to a center axis that is parallel to the reference optical axis of the reflector and then bending a surface outside of the vehicle to an opposite side to the light emission direction with respect to the center axis.

A vehicle headlamp according to fifth aspect of the present invention comprising:

a semiconductor-type light source;

a reflector; and a lens, wherein the semiconductor-type light source has a downward light emission surface, the reflector has a reflection surface that is configured to reflect light from the light emission surface of the semiconductor-type light source as a basic light distribution pattern that has a cutoff line, the lens has a lens portion that has a plurality of convex surfaces, the lens portion being configured to emit the basic light distribution pattern from the reflection surface forward of a vehicle as a light distribution pattern having a cutoff line, the reflection surface is formed by means of vapor deposition, and at least a part of a lower end part of the reflection surface is positioned at a lower de than a lower end part of the lens portion.

The vehicle headlamp according to sixth aspect of the present invention, wherein in the fifth aspect, the lower end part of the reflection surface that is positioned at the lower side than the lower end part of the lens portion is a portion that is configured to emit a spot light distribution of the basic light distribution pattern.

The vehicle headlamp according to seventh aspect, wherein in the fifth aspect, the vehicle headlamp comprises a light impermeable member to shade reflected light from the lower end part of the reflection surface that is positioned on the lower end side of the lens portion.

The vehicle headlamp according to eigth aspect, wherein in the seventh aspect, an engagement portion configured to engage with the light impermeable member is provided on the lens portion, and a scattering surface or a light shading surface is provided at least on an incidence surface of the engagement portion.

A vehicle headlamp according to ninth aspect of the present invention, comprising:

a first semiconductor-type light source and a second semiconductor-type light source;

a first reflector and a second reflector; and a lens, wherein the first semiconductor-type light source and the second semiconductor-type light source has a downward or upward light emission surface;

the first reflector has a first reflection surface to reflect light from the light emission surface of the first semiconductor-type light source as a first basic light distribution pattern having a cutoff line;

the second reflector has a second reflection surface to reflect light from the light emission surface of the second semiconductor-type light source as a second basic light distribution pattern having a high luminous intensity zone; and the lens has a plurality of convex surfaces, and has a first lens portion to emit the first basic light distribution pattern from the first reflection surface forward of a vehicle as a first light distribution pattern having a cutoff line; and a second lens portion to emit the second basic light distribution pattern from the second reflection surface forward of the vehicle as a second light distribution pattern having a high luminous intensity zone,.

wherein the second reflector is positioned in a horizontal direction relative to the first reflector, the first lens and the second lens, respectively, are positioned in a horizontal direction corresponding to the first reflector and the second reflector.

The vehicle headlamp according to tenth aspect of the present invention, in the ninth aspect, comprising a shade portion to shade light that is incident from the first semiconductor-type light source to the second lens portion.

The vehicle headlamp according to eleventh aspect of the present invention, wherein in the ninth aspect, a light emission luminous quantity of the second semiconductor-type light source is smaller than a light emission luminous quantity of the first semiconductor-type light source.

The vehicle headlamp according to twelfth aspect of the present invention, wherein in the ninth aspect, a reference focal point distance of the second reflection surface is shorter than a reference focal point distance of the first reflection surface.

A vehicle headlamp according to thirteenth aspect of the present invention, comprising:

a semiconductor-type light source;

a reflector; and a lens, wherein the reflector has a reflection surface to reflect light from the light emission surface of the semiconductor-type light source as a basic light distribution pattern, the lens has a plurality of convex surfaces, and has a lens portion to scatter and radiate the basic light distribution pattern for the reflection surface, and the semiconductor-type light source is disposed at a position at which the light from the semiconductor-type light source is not directly incident to the lens portion.

The vehicle headlamp according to fourteenth aspect of the present invention, in the thirteenth aspect, comprising a shade portion, wherein the semiconductor-type light source is disposed in an opposite direction to a direction in which the light distribution pattern is to be radiated more than the shade portion and at a position at which the light from the semiconductor-type light source is not directly incident to the lens portion.

The vehicle headlamp according to fifteenth aspect of the present invention, in the fourteenth aspect, wherein, of the reflection surface, at a portion at which reflected light from the reflection surface is shaded by means of the shade portion, an auxiliary reflection surface is provided for reflecting the light from the semiconductor-type light source to the lens portion, and a part of the lens portion is a lens portion to scattering and radiate the basic light distribution pattern and to emit the reflected light from the auxiliary reflection surface as an auxiliary light distribution pattern.

The vehicle headlamp according to sixteenth aspect of the present invention, in the fourteenth aspect, wherein a light impermeable member is provided at a periphery of the lens portion, a window portion is provided at the light impermeable member, of the reflection surfaces, at the portion at which the reflected light from the reflection surface is shaded by means of the shade portion, an auxiliary reflection surface is provided for reflecting the light from the semiconductor-type light source to the window portion, and radiating the reflected light as an auxiliary light distribution from the window portion.

The vehicle headlamp according to the first aspect to the fourth aspect of the present invention is provided in such a manner that the light from a semiconductor-type light source can be obtained as an appropriate light distribution pattern for low beam by means of a reflection surface and a plurality of convex surfaces of a reflector.

The vehicle headlamp according to the fifth aspect to the eighth aspect of the present invention, a good light distribution pattern for low beam can be obtained.

The vehicle headlamp according to the ninth aspect to the twelfth aspect of the present invention is capable of obtaining a good light distribution pattern for low beam and a good light distribution pattern for high beam.

The vehicle headlamp according to the thirteenth aspect to the sixteenth aspect of the present invention, since a semiconductor-type light source is disposed at a position to which light from the semiconductor-type light source is not directly incident, a good light distribution pattern, for example, a light distribution pattern for low beam can be obtained.

DESCRIPTION OF THE PREFERRED EMBODIMENTS

Figure 1:
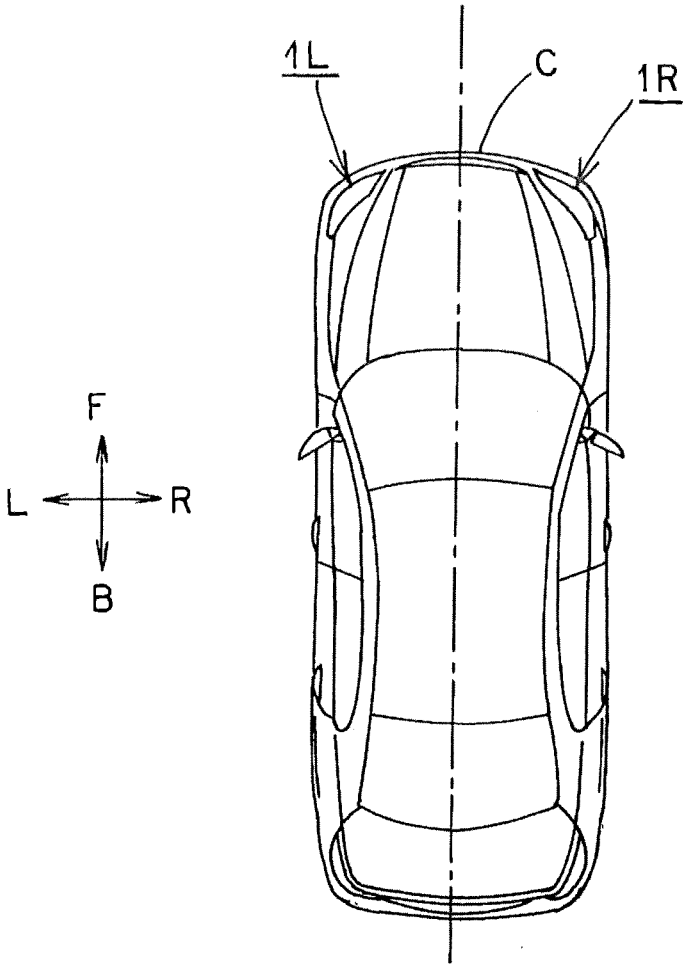
FIG. 1 shows an embodiment of a vehicle headlamp according to the present invention, and is a plan view of a vehicle on which vehicle headlamps on both of the left and right sides have been mounted (embodiment)

Hereinafter, the embodiments (exemplary embodiments) of a vehicle headlamp according to the present invention will be described in detail with reference to the drawings. It is to be noted that the present invention is not limited by the embodiments. In the present specification and its related claims, the terms "front", "rear", "top", "bottom", "left", and "right" designate the front, rear, top, bottom, left, and right in a case where the vehicle headlamp according to the present invention has been mounted on a vehicle, respectively.

In the drawings, reference uppercase letter "F" designates a front side of a vehicle (a side of a forward movement direction of the vehicle). Reference uppercase letter "B" designates a rear side of the vehicle. Reference uppercase letter "D" designates a lower side that is defined in a case where the front side is seen from the driver side. Reference uppercase letter "L" designates a left side that is defined in a case where the front side is seen from the driver side. Reference uppercase letter designates an upper side that is defined in a case where the front side is seen from a driver side. Reference uppercase letter designates a right side that is defined in a case where the front side is seen from the driver side. In addition, a combination of reference uppercase letters with hyphen "VU-VD" designates a vertical line from the top to bottom of a screen. A left side of the screen refers to a left side from the vertical line VU-VD from the top to bottom. A right side of the screen refers to a right side from the vertical line VU-VD from top to bottom. A combination of reference uppercase letters with hyphen "HL-HR" designates a horizontal line from the left to right of the screen. An upper side of the screen refers to a horizontal line from the left to right of the screen. A lower side of the screen refers to a lower side from the horizontal line HL-HR from the left and right.

FIG. 12, FIG. 13, FIG. 17, FIG. 22, FIG. 33, FIG. 39 and FIG. 41 are explanatory views of equi-intensity curve, a respective one of which summarizes and shows a light distribution pattern on a screen drawn by means of computer simulation, wherein a central equi-intensity curve designates a high luminous intensity zone, and other curves are luminous intensity zones that lower as they go to the outside.

(First Embodiment)

Hereinafter, a configuration of the vehicle headlamp in the first embodiment will be described. In FIG. 1, reference codes 1L and 1R designate the vehicle headlamps in the first embodiment (such as headlamps, for example). The vehicle headlamps 1L and 1R described previously are mounted on both of the left and right end parts of a front portion of a vehicle C for right side cruising. Hereinafter, a left side vehicle headlamp 1L that is to be mounted on a left side L of the vehicle C will be described. It is to be noted that a right side headlamp 1R that is to be mounted on a right side R of the vehicle Cis made of the constituent elements that are substantially identical to those of the left side vehicle headlamp 1L.

(Description of Vehicle Headlamp 1L)

The vehicle headlamp 1L described previously, as shown in FIG. 2 to FIG. 5 and FIG. 14, is provided with a lamp housing (not shown), a lamp lens (not shown), a semiconductor-type light source 2, a reflector 3, a lens 4, a heat sink member 5, and a cover member 6.

The semiconductor-type light source 2, the reflector 3, the lens 4, the heat sink member 5, and the cover member 6 configure a lamp unit. The lamp housing and the lamp lens define a lamp room (not shown). The constituent elements 2, 3, 4, 5, and 6 that configure the lamp unit are disposed in the lamp room, and further, are mounted to the lamp housing via an optical axis adjustment mechanism for vertical direction (not shown) and an optical axis adjustment mechanism for transverse direction (not shown).

(Description of Semiconductor-Type Light Source 2)

Figure 2:
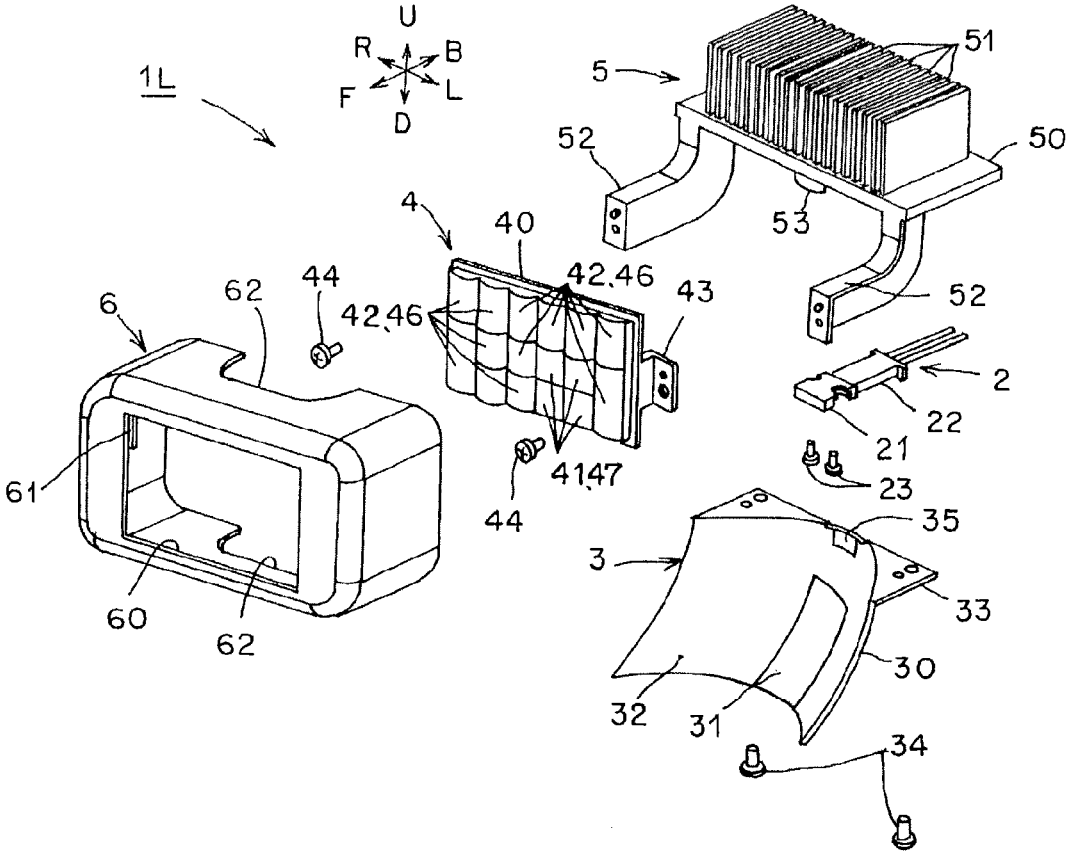
FIG. 2 is an exploded perspective view showing a left side lamp unit (first embodiment)
Figure 3:
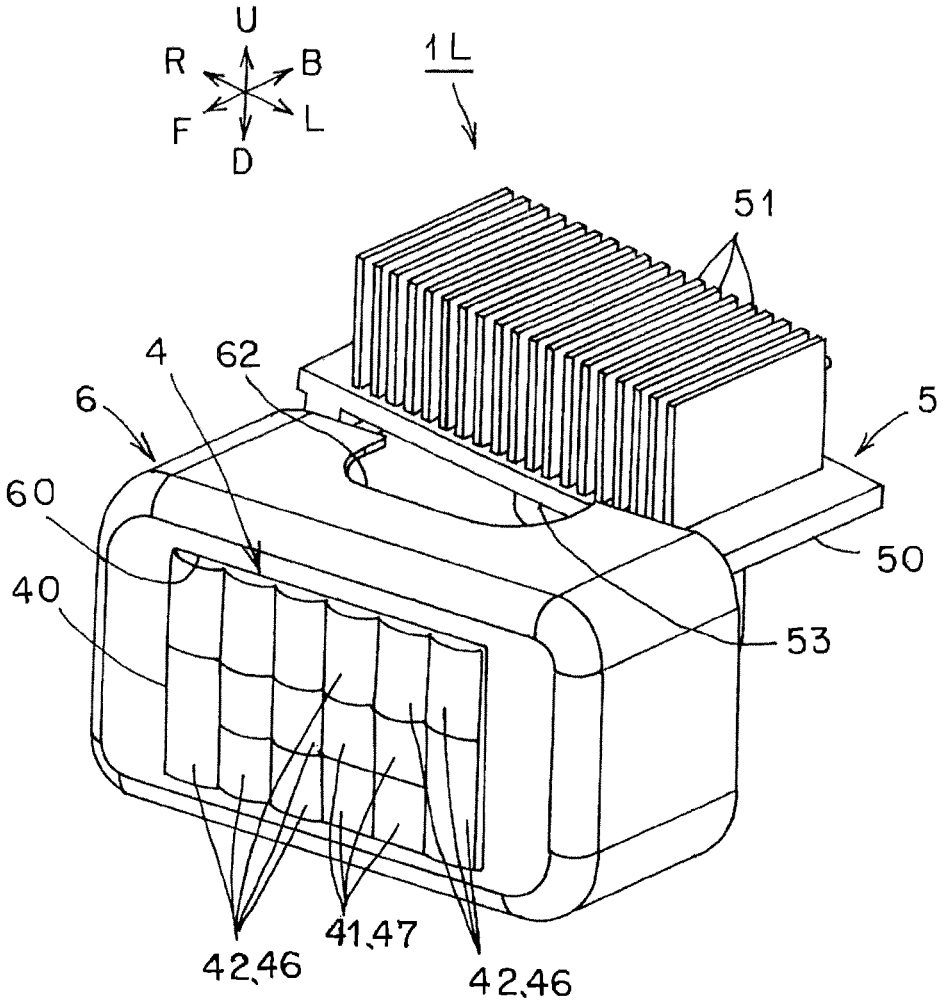
FIG. 3 is a perspective view showing the left side lamp unit (first embodiment)
Figure 4:
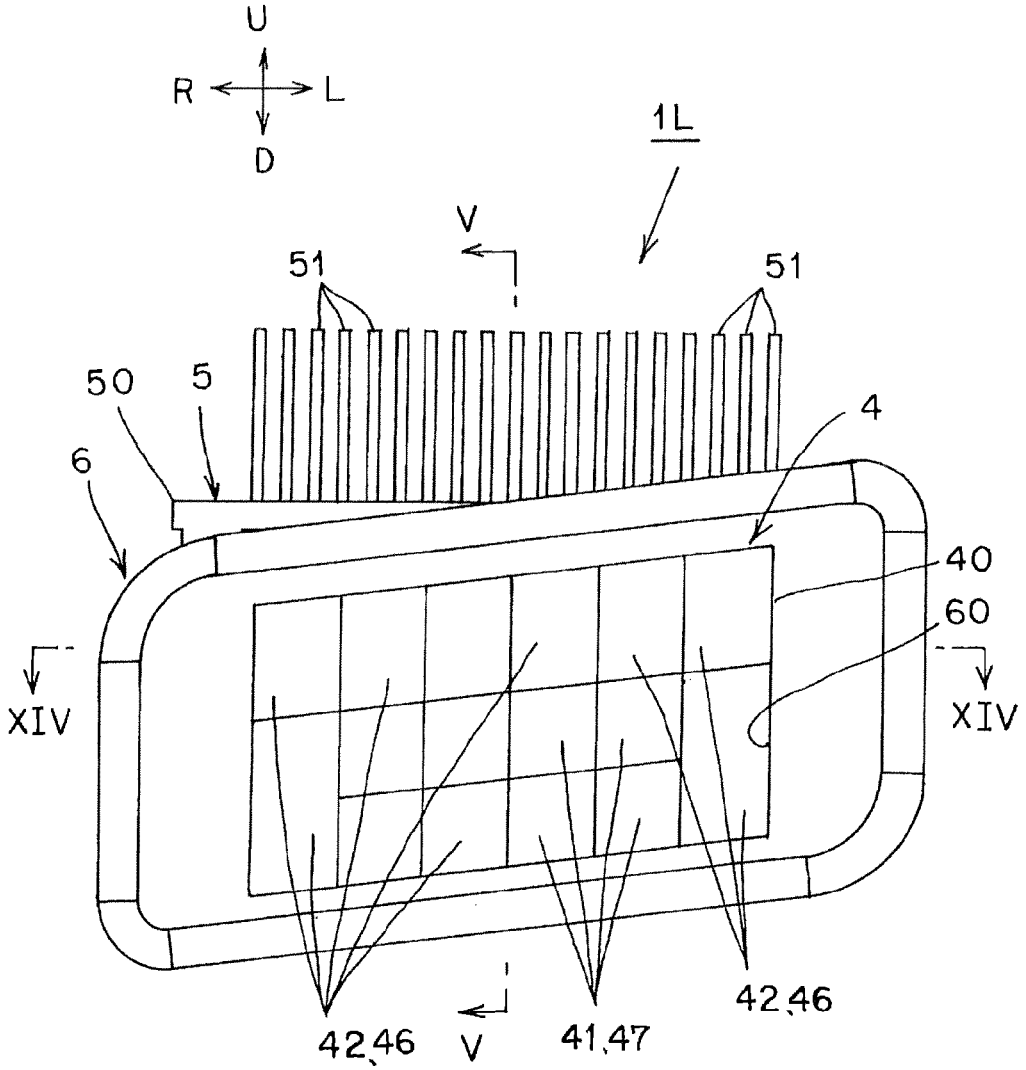
FIG. 4 is a front view showing the left side lamp unit (first embodiment)
Figure 5:
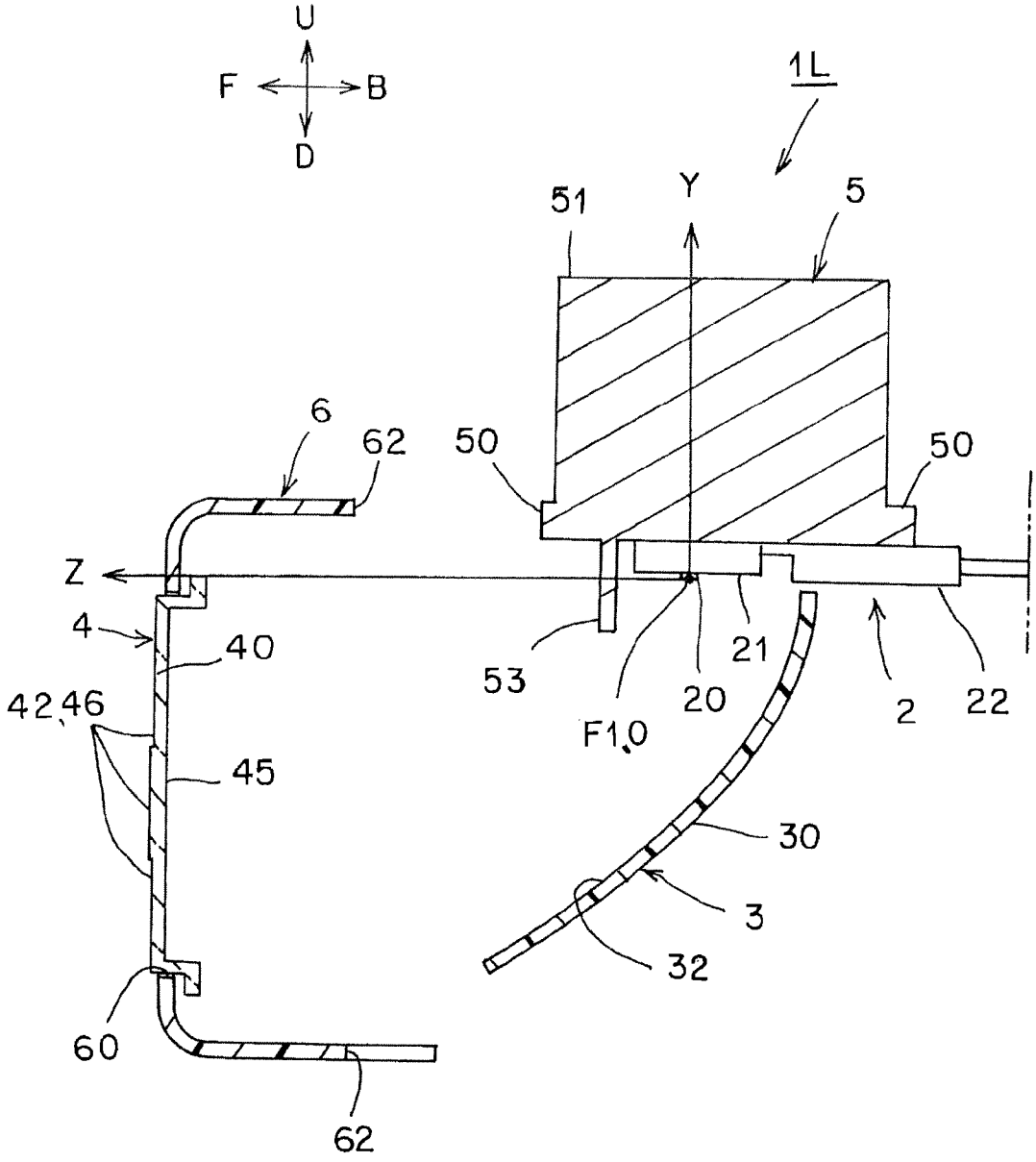
FIG. 5 is a sectional view taken along the line V-V in FIG. 4 (first embodiment)

The semiconductor-type light source 2, as shown in FIG. 2 and FIG. 5, corresponds to a self-emitting semiconductor-type light source such as an LED or an EL (an organic EL), for example. The semiconductor-type light source 2 is made of: a light emitting chip (an LED chip) 20; a package (an LED package) that seals the light emitting chip 20 with a sealing resin member; a board 21 that mounts the package; a connector 22 that is mounted to the board 21 and that supplies an electric current from a power source (a battery) to the light emitting chip 20. The board 21 is fixed to the heat sink member 5 by means of a screw 23. As a result, the semiconductor-type light source 2 is fixed to the heat sink member 5.

Figure 9:
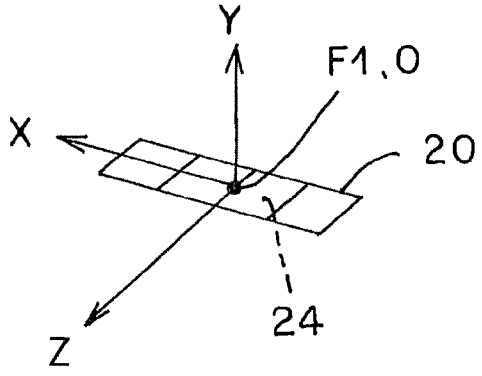
FIG. 9 is an explanatory view showing light emitting chips (light emitting surfaces) of a semiconductor-type light source (first embodiment)

The light emitting chip 20, as shown in FIG. 9, is formed in a planar rectangular shape (a planar elongated shape). In other words, four square chips are arranged in an X-axis direction (in a horizontal direction). It is to be noted that two, three, or five or more square chips or one elongated chip, or one square chip may also be used. A surface (a lower surface) of the lower side D of the elongated shape of the light emitting chip forms a light emission surface 24. As a result, the light emission surface 24 is oriented to the lower side D. A center O of the light emission surface 24 of the light emitting chip 20 is positioned at or near a reference focal point F1 of the reflector 2, and is positioned on or near a reference optical axis reference axis) the reflector.

In FIG. 9, the X, Y, and Z axes configure an orthogonal coordinate (an X-Y-Z orthogonal coordinate system). The X axis designates a horizontal axis that is defined in a transverse direction that passes through the center O of the light emission surface 24 of the light emitting chip 20. On the X axis, the inside of the vehicle C, in other words, in the first embodiment the right side designates a positive direction, and the outside of the vehicle C, in other words, in the first embodiment the left side L designates a negative direction. In addition, the Y axis designates a vertical axis (a vertical line, a normal line, or a perpendicular line) that passes through the center O of the light emission surface 24 of the light emitting chip 20. On the Y axis, in the first embodiment, the upper side designates a positive direction, and the lower side D designates a negative direction. Further, the Z axis designates a reference optical axis Z of the reflector 3, and designates an axis that is defined in a forward/backward direction that passes through the center O of the light emission surface 24 of the light emitting chip 20 and that is orthogonal to the X axis and the Y axis. On the Z axis, in the first embodiment, the front side F designates a positive direction, and the rear side B designates a negative direction.

(Description of Reflector 3)

The reflector 3, as shown in FIG. 2, is made of a reflection portion 30 and a mount portion 33. The mount portion 33 is fixed to the heat sink member 5 by means of a screw 34. As a result, the reflector 3 is fixed to the heat sink member 5. A refection surface that is formed of one continuous surface is provided on a surface (an interior surface) of the front side F of the reflection portion 30.

Figure 6:
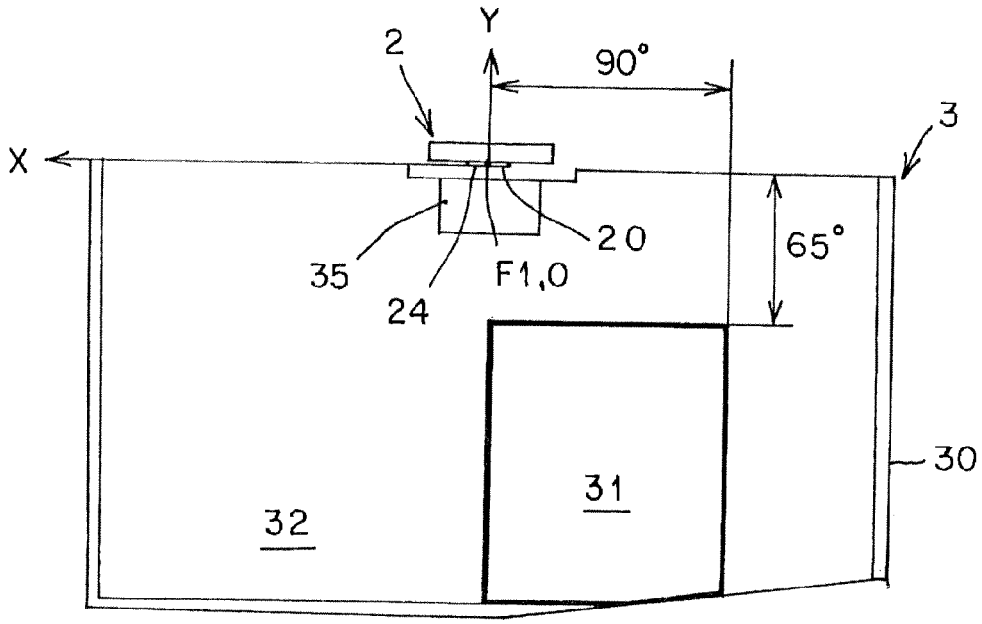
FIG. 6 is a front view showing a reflector (first embodiment)
Figure 8:
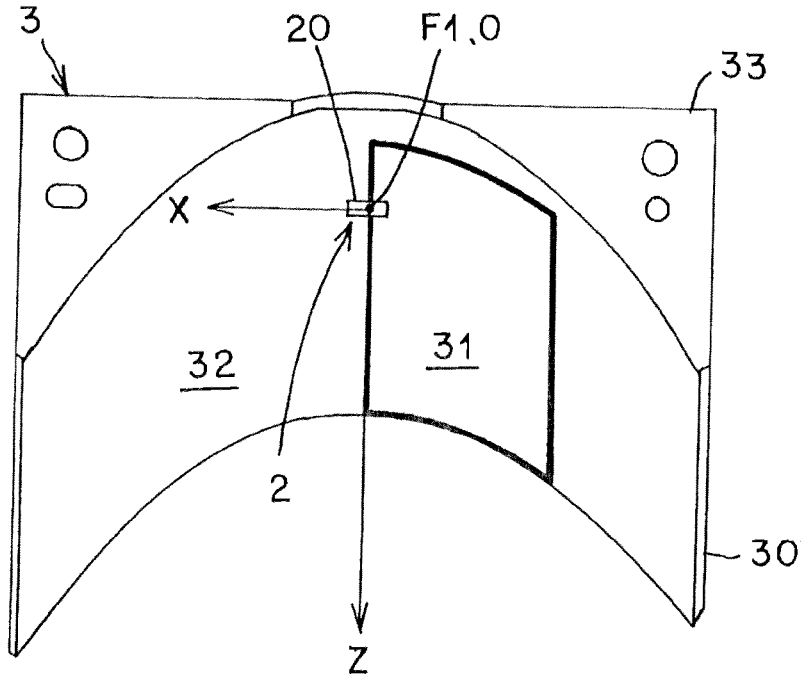
FIG. 8 is a front view showing the reflector (first embodiment)

The reflection surface corresponds to a reflection surface that is made of a parabolic free curved surface. As a result, the reflection surface (the reflector 3) has the reference focal point F1 and the reference optical axis Z. The reflection surface, as shown in FIG. 6 and FIG. 8, has: a first reflection surface 31 (a surface in the range enclosed by the solid line in FIG. 6 and FIG. 8) and a second reflection surface 32 (a surface in the range outside of the thick solid line in FIG. 6 and FIG. 8).

Figure 12:
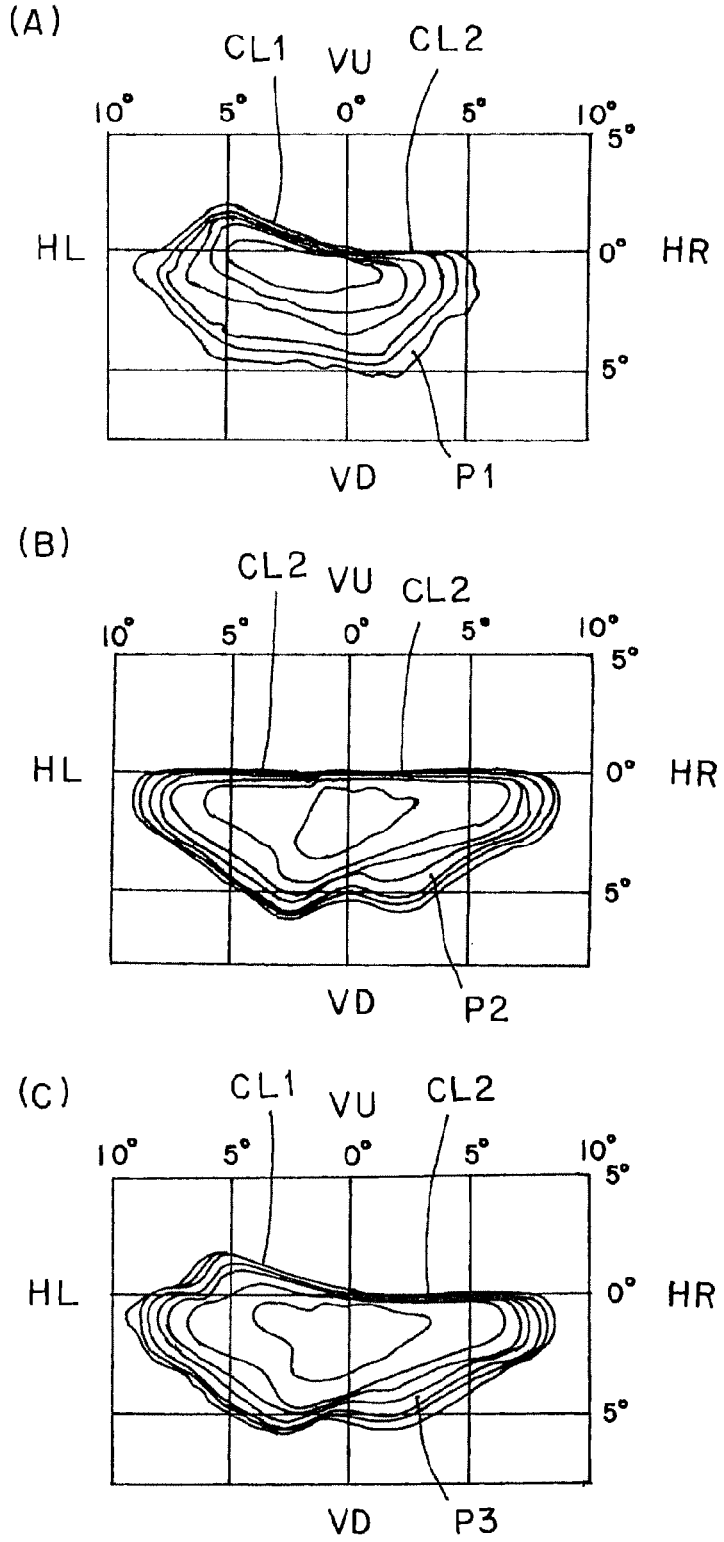
FIG. 12 is an explanatory view showing a basic light distribution pattern that is reflected and obtained by means of the reflector (first embodiment)

The first reflection surface 31 corresponds to a reflection surface of a free curved surface that is configured to reflect the light from the light emission surface 24 of the semiconductor-type light source 2 as a basic light distribution pattern (hereinafter, referred to as a "first basic light distribution pattern") P1 that has an oblique cutoff line CL1 and a horizontal cutoff line CL2 that are shown in FIG. 12 (A). The first basic light distribution pattern P1 has an oblique cutoff line CL1 from the vertical line VU-VD from the top to bottom of the scree to about 5 degrees to the left side (the cruising lane side), and a horizontal cutoff line CL2 from the vertical line VU-VD from the top to bottom of the screen to about 5 degrees to the right side (the opposite lane side). In addition, the first basic light distribution pattern P1 is formed in a fan shape from the oblique cutoff line CL1 to about 5 degrees on the lower side of the screen.

The second reflection surface 32 corresponds to a reflection surface of a free curved surface that is configured to reflect the light from the light emission surface 24 of the semiconductor-type light source 2 as a basic light distribution pattern (hereinafter, referred to as a "second basic light distribution pattern) P2 that has the horizontal cutoff line CL2 that are shown in FIG. 12 (A). The second basic light distribution pattern P2 has a horizontal cutoff line CL2 from the vertical line VU-VD from the top to bottom of the screen to the order of about 10 degrees from both of the left and right sides. In addition, the second basic light distribution pattern P2 is formed in a reversed V shape from the horizontal cutoff line CL2 to about 5 degrees on the lower side of the screen.

When the first basic light distribution pattern P1 and the second basic light distribution pattern P2 are combined (weighted) with each other, as shown in FIG. 12 (C), a third basic light distribution pattern P3 that has an oblique cutoff line CL1 and a horizontal cutoff line CL2 can be obtained. Here, the first basic light distribution pattern P1 is formed in a fan shape from the oblique cutoff line CL1 to the lower side of the screen. Therefore, in the third basic light distribution pattern P3, a smooth light distribution pattern for low beam LP that prevents missing of light is formed at a portion from about 5 degrees to the order of about 10 degrees on the left side of the horizontal line HL-HR from the left and right of the screen.

(Description of Range of First Reflection Surface 31)

The first reflection surface 31 is provided in a predetermined longitude range and in a predetermined latitude range of the reflector 3.

Figure 11:
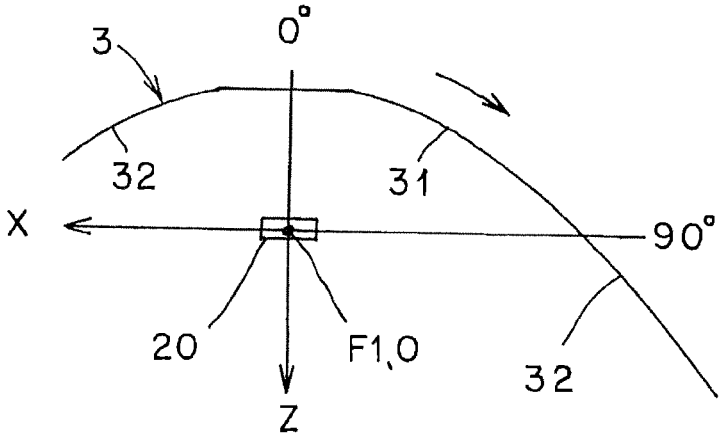
FIG. 11 is an explanatory view showing a range of longitudes of the first reflection surface of the reflector (first embodiment)

The predetermined longitude range, as shown in FIG. 6 and FIG. 11, designates a longitude angle that corresponds to a tilt angle of the oblique cutoff line CL1 of the first basic light distribution pattern P1 from a longitude angle of 0 degree to the cruising lane side (the right side R or in the side of clockwise direction) in a state in which a cross point between the reference optical axis Z of the reflector 3 and the reflector 3 is defined as the longitude angle of 0 degree, and in this example, this range designates a range leading up to about 90 degrees.

Figure 10:
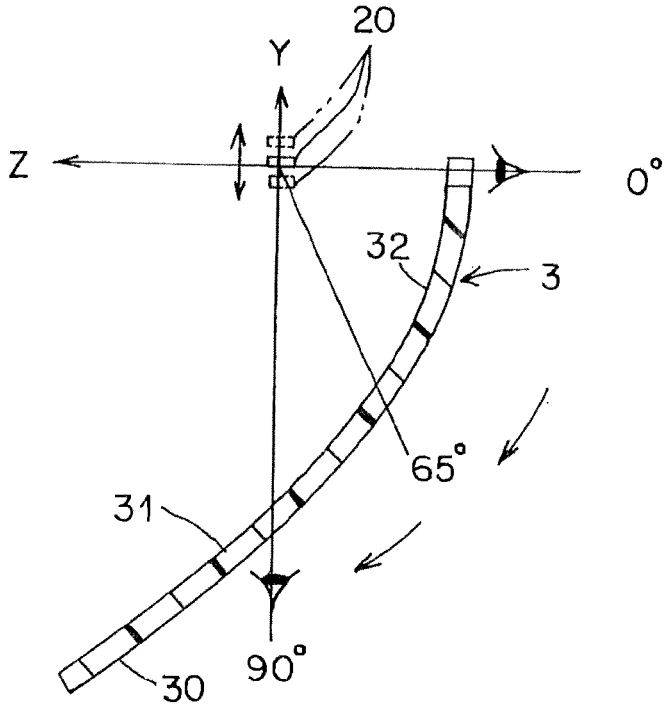
FIG. 10 is an explanatory view showing a range of latitudes of a first reflection surface of the reflector (first embodiment)

The predetermined latitude range, as shown in FIG. 6 and FIG. 10, designates a latitude angle at which a positional shift in the vertical direction of the light emission surface 20 of the semiconductor-type light source 2 can be permitted in a state in which a cross line between a surface that includes the reference optical axis Z of the reflector 3 and the reflector 3 is defined as a latitude angle of 0 degree, and in this example, this range designates a range leading up to about 65 degrees or more.

(Description of Auxiliary Reflection Surface 35)

An auxiliary reflection surface 35 is provided at a center part of an upper edge of the reflector 3, in other words, at a portion that corresponds to a shade portion 53 of the heat sink member 5. The auxiliary reflection surface 35 is configured to reflect a part (not shown) of the light from the semiconductor-type light source 2 in such a manner as to cross the shade portion 53 of the heat sink member 5. The reflected light (not shown) that is obtained by crossing the shade portion 53 of the heat sink member 5 is transmitted through the lens 4 and then the thus transmitted light is emitted forward (to the front side F) of the vehicle C as a predetermined light distribution pattern, or alternatively, the above reflected light is transmitted through a window portion (not shown) that is provided at the cover member 6 and then the thus transmitted light is emitted to the outside of the vehicle C as a predetermined light distribution pattern (not shown).

(Description of Lens 4)

The lens 4, as shown in FIG. 2 to FIG. 5, FIG. 7, and FIG. 14, is made of: a lens portion 40 that is formed in a frontal viewing elongated shape; and a mount portion 43. The mount portion 43 is fixed to the heat sink member 5 by means of a screw 44. As a result, the lens 4 is fixed to the heat sink member 5. A distance in the forward/backward direction between the lens 4 and the reflector 3 is short.

The lens 40 of the lens 4 corresponds to a lens that has a plurality of convex surfaces (a thin lens or a prism lens). The lens portion 40 of the lens 4 tilts (slants) from the inside (the right side R) of the vehicle C to the outside (the left side L), in other words, from the front side F to the rear side B of the vehicle C in the planar viewing of the vehicle C, and tilts (slants) (rises up) from the inside (the right side R) to the outside (the left side) of the vehicle C, in other words, from the lower side D to the upper side U of the vehicle C.

An incidence surface 45 is provided on the interior surface of the lens portion 40 of the lens 4 (on a surface of the rear side B). A respective one of emission surfaces 46 and 47 is provided on the exterior surface of the lens portion 4 of the lens 4 (on a surface of the front side F). The incidence surface 45 is formed in a planar or composite quadrature curved surface. The emission surfaces 46 and 47 are respectively made of a plurality of the convex surfaces, and are respectively formed in a convex shaped free curved surface. As a result, the lens portion 40 of the lens 4 is formed in the shape of a cylindrical lens portion (a prism lens portion) of which an axis is in a vertical direction.

Figure 7:
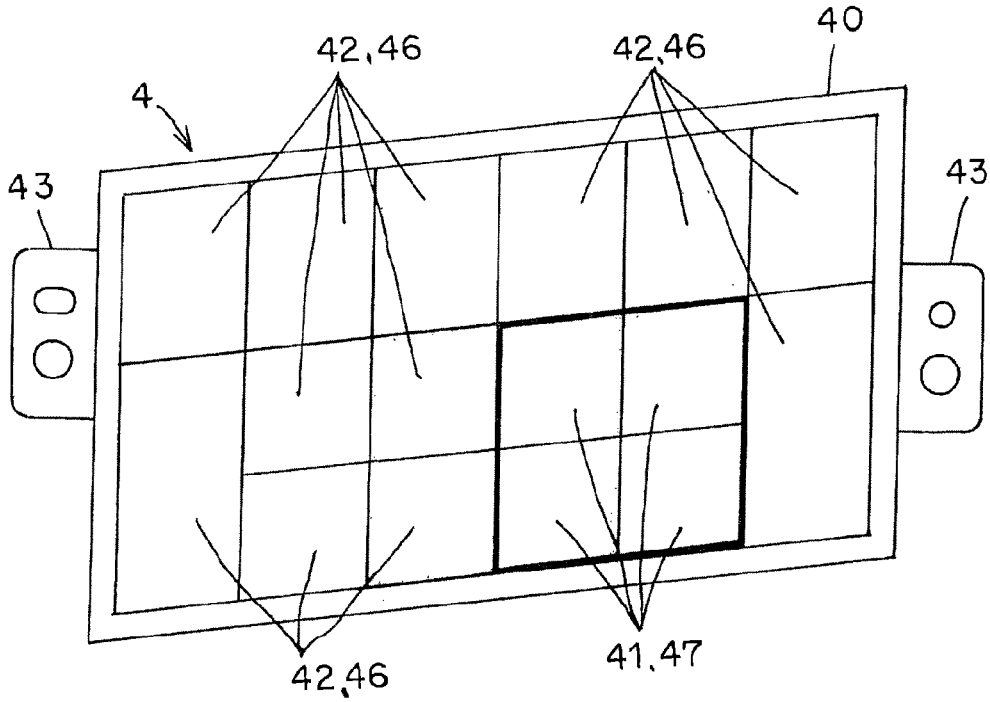
FIG. 7 is a front view showing a lens (first embodiment)

The lens portion 40 of the lens 4 has a first lens portion 41 (a portion in the range enclosed by the thin solid line in FIG. 7) and a second lens portion 42 (a portion in the range of the outside of the thick solid line in FIG. 7).

The first lens portion 41 corresponds to a lens portion that is configured to transparently pass the first basic light distribution pattern P1 from the first reflection surface 31 of the reflector 3 forward of the vehicle C. Here, the term "transparently" refer to a case in which the first basic light distribution pattern P1 is transparently passed as it is, a case in which the first basic light distribution pattern P1 is appropriately moved and transmitted vertically and transparently, a case in which the first basic light distribution pattern P1 is lowly scattered in the transverse direction, a case in which the first basic light distribution pattern P1 is lowly scattered in the transverse direction and is further lowly scattered in the vertical direction, or a case of a combination thereof. The first lens portion 41 has the convex surface (the emission surface 47) which is provided in correspondence with the first reflection surface 31 and of which a plane or curvature radius is large. It is to be noted that the convex surface is made of a group of microscopic convex surfaces.

The second lens portion 42 corresponds to a lens portion that is configured to scattering the second basic light distribution pattern P2 from the second reflection surface 32 of the reflector 3 mainly in the transverse direction (in the vertical direction in order to obtain a thickness in the vertical direction of the light distribution pattern as well) and then emit the scattered pattern forward of the vehicle C. The second lens portion 42 has the convex surface (the emission surface 46) which is provided in correspondence with the second reflection surface 32 and of which a curvature radius is smaller than the curvature radius of the first lens portion 41. It is to be noted that the convex shape is made of a group of microscopic convex surfaces in the same manner as described previously.

In the second lens portion 42, a portion that is proximal to the semiconductor-type light source 2 corresponds to a portion that is configured to widely scattering the second basic light distribution pattern P2 in the transverse direction, whereas a portion that is distant from the semiconductor-type light source 2 corresponds to a portion that is configured to lowly scattering the second basic light distribution pattern P2 in comparison with a portion that is proximal in the transverse direction. The thickness of the portion that is proximal to the semiconductor-type light source 2 of the second lens portion 42 is large, whereas the thickness of the distant portion is small in comparison with the proximal portion. In addition, the curvature radius of the convex portion (the emission surface 46) of the portion that is proximal to the semiconductor-type light source 2 of the second lens portion 42 is small, whereas the curvature radius of the distant portion is large in comparison with the proximal portion and is small or substantially equal in comparison with that of the first lens portion 41.

(Description of Convex Surfaces (Emission Surfaces 46 and 47))

Figure 15:
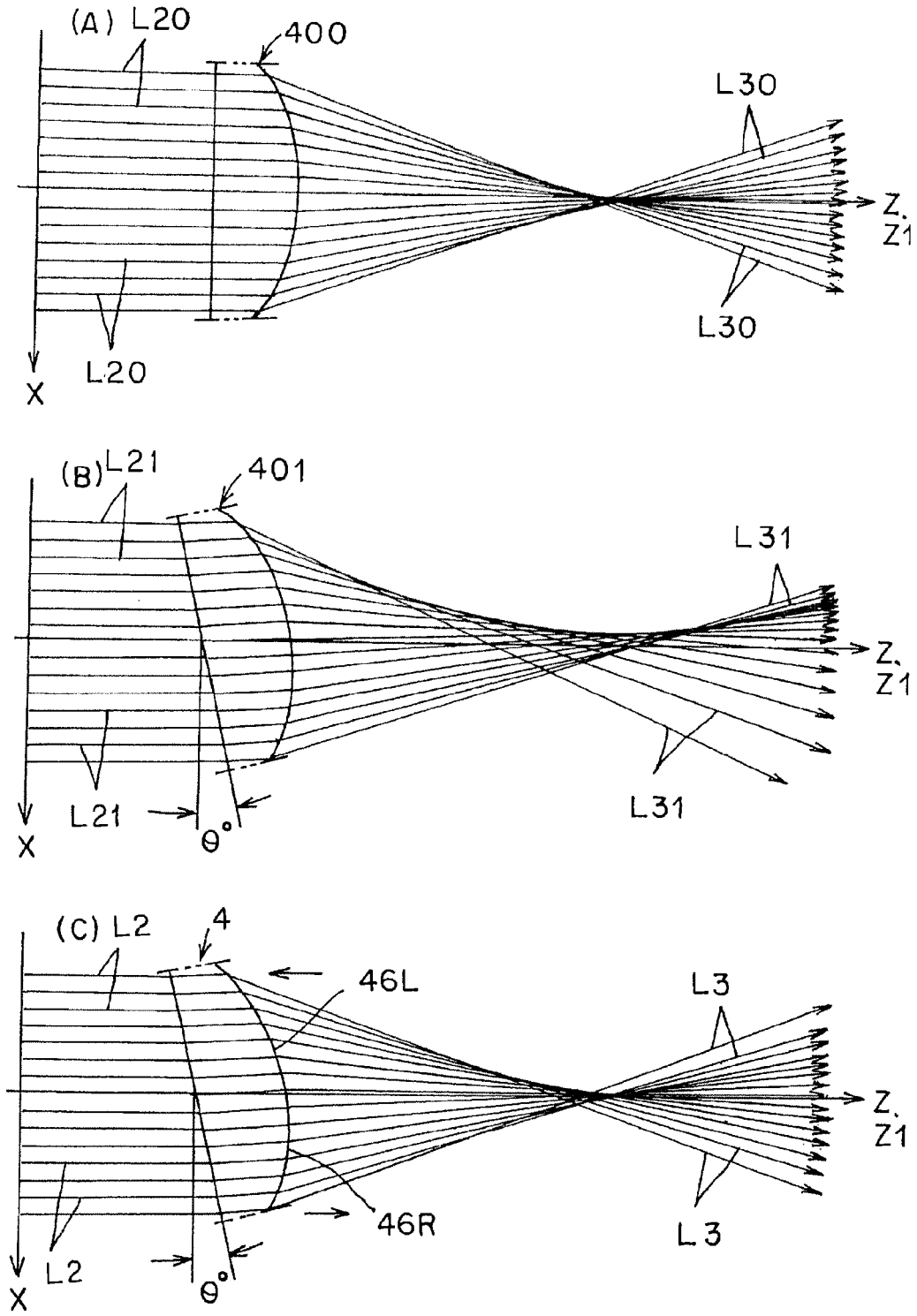
FIG. 15 is an explanatory view showing an optical path (a ray of light) that is transmitted through one prism portion of a lens in FIG. 14 (first embodiment)

A plurality of the convex shaped free curved surfaces, in other words, the convex surfaces (the emission surfaces 46 and 47) are bent as shown in FIG. 15 (C). In other words, a surface 46R of the inside (the right side R) of the vehicle C with respect to a center axis Z1 that is parallel to the reference optical axis Z of the reflector 3 is bent on the side of the light emission direction (on the front side F, in the positive direction of the Z axis, and on the side of the direction indicated by the solid line in FIG. 15 (C). On the other hand, a surface 46L of the outside (the right side L) of the vehicle C with respect to the center axis Z1 is bent on an opposite side to the light emission direction (the rear side B, in the negative direction of the Z axis, and on the side in the direction indicated by the solid line in FIG. 15 (C).

Figure 16:
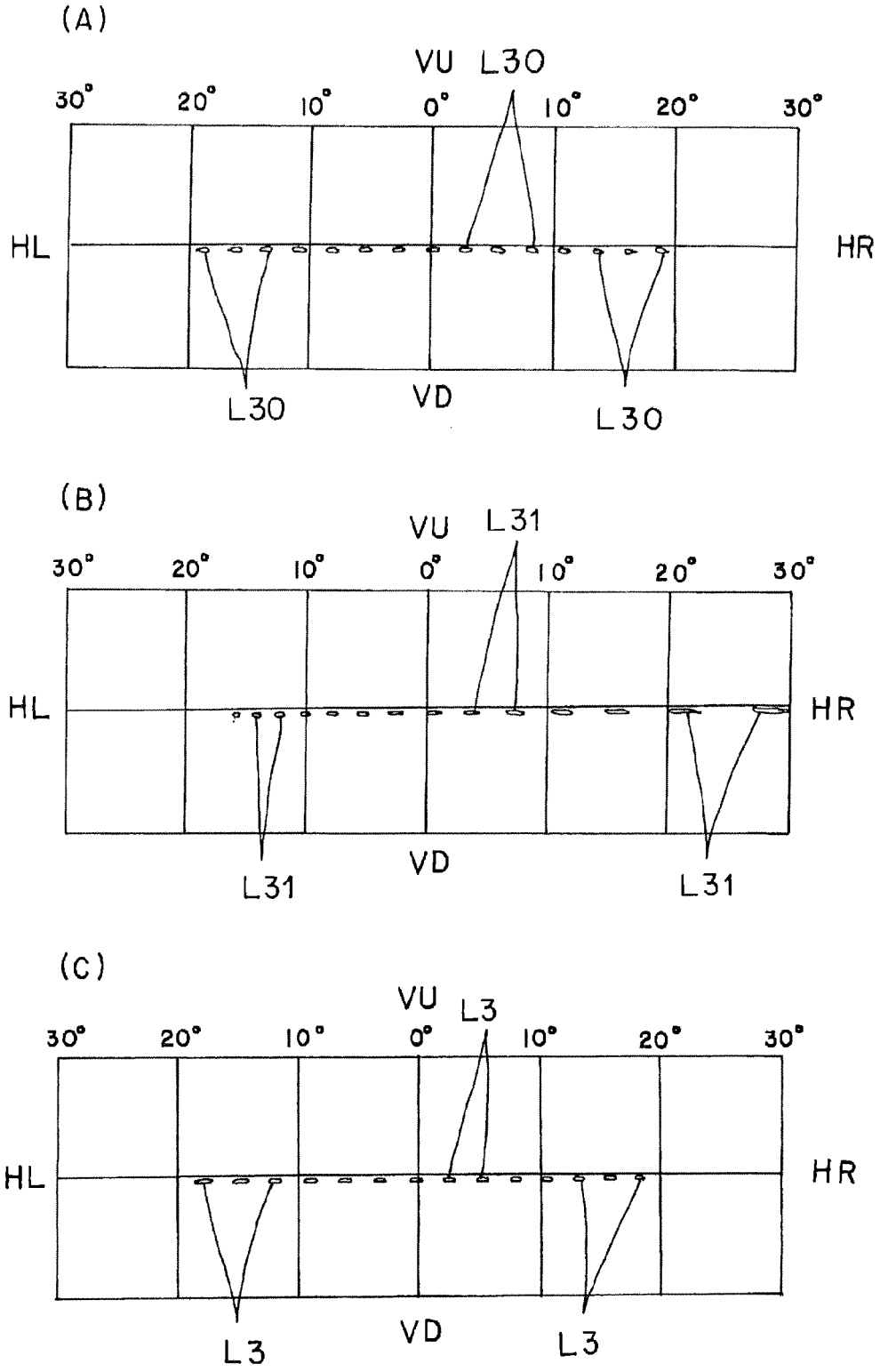
FIG. 16 is an explanatory view showing a location which the optical path in FIG. 15 has reached (first embodiment)
Figure 17:
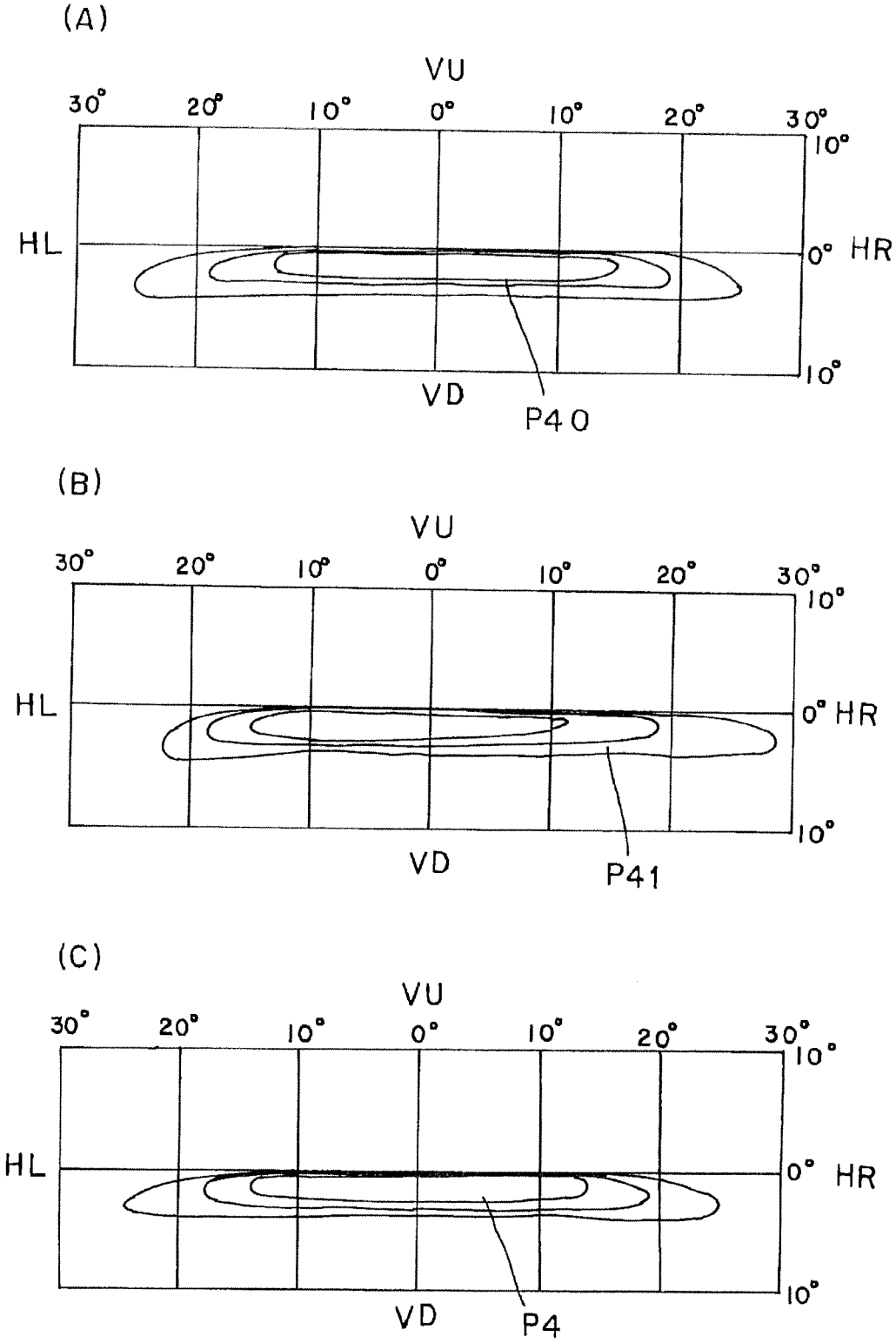
FIG. 17 is an explanatory view showing a light distribution pattern that is formed by means of one prism portion of the lens in FIG. 14 (first embodiment)

As a result, even if the lens 4 tilts, its related emitted light (refer to FIG. 15 (A) and FIG. 16 (A)) and its related light distribution pattern (refer to FIG. 17 (A)) that are similar to those of a lens 400 that does not tilt can be obtained as shown in FIG. 15 (C), FIG. 16 (C), and FIG. 17 (C). In other words, in the lens 401 which has tilted and of which a convex surface (an emission surface) is not bent, its related emitted light and light distribution pattern are biased to the right side R as shown in FIG. 15 (B), FIG. 16 (B), and FIG. 17 (B). However, even if the lens 4 tilts, its related emitted light and light distribution pattern are bent as shown in FIG. 15 (C), FIG. 16 (C), and FIG. 17 (C).

In FIG. 16 (A), FIG. 16 (B), and FIG. 16 (C), the top and bottom positions (degrees) in the screen of the emitted light beams L30, S31, and L3 respectively change depending on the top and bottom position on a horizontal cross section of the lenses 400, 401, and 4 shown in FIG. 15 (A), FIG. 15 (B), and FIG. 15 (C); and therefore, its related specific numeric values are not shown here.

(Description of Heat Sink Member 5)

The heat sink member 5, as shown in FIG. 2 to FIG. 5 and FIG. 14, is made of a horizontal plate portion 50, a fin portion 51, a mount portion 52, and the shade portion 53. On one surface of the horizontal plate portion 50 (on a surface of the lower side D), the semiconductor-type light source 2 and the reflector 3 are respectively mounted by means of the screws 23 and 24.

A plurality of the fin portions 51, a respective one of which is formed in the shape of a vertical plate, are integrally provided on the other surface (on a face of the upper side U) of the horizontal plate portion 50. The fin portions 51 are configured to radiate a heat that is generated on the light emitting chip 20 of the semiconductor-type light source 2 to the outside.

The mount portion 52 that is formed in the shape of a curved arc is integrally provided at a respective one of the left and right end parts on edges of the front side F of one surface of the horizontal plate portion 50. On the mount portion 52, the lens 4 is mounted by means of the screw 44.

The shade portion 53 that is formed in a curved shape is integrally provided at a center part of an edge of the front side F of one surface of the horizontal plate portion 50. The shade portion 53 is configured to prevent the light from the light emission surface 24 of the semiconductor-type light source 2 from being directly incident to the lens portion 40 of the lens 4.

(Description of Cover Member 6)

The cover member 6, as shown in FIG. 2 to FIG. 5 and FIG. 14, is formed in a hollow cover shape in which a portion of the front side F closes and a portion of the rear side B opens. The cover member 6 is made of an optically impermeable member.

An insert opening portion 60 that is formed in an elongated shape is provided at a portion of the front side F of the cover member 6. The lens portion 40 of the lens 4 is inserted into the insert opening portion 60. A mount portion 61 is integrally provided on an edge of a respective one of the left and right sides inside of the insert opening portion 60 of a portion of the front side F of the cover member 6. The mount portion 61 is mounted to the mount portion 43 of the lens 4. As a result, the cover member 6 is fixed to the heat sink member 5 via the lens 4. A ventilation opening portion 62 is provided at a center part of an edge on a respective one of the top and bottom of the opening portion on the rear side B of the cover member 6.

(Description of Functions of First Embodiment)

The vehicle headlamps 1L and 1R in the first embodiment are respectively made of the constituent elements as described above, and hereinafter, their related functions will be described.

The light emitting chip 20 of the semiconductor-type light source 2 is lit. After that, a majority L1 of the light that is radiated from the light emission surface 24 of the light emitting chip 20 is respectively reflected on the side of the lens 4 by means of the first reflection surface 31 and the second reflection surface 32 of the reflector 3.

The reflected light (not shown), in other words, the light that is reflected by means of the first reflection surface 31, is optically distributed and controlled in such a manner as to be the first light distribution pattern P1 shown in FIG. 12 (A) and then the thus obtained light is transparently passed or lowly scattered in the transverse direction from the incidence surface 45 and the emission surface 47, and is transmitted through the first lens portion 41 of the lens 4. The emitted light (not shown), in other words, the light that is emitted from the first lend portion 41, as shown in FIG. 13 (A), is optically distributed and controlled in such a manner as to be the first light distribution pattern Pit having the oblique cutoff line CL1 and the horizontal cutoff line CL2 and then the thus obtained light is emitted forward of the vehicle C.

The reflected light L2, in other words, the light that is reflected by means of the second reflection surface 32, is optically distributed and controlled in such a manner as to be the second light distribution pattern P2 shown in FIG. 12 (B) and then the thus obtained light is scattered in the transverse direction from the incidence surface 45 to the emission surface 46, and is transmitted through the second lens portion 42 of the lens 4. The emitted light L3, in other words, the light that is emitted from the second lens portion 42, as shown in FIG. 13 (B), is optically distributed and controlled in such a manner as to be the second light distribution pattern P12 that has the horizontal cutoff line CL2, and the thus obtained light is emitted forward of the vehicle C.

Figure 13:
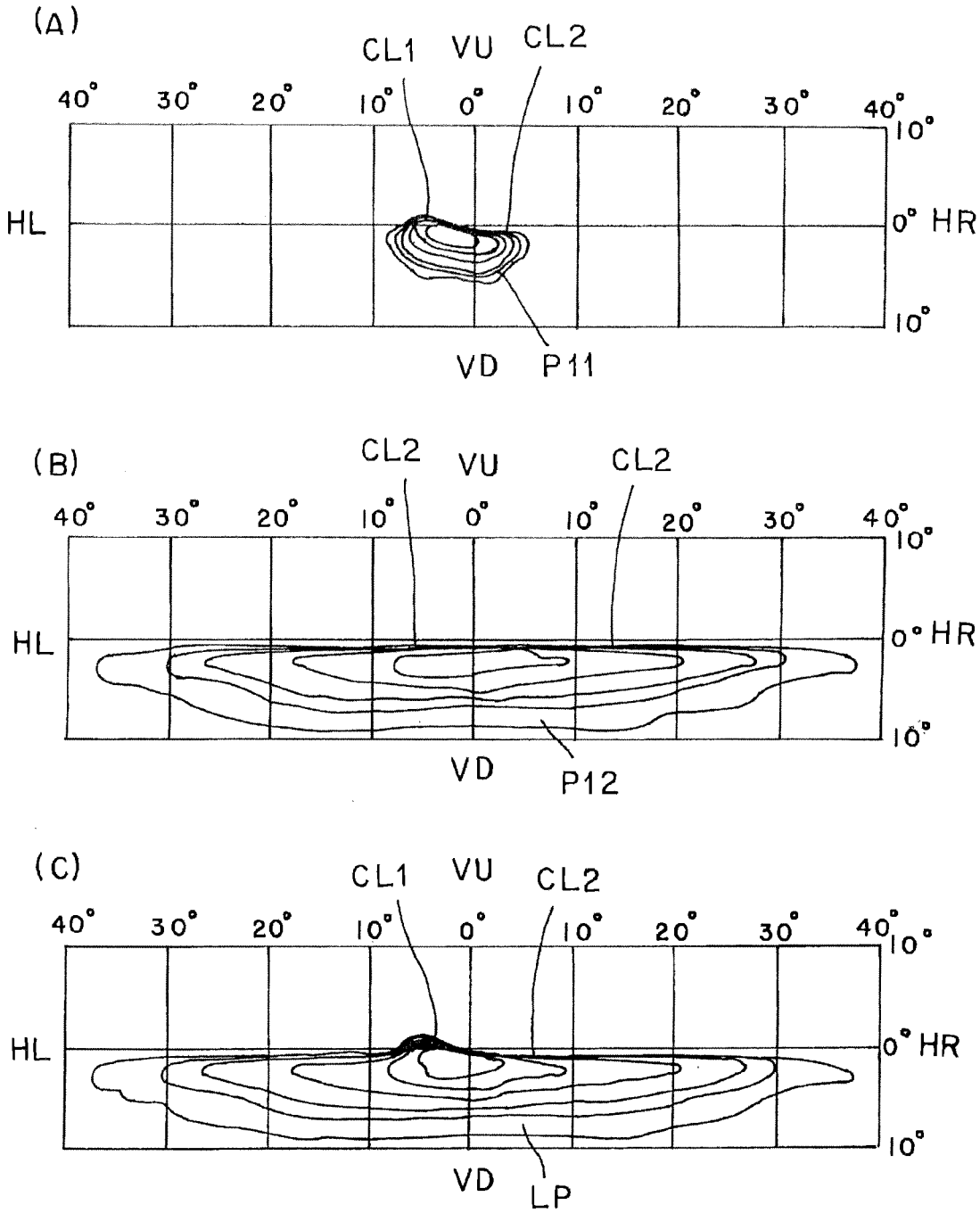
FIG. 13 us an explanatory view showing a light distribution pattern that is obtained after transmitted through a lens (first embodiment)
Figure 14:
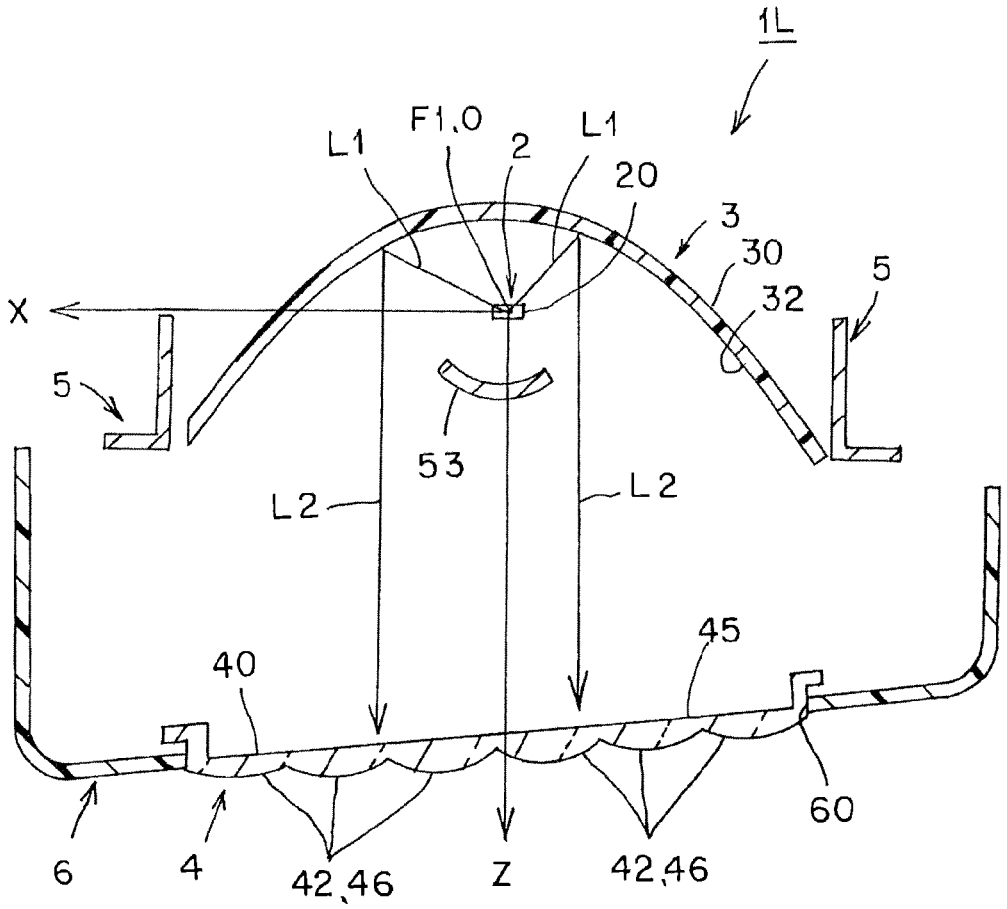
FIG. 14 is a sectional view taken along the line XIV-XIV in FIG. 4 (first embodiment)

After that, the first light distribution pattern P11 shown in FIG. 13 (A) and the second light distribution pattern P12 shown in FIG. 13 (B) are combined (weighted) with each other, and as shown in FIG. 13 (C), an appropriate light distribution pattern for low beam LP having the oblique cutoff line CL1 and the horizontal cutoff line CL2 can be obtained.

(Description of Advantageous Effects of First embodiment)

The vehicle headlamps 1L and 1R in the first embodiment are respectively made of the constituent elements and functions as described above, and hereinafter, their related advantageous effects will be described.

A respective one of the vehicle headlamps 1L and 1R in the first embodiment is provided in such a manner that the light L1 from the semiconductor-type light source 2 can be formed as an appropriate light distribution pattern for low beam LP by means of the first lens portion 41 and the second lens portion 42 of the lens 4 that has the first reflection surface 31, the second reflection surface 32, and a plurality of convex surfaces of the reflector 3.

In other words, a respective one of the vehicle headlamps 1L and 1R in the first embodiment is provided in such a manner t as to optically distribute and control the first basic light distribution pattern P1 that has the oblique cutoff line CL1 and the horizontal cutoff line CL2 by means of the first reflection surface 31 and as to optically distribute and control the second basic light distribution pattern P2 that has the horizontal cutoff line CL2 by means of the second reflection surface 32. In addition, a respective one of the vehicle headlamps 1L and 1R in the first embodiment is provided in such a manner as to transparently pass or lowly scatter the first basic light distribution pattern P1 in the transverse direction by means of the first lens portion 41 to thereby optically distribute and control the first light distribution pattern Pit that has the oblique cutoff line CL1 and the horizontal cutoff line CL2 and then scatter the second basic light distribution in the transverse direction by means of the second lens portion 42 to thereby optically distribute and control the second light distribution pattern P12 that has the horizontal cutoff line CL2. After that, a respective one of the vehicle headlamps 1L and 1R in the first embodiment is provided in such a manner that the first light distribution pattern P11 and the second light distribution pattern 12 are combined (weighted) with each other to be thereby able to obtain an appropriate light distribution pattern for low beam LP that has the oblique cutoff line CL1 and the horizontal cutoff line CL2.

In particular, a respective one of the vehicle headlamps 1L and 1R in the first embodiment is provided in such a manner that the first basic light distribution pattern P1 is formed in a fan shape from the oblique cutoff line CL1 to the lower side of the screen. Therefore, in the third basic light distribution pattern P3, the smooth light distribution pattern for low beam LP that prevents missing of light is formed at a portion from about 5 degrees to the order of about 10 degrees on the left side of the horizontal line HL-HR from the left and right of the screen. In this manner, a respective one of the vehicle headlamps 1L and 1R in the first embodiment is provided in such a manner that the appropriate light distribution pattern for low beam LP free of missing of light can be obtained.

A respective one of the vehicle headlamps 1L and 1R in the first embodiment is provided in such a manner that the first basic light distribution pattern P1 that is optically distributed and controlled by means of the first reflection surface 31 is transparently passed or lowly scattered in the transverse direction by means of the first lens portion 41. Therefore, even if a shift in relative positional between the first reflection surface 31 and the first lens portion 41 occurs to a certain extent, there will be a less influence as to light distribution control from the first basic light distribution pattern P1 to the first light distribution pattern P11. In other words, light distribution control with its high precision becomes possible.

A respective one of the vehicle headlamps 1L and 1R in the first embodiment is provided in such a manner that the first lens portion 4I has a convex surface 47 which is provided in correspondence with the first reflection surface 31 and of which a plane or a curvature radius is large. As a result, the first light distribution pattern P11 can be reliably optically distributed and controlled from the first basic light distribution pattern P1. On the other hand, a respective one of these vehicle headlamps are provided in such a manner that the second lens portion 42 has a convex surface 46 which is provided in correspondence with the second reflection surface 32 and of which a curvature radius is smaller than a curvature radius of the first lens portion 41. As a result, the second light distribution pattern P12 can be reliably optically distributed and controlled from the second basic light distribution pattern P2. In this way, a respective one of the vehicle headlamps 1L and 1R in the first embodiment is provided in such a manner that the appropriate light distribution pattern for low beam LP can be obtained.

A respective one of the vehicle headlamps 1L and 1R in the first embodiment is provided in such a manner that the first reflection surface 31 is provided in a predetermined longitude range of the reflector 3, in other word, in the range from a longitude of 0 degree to a longitude of about 90 degrees. As a result, the oblique cutoff line CL1 can be reliably formed on the cruising lane side. In addition, a respective one of the vehicle headlamps 1L and 1R in the first embodiment is provided in such a manner that the first reflection surface 31 is provided in a predetermined latitude range of the reflector 3, in other words, in the range of latitudes that are equal to or more than about 65 degrees. As a result, as shown in FIG. 10, in a case where the light emitting chip 20 is seen from the latitude of 0 degree, a positional shift in the vertical direction of the light emitting chip 20 becomes large (refer to the double dotted chain line in FIG. 10). However, in a case where the light emitting chip 20 is seen from the latitude of 90 degrees, a positional shift in the vertical direction of the light emitting chip 20 is small (refer to the double dotted chain line in FIG. 10). In this manner, when the first basic light distribution pattern P1 is optically distributed and controlled in the first reflection surface 31, there will be a less influence exerted by the positional shift in the vertical direction of the light emission surface 24 of the light emitting chip 20 of the semiconductor-type light source 2, and the first basic light distribution pattern P1 that has the oblique cutoff line CL1 and the horizontal cutoff line CL2 can be reliably optically distributed and controlled.

A respective one of the vehicle headlamps 1L and 1R in the first embodiment is provided in such a manner that a plurality of convex surfaces (the emission surfaces 46 and 47) are bent as shown in FIG. 15 (C). In other words, the surface 46R of the inside (the right side R) of the vehicle C with respect to the center axis Z1 that is parallel to the reference optical axis Z of the reflector 3 is bent on the side of the light emission direction (on the front side F, in the positive direction of the Z axis, and on the side of the direction indicated by the solid arrow in FIG. 15 (C)). On the other hand, the surface 46L of the outside (the left side L) of the vehicle C with respect to the center axis Z1 is bent on an opposite side to the light emission direction (on the rear side B, in the negative direction of the Z axis, and on the side of the direction indicated by the solid line in FIG. 15 (C)).

As a result, a respective one of the vehicle headlamps 1L and 1R in the first embodiment is provided in such a manner that even if the lens 4 tilts, as shown in FIG. 15 (C), FIG. 16 (C), and FIG. 17 (C), the emitted light L3 (refer to FIG. 15 (A) and FIG. 16 (A)) and the light distribution pattern P4 (refer to P40 of FIG. 17 (A)) that is similar to the lens 400 that does not tilt can be obtained. In other words, in the lens 401 which has tilted and of which the convex surface (the emission surface) is not bent, as shown in FIG. 15 (B), FIG. 16 (B), and FIG. 17 (B), the emitted light L31 and the light distribution pattern 41 are biased to the right side R. However, even if the lens 4 tilts, as shown in FIG. 15 (C), FIG. 16 (C), and FIG. 17 (C), the emitted light L3 and the light distribution pattern 4 are not biased. In this way, a respective one of the vehicle headlamps 1L and 1R in the first embodiment is provided in such a manner that the appropriate light distribution pattern for low beam LP can be reliably obtained even if the lens 4 tilts.

In FIG. 15 (A), FIG. 15 (B), and FIG. 15 (C), reference numerals L20 and L21 respectively designate the reflected light beams from the reflection surfaces of a reflector (not shown), and reference numeral L2 designates the reflected light from the second reflection surface 32 of the reflector 3.

The vehicle headlamps 1L and 1R in the first embodiment each use the lens 4 that has a plurality of convex surfaces (emission surfaces 46 and 47); and therefore, as shown in FIG. 15 (C), the emitted light L3, in other words, the light that is emitted from the plurality of convex surfaces (the emission surfaces 46 and 47) of the lens 4, is focused on the front side F at one time and then the focused light is scattered in the transverse direction. In other words, a start point of scattering and light distribution is positioned forward of the lens 4. As a result, even if the vehicle headlamps 1L and 1R are disposed on the rear side B (on the hack side) of the vehicle C, or alternatively, if the lens 4 tilts as described previously, the emitted light L3, in other words, the light that is emitted from the plurality of convex surfaces (the emission surfaces 46 and 47) of the lens 4, is not shaded by any other component (such as a vehicle body) of the vehicle C, and the emitted light is reliably emitted forward of the vehicle C. In addition, a degree of freedom of the layout of the vehicle headlamps 1L and 1R for the vehicle C increases.

A respective one of the vehicle headlamps 1L and 1R in the first embodiment is provided in such a manner that, of the second lens portion 42, a portion that is proximal to the semiconductor-type light source 2 corresponds to a portion that is configured to widely scatter the second basic light distribution pattern P2 in the transverse direction, whereas a portion that is distant from the semiconductor-type light source 2 corresponds to a portion that is configured to lowly scatter the second basic light distribution pattern P2 in comparison with the portion that is proximal in the transverse direction. As a result, the portion that is proximal to the semiconductor-type light source 2 serves to widely scatter the strong light from the semiconductor-type light source 2, whereas the portion that is distant from the semiconductor-type light source 2 serves to lowly scatter the weak light from the semiconductor-type light source 2. In this manner, the second basic light distribution pattern P2 can be efficiently optically distributed and controlled in such a manner as to be the first light distribution pattern P12.

A respective one of the vehicle headlamps 1L and 1R in the first embodiment is provided in such a manner that a distance in the forward/backward direction between the lens 4 and the reflector 3, in other words, a distance from the first reflection surface 31 and the second reflection surface 32 of the reflector 3 leading up to the incidence surface 45 of the lens 4 is short. Therefore, even if a shift in relative position between the first reflection surface 31 and the second reflection surface 32 of the reflector 3 and the first lens portion 41 and the second lens portion 42 of the lens 4 occurs to a certain extent, there will be a less influence as to light distribution control from the first basic light distribution pattern P1 and the second basic light distribution pattern 2 to the first light distribution pattern P11 and the second light distribution pattern P12. In other words, light distribution control with its high precision becomes possible.

(Description of Examples Other Than First Embodiment)

In the first embodiment, a description will be given with respect to a respective one of the vehicle headlamps 1L and 1R in a case where the vehicle C is intended for use in left side cruising. However, the present invention can be applied to the vehicle headlamps in a case where the vehicle C is intended for use in right side cruising as well.

In addition, in the first embodiment, the light emission surface 24 of the light emitting chip 20 of the semiconductor-type light source 2 is oriented to the lower side D. However, in the present invention, the light emission surface 24 of the light emitting chip 20 of the semiconductor-type light source 2 may be oriented to the upper side U.

Further, in the first embodiment, the emission surfaces 46 and 47 of the lens 47 are respectively formed in a plurality of convex surfaces. However, in the present invention, an incidence surface of a lens may be formed in a plurality of convex surfaces, or alternatively, an emission surface and an incidence surface of the lens may be respectively formed in a plurality of convex surfaces.

Furthermore, in the first embodiment, the second lens portion 42 is the one that is made of a lens portion that is configured to fully scatter the reflected light L2 from the second reflection surface 2. However, in the present invention, of the second lens portion 42, all or part of the second lens portion 42 that is adjacent to the first lens portion 41 may be made of a lens portion that is configured to transparently pass the reflected light L2 from the second reflection surface 2.

Still furthermore, in the first embodiment, the incidence surface 45 of the lens 4 is formed in a planar or composite quadrature curved surface, the emission surfaces 46 and 47 of the lens 4 are respectively made of a plurality of convex surfaces, and are respectively formed in a convex shaped free curved surface. However, in the present invention, it may be that the incidence surface 45 of the lens 4 is made of a plurality of convex surfaces and is formed in a convex shaped free curved surface, and that the emission surfaces 46 and 47 of the lens 4 are respectively formed in a composite quadrature curved surface.

(Second Embodiment)

Figure 21:
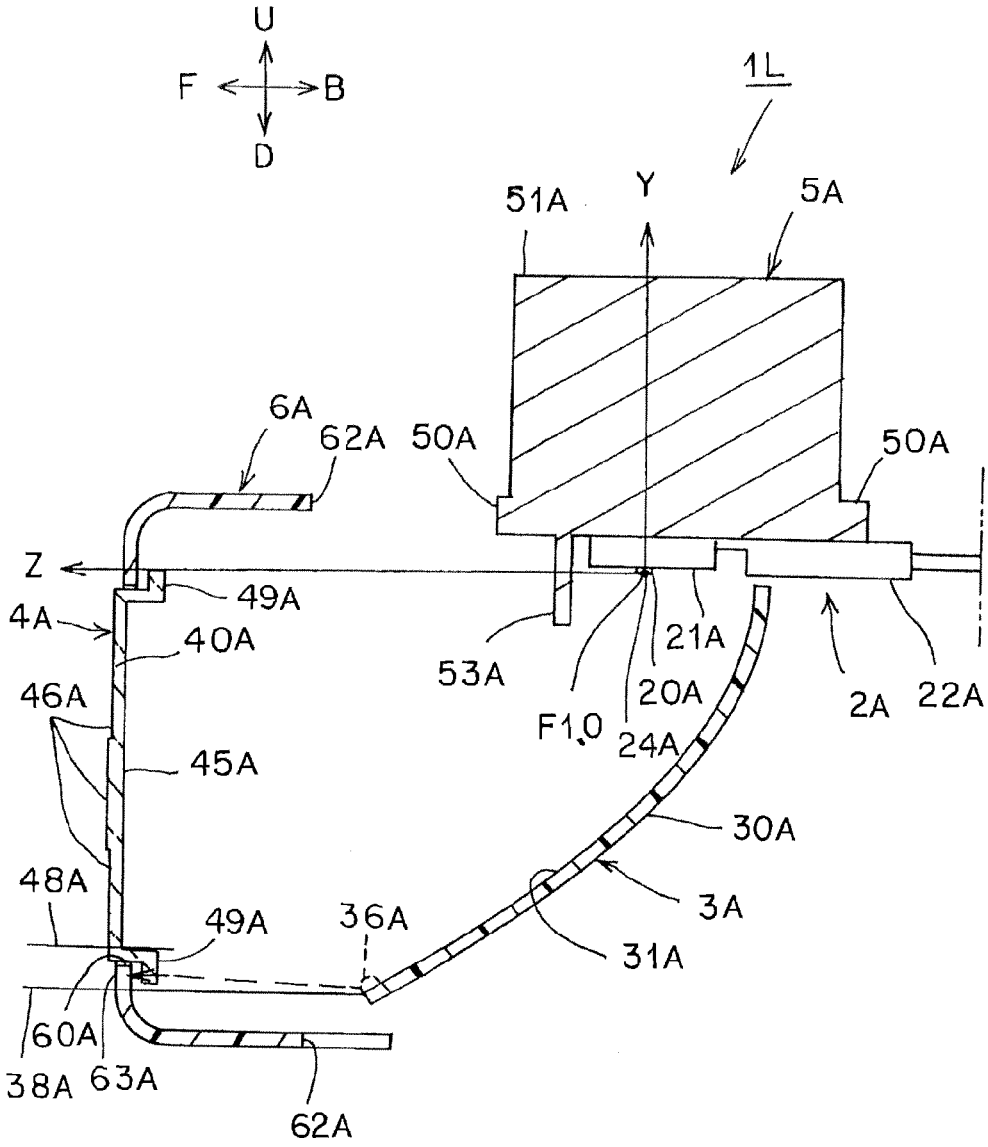
FIG. 21 is a sectional view taken along the line V-V in FIG. 20 (second embodiment)

The present invention provides as shown in FIG. 21, a semiconductor-type light source 2A, a reflector 3A, and a lens 4A. The semiconductor-type light source 2A has a downward light emission surface 24A. The reflector 3A has a reflection surface 31A. The lens 4A has a plurality of convex surfaces (emission surfaces 46A) and a lens portion 40A. At least a part of a lower end part 38A of the reflection surface 31A is positioned on a lower side D than a lower end part 48A of the lens portion 40A. As a result, according to the present invention, a good light distribution pattern for low beam LP can be obtained.

In the conventional vehicle headlamp, a reflection surface of a reflector is formed by means of vapor deposition. Reflected light, in other words, the light that is reflected in this vapor deposition bank, is not controlled in light distribution. As a result, the reflected light from the vapor deposition bank is transmitted through a scattering portion prism, and there may be a case in which stray light is generated. In this case, there may be a case in which a good light distribution pattern cannot be obtained.

A problem to be solved by the present invention is that in the conventional vehicle headlamp, there may be a case in which a good light distribution pattern (a light distribution pattern for low beam) cannot be obtained.

Hereinafter, a configuration of the vehicle headlamp in the second embodiment will be described. A reference codes 1L and 1R designate the vehicle headlamps in the second embodiment (such as headlamps, for example). The vehicle headlamps 1L and 1R described previously are mounted on both of the left and right end parts of a front portion of a vehicle C for right side cruising. Hereinafter, a left side vehicle headlamp 1L that is to be mounted on a left side L of the vehicle C will be described. It is to be noted that a right side headlamp 1R that is to be mounted on a right side R of the vehicle C is made of the constituent elements that are substantially identical to those of the left side vehicle headlamp 1L (Description of Vehicle Headlamp 1L)

The vehicle headlamp 1L described previously, as shown in FIG. 18 to FIG. 21, is provided with a lamp housing (not shown), a lamp lens (not shown), a semiconductor-type light source 2A, a reflector 3A, a lens 4A, a heat sink member 5A, and a cover member 6A.

The semiconductor-type light source 2A, the reflector 3A, the lens 4A, the heat sink member 5A, and the cover member 6A configure a lamp unit. The lamp housing and the lamp lens define a lamp room (not shown). The constituent elements 2A, 3A, 4A, 5A, and 6A that configure the lamp unit are disposed in the lamp room, and further, are mounted to the lamp housing via an optical axis adjustment mechanism for vertical direction (not shown) and an optical axis adjustment mechanism for transverse direction (not shown).

(Description of Semiconductor-Type Light Source 2A)

Figure 18:
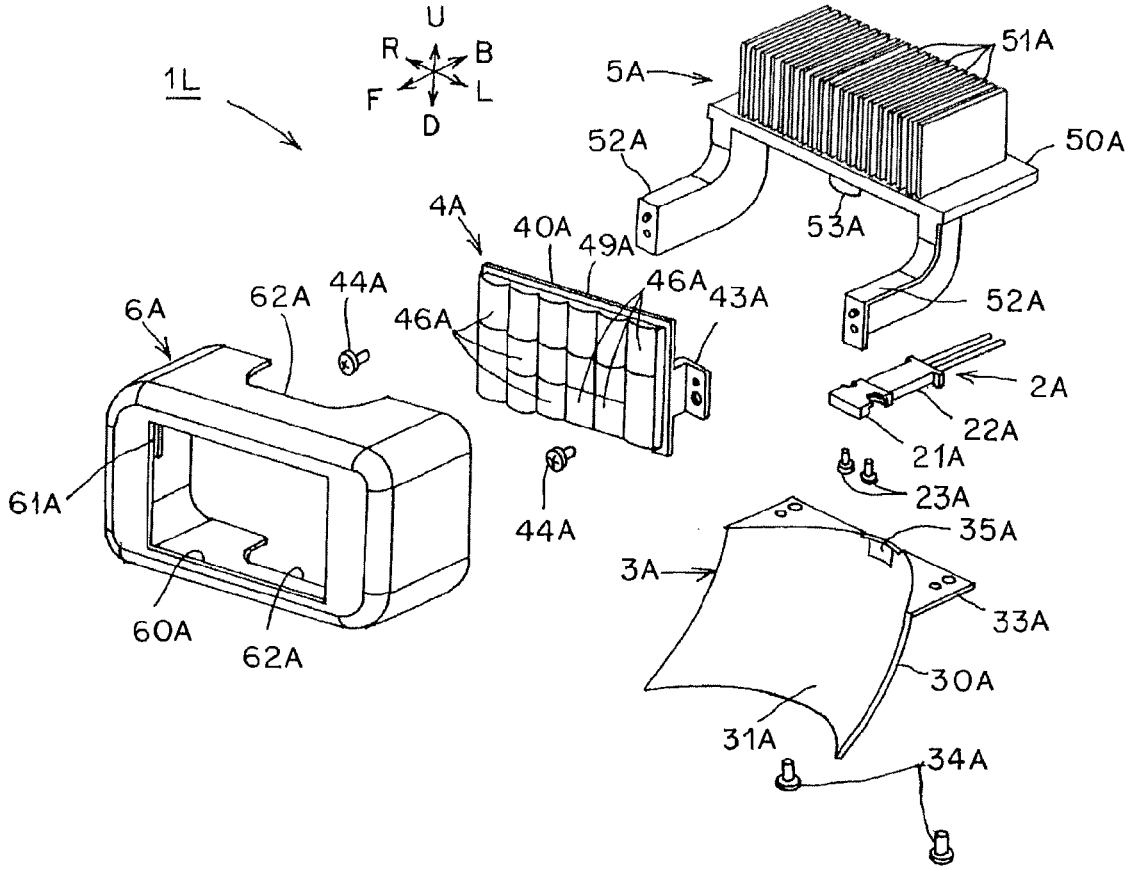
FIG. 18 is an exploded perspective view showing a left side lamp unit (second embodiment)
Figure 19:
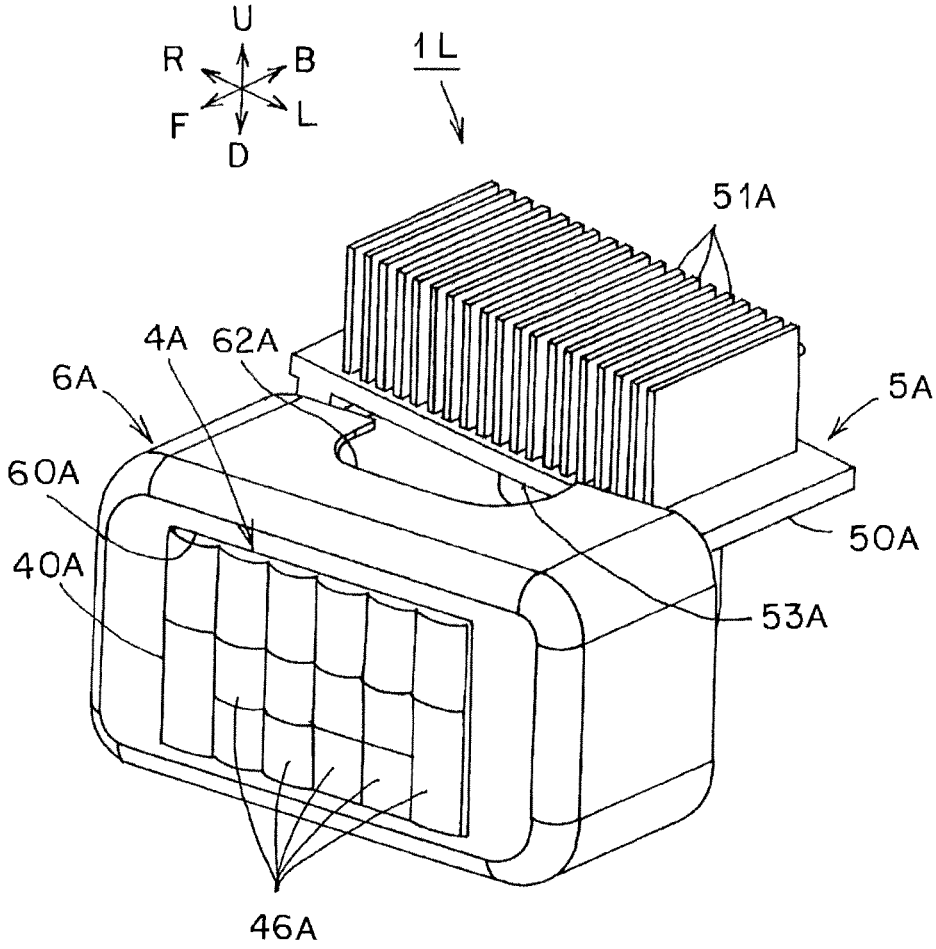
FIG. 19 is a perspective view showing the left side lamp unit (second embodiment)

The semiconductor-type light source 2A, as shown in FIG. 18 and FIG. 21, corresponds to a self-emitting semiconductor-type light source such as an LED or an EL (an organic EL), for example. The semiconductor-type light source 2A is made of: a light emitting chip (an LED chip) 20A; a package (an LED package) that seals the light emitting chip 20A with a sealing resin member; a board 21A that mounts the package; a connector 22A that is mounted to the board 21A and that supplies an electric current from a power source (a battery) to the light emitting chip 20A. The board 21A is fixed to the heat sink member 5A by means of a screw 23A. As a result, the semiconductor-type light source 2A is fixed to the heat sink member 5A.

The light emitting chip 20A is formed in a planar rectangular shape (a planar elongated shape). In other words, four square chips are arranged in an X-axis direction (in a horizontal direction). It is to be noted that two, three, or five or more square chips or one elongated chip, or one square chip may also be used. A surface (a lower surface) of the lower side D of the elongated shape of the light emitting chip forms a light emission surface 24A. As a result, the light emission surface 24A is oriented to the lower side D. A center O of the light emission surface 24A of the light emitting chip 20A is positioned at or near a reference focal point F1 of the reflector 2A, and is positioned on or near a reference optical axis (a reference axis) Z of the reflector.

Figure 20:
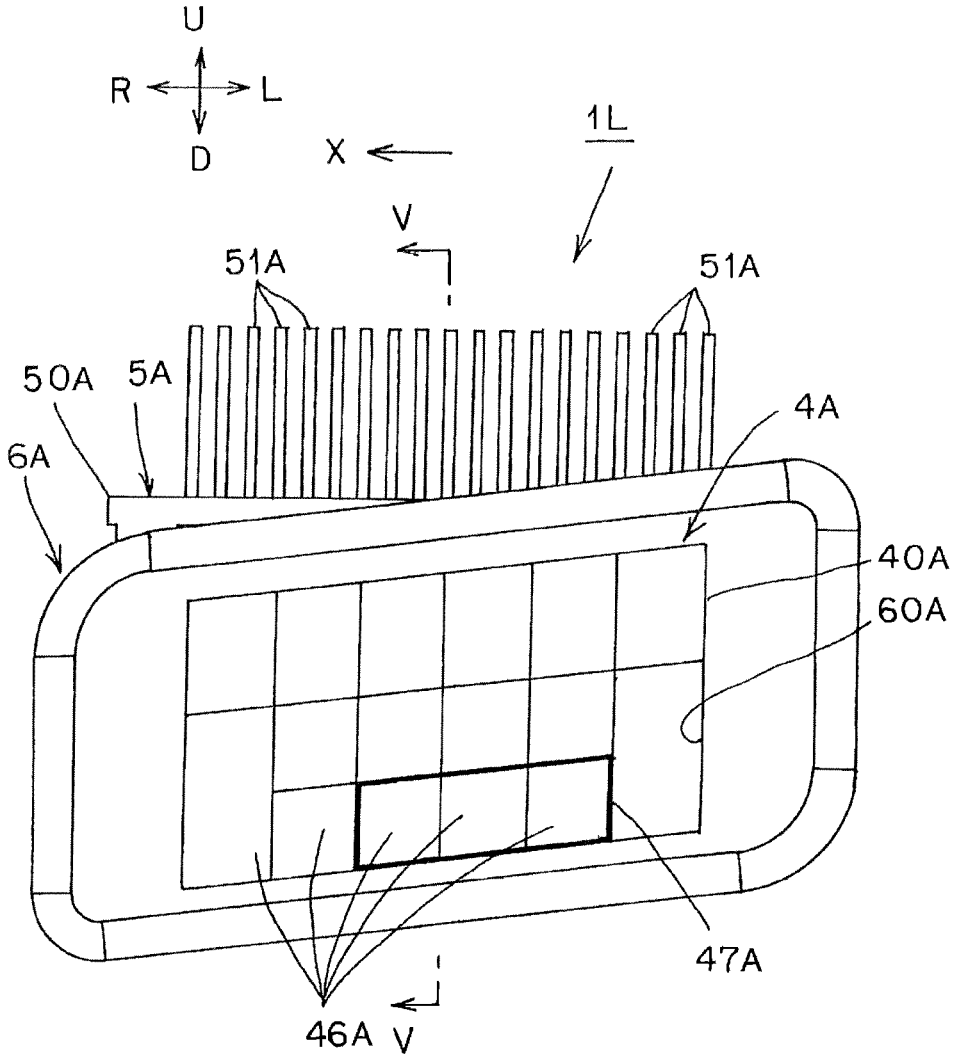
FIG. 20 is a front view showing the left side lamp unit (second embodiment)

In FIG. 20 and FIG. 21, the X, Y, and Z axes configure an orthogonal coordinate (an X-Y-Z orthogonal coordinate system). The X axis designates a horizontal axis that is defined in a transverse direction that passes through the center O of the light emission surface 24A of the light emitting chip 20A. On the X axis, the inside of the vehicle C, in other words, in the second embodiment the right side designates a positive direction, and the outside of the vehicle C, in other words, in the second embodiment the left side L designates a negative direction. In addition, the Y axis designates a vertical axis (a vertical line, a normal line, or a perpendicular line) that passes through the center O of the light emission surface 24A of the light emitting chip 20A. On the Y axis, in the second embodiment, the upper side designates a positive direction, and the lower side D designates a negative direction. Further, the Z axis designates a reference optical axis Z of the reflector 3A, and designates an axis that is defined in a forward/backward direction that passes through the center O of the light emission surface 24A of the light emitting chip 20A and that is orthogonal to the X axis and the Y axis. On the Z axis, in the second embodiment, the front side F designates a positive direction, and the rear side B designates a negative direction.

(Description of Reflector 3A)

The reflector 3A, as shown in FIG. 18, is made of a reflection portion 30A and a mount portion 33A. The mount portion 33A is fixed to the heat sink member 5A by means of a screw 34A. As a result, the reflector 3A is fixed to the heat sink member 5A.

A reflection surface 31A that is formed of one continuous surface is provided on a surface (an interior surface) of a front side F of the reflection portion 30A. The reflection surface 31A is a reflection surface that is made of a parabolic free curved surface. As a result, the reflection surface 31A (the reflector 31A) has the reference focal point F1 and the reference optical axis Z.

Figure 22:
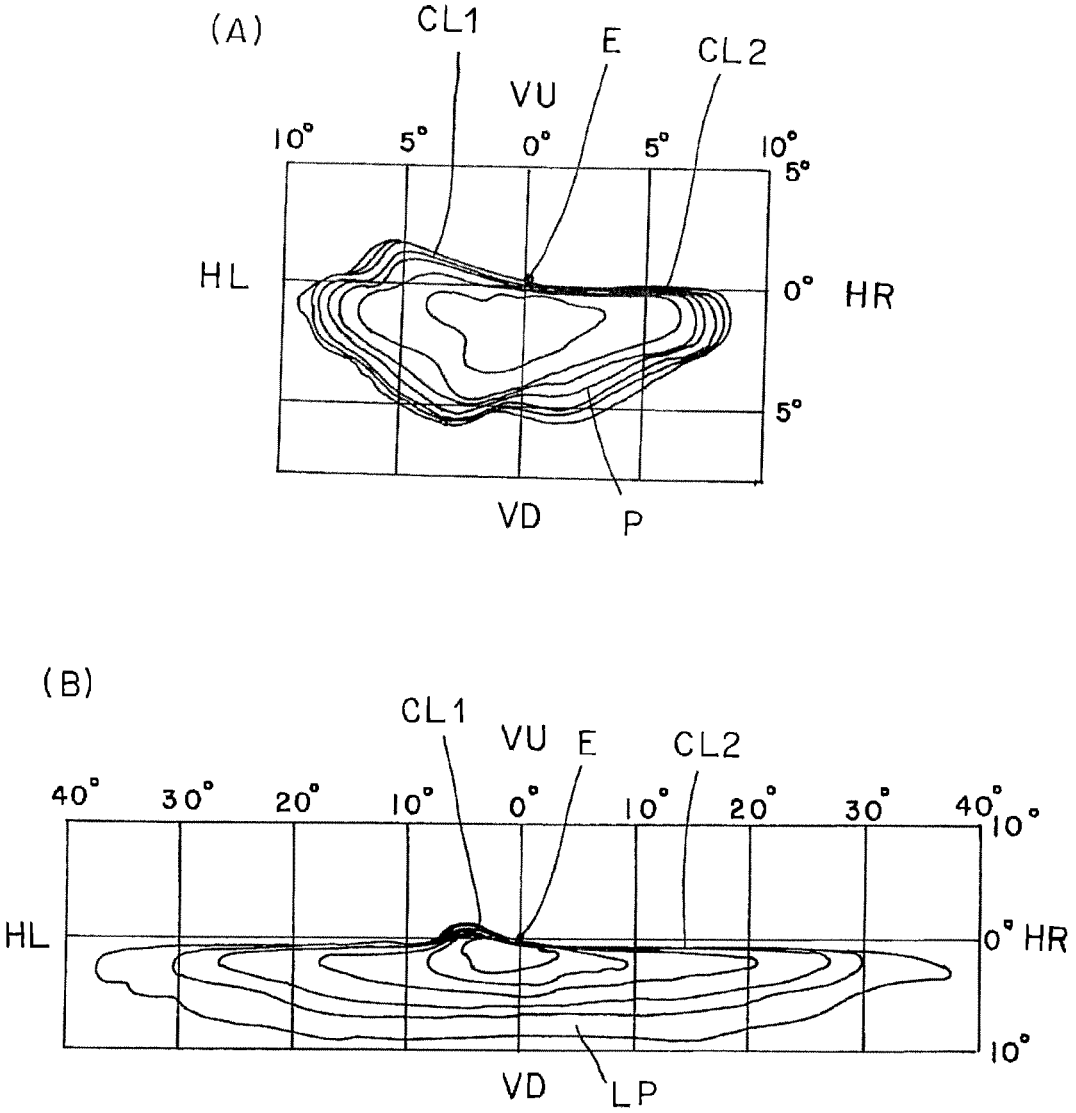
FIG. 22 is an explanatory view showing a basic light distribution pattern that is obtained after reflected by a reflector and a light distribution pattern that is obtained after transmitted through a lens (second embodiment)

The reflection surface 31A is a reflection surface of a free curved surface to reflect light from the light emission surface 24A of the semiconductor-type light source 2A as a basic light distribution pattern P that has an oblique cutoff line CL1, a horizontal cutoff line CL2, and an elbow point E (a cross point between the oblique cutoff line CL1 and the horizontal cutoff line CL2 or its proximal point), shown in FIG. 22 (A). Here, in the basic light distribution pattern P, a smooth light distribution pattern that prevents missing of light is formed at a portion from about 5 degrees to the order of about 10 degrees on the left side of a horizontal line HL-HR from the left to right of a screen.

The reflection surface 31A is formed by means of vapor deposition. A structure of the vapor deposition is a structure in which an undercoat layer for enhancing intimacy is formed on a surface of a base material for the reflector 3A; next, on the aluminum vapor deposition layer, an aluminum vapor deposition layer as a reflection surface is formed; and further, on the aluminum vapor deposition layer, a top coat layer for enhancing weather resistance is formed. At the time of the vapor deposition, a vapor deposition bank 36A (refer to a portion indicated by the dotted line in FIG. 21) is formed at a lower end part of the reflection surface 31A of the reflector 3A.

(Description of Auxiliary Reflection Surface 35)

An auxiliary reflection surface 35A is provided at a center part of an upper edge of the reflector 3A, in other words, at a portion that corresponds to a shade portion 53A of the heat sink member 5A. The auxiliary reflection surface 35A is configured to reflect a part (not shown) of the light from the semiconductor-type light source 2A in such a manner as to cross the shade portion 53A of the heat sink member 5A. The reflected light (not shown) that is obtained by crossing the shade portion 53A of the heat sink member 5A is transmitted through the lens 4A and then the thus transmitted light is emitted forward (to the front side F) of the vehicle C as a predetermined light distribution pattern, or alternatively, the above reflected light is transmitted through a window portion (not shown) that is provided at the cover member 6A and then the thus transmitted light is emitted to the outside of the vehicle C as a predetermined light distribution pattern (not shown).

(Description of Lens 4A)

The lens 4A, as shown in FIG. 18 to FIG. 21, is made of: a lens portion 40A that is formed in a rectangular shape in front view; an engagement portion 49A that is integrally provided at the periphery of the lens portion 40A; and a mount portion 43A that is integrally provided on each of the left and right of the engagement portion 49A. The engagement portion 49A is lower by one stage to a rear side B than the lens portion 40A. Of the engagement portion 49A, at least on an incidence surface (that may include a full reflection surface), a scattering surface or a light shading surface such as grain (not shown) is provided. The mount portion 43A is fixed to the heat sink member 5A by means of a screw 44A. As a result, the lens 4A is fixed to the heat sink member 5A. A distance in a forward/backward direction between the lens 4A and the reflector 3A is short.

The lens 40A of the lens 4A corresponds to a lens that has a plurality of convex surfaces (a thin lens or a prism lens). The lens portion 40A of the lens 4A tilts (slants) from the inside (the right side R) of the vehicle C to the outside (the left side L), in other words, from the front side F to the rear side B of the vehicle C in the planar viewing of the vehicle C, and tilts (slants) (rises up) from the inside (the right side R) to the outside (the left side) of the vehicle C, in other words, from the lower side D to the upper side U of the vehicle C.

An incidence surface 45A is provided on an interior surface (a surface of the rear side B) of the lens portion 40A. An emission surface 46A is provided on an exterior surface (on a surface of the front side F) of the lens portion 40A of the lens 4A. The incidence surface 45A is formed in the shape of a planar or composite quadrature curved surface. The emission surface 46A is the convex surface, and is formed in the shape of a convex-shaped free curved surface. As a result, the lens portion 40A of the lens 4A is formed in the shape of a cylindrical lens portion (a prism lens portion) of which an axis is in a vertical direction.

The lens portion 40A is configured to emit the basic light distribution pattern P from the reflection surface 31A forward of a vehicle as a light distribution pattern for low beam LP that has an oblique cutoff line CL1, a horizontal cutoff line CL2, and an elbow point E, as shown in FIG. 22 (B).

Of the lens portion 40A, a portion that is a portion of the lower side D, and that is central (a portion in a range enclosed by the thick solid line in FIG. 20), is a lowly scattering portion 47A. The lowly scattering portion 47A is a portion that is configured to emit a spot light distribution that is a portion at or near the elbow point of the basic light distribution pattern P as a spot light distribution that is a portion at or near the elbow point E of the light distribution pattern for low beam LP. In other words, the lowly scattering portion 47A is configured to lowly scatter the elbow point E and its proximity of the basic light distribution pattern P and then form the elbow point E and its proximity of the light distribution pattern for low beam LP. The convex surface (the emission surface 46A) of the lowly scattering portion 47A is formed in the shape of a convex surface of which a radius of curvature is large. It is to be noted that there may be a case in which a part of the convex surface (the emission surface 46A) of the lowly scattering portion 47A is formed in the shape of a planer surface. In this case, there may be a case in which the elbow point E of the basic light distribution pattern P and a part of its proximity is transmitted as it is.

A majority of the convex surface (the emission surface 46A) of the other portions excluding the lowly scattering portion 47A (an outside portion in the range enclosed by the thick solid line in FIG. 20) is formed in the shape of a convex surface of which a radius of curvature is smaller than that of the lowly scattering portion 47A. Of the other portions, the convex surface (the emission surface 46A) of a portion that is adjacent to the lowly scattering portion 47A may be formed in the shape of a convex surface which is planer and of which a radius of curvature is large.

(Description of Relative Position Relationship between Lower End Part 38A of Reflection Surface 31A and Lower End Part 48A of Lens Portion 40A)

As shown in FIG. 21, at least a part of a lower part 38A of the reflection surface 31A is positioned on a lower side D than the lower end part 48A of the lens portion 40A.

The lower end part 38A of the reflection surface 31A that is positioned on the lower side than the lower end part 48A is a portion that corresponds to the lowly scattering portion 47A of the lens portion 40A. It is to be noted that all of the lower end part 38A of the reflection surface 31A may be positioned on a lower side D than a lower end part 48A of the lens portion 40A.

(Description of Heat Sink Member 5A)

The heat sink member 5A, as shown in FIG. 18 to FIG. 21, is made of a horizontal plate portion 50A, a fin portion 51A, a mount portion 52A, and the shade portion 53A. On one surface of the horizontal plate portion 50A (on a surface of the lower side D), the semiconductor-type light source 2A and the reflector 3A are respectively mounted by means of the screws 23A and 24A.

A plurality of the fin portions 51A, a respective one of which is formed in the shape of a vertical plate, are integrally provided on the other surface (on a face of the upper side U) of the horizontal plate portion 50A. The fin portions 51A are configured to radiate a heat that is generated on the light emitting chip 20A of the semiconductor-type light source 2A to the outside.

The mount portion 52A that is formed in the shape of a curved arc is integrally provided at a respective one of the left and right end parts on edges of the front side F of one surface of the horizontal plate portion 50A. On the mount portion 52A, the lens 4A is mounted by means of the screw 44A.

The shade portion 53A that is formed in a curved shape is integrally provided at a center part of an edge of the front side F of one surface of the horizontal plate portion 50A. The shade portion 53A is configured to prevent the light from the light emission surface 24A of the semiconductor-type light source 2A from being directly incident to the lens portion 40A of the lens 4A.

(Description of Cover Member 6A)

The cover member 6A, as shown in FIG. 18 to FIG. 21, is formed in a hollow cover shape in which a portion of the front side F closes and a portion of the rear side B opens. The cover member 6A is made of an optically impermeable member.

An insert opening portion 60A that is formed in an elongated shape is provided at a portion of the front side F of the cover member 6A. The lens portion 40A of the lens 4A is inserted into the insert opening portion 60A. A mount portion 61A is integrally provided on an edge of a respective one of the left and right sides inside of the insert opening portion 60A of a portion of the front side F of the cover member 6A. The mount portion 61A is mounted to the mount portion 43A of the lens 4A. As a result, the cover member 6A is fixed to the heat sink member 5A via the lens 4A. A ventilation opening portion 62A is provided at a center part of an edge on a respective one of the top and bottom of the opening portion on the rear side B of the cover member 6A.

An edge part of a lower side D of the insert opening portion 60A of the cover member 6A is a shading portion 63 that is configured to shade reflected light from the vapor deposition hank 36A of the lower end part 38A of the reflection surface 31A that is positioned on a lower side D than the lower end part 48A of the lens portion 40A.

(Description of Functions of Second Embodiment)

A respective one of the vehicle headlamps 1L and 1R in the second embodiment is made of the constituent elements as described above, and hereinafter, their related functions will be described.

The light emitting chip 20A of a semiconductor-type light source 2A is lit. A majority of the light that is radiated from the light emission surface 24A of the light emitting chip 20A is then reflected on the side of the lens 4A by means of the reflection surface 31A of the reflector 3A.

Reflected light, in other words, the light that is reflected by means of the first reflection surface 31A, as shown in FIG. 22 (A), is controlled in light distribution so as to be a basic light distribution pattern that has an oblique cutoff line CL1, a horizontal cutoff line CL2, and an elbow point E, and then, the thus controlled light is transmitted through the lens portion 40A of the lens 4A from the incident surface 45A to the emission surface 46A. Emitted light, in other words, the light that is emitted from the lens portion 40A, as shown in FIG. 22 (B), is controlled in light distribution so as to be a light distribution pattern for low beam LP that has an oblique cutoff line CL1, a horizontal cutoff line CL2, and an elbow point E, and then, the thus controlled light is emitted forward of the vehicle C.

At this time, if the light from the light emission surface 24A of the light emitting chip 20A is incident to the vapor deposition bank 36A of the lower end part 38A of the reflection surface 31A, the thus incident light is reflected from the vapor deposition bank 36A as reflected light that is not controlled in light distribution (refer to the dashed arrow in FIG. 21). The thus reflected light that is not controlled in light distribution is prevented from being transmitted through the lens portion 40A of which a lower end part 48A is positioned on an upper side U than the lower end part 38A of the reflection surface 31A. In addition, the reflected light that is not controlled in light distribution is shaded by means of the shading portion 63A. In this manner, the reflected light that is not controlled in light distribution can be prevented from being transmitted through the lens portion 40A which may lead to generation of stray light, and a good light distribution pattern for low beam LP can be obtained.

Of the engagement portion 49A that is integrally provided at the periphery of the lens portion 40A as mentioned here, at least on the incidence surface (that may include the full reflection surface), the scattering surface or light shading surface such as grain is provided. Thus, even if reflected light is incident to the engagement portion 49A, full reflection of the reflected light, which may lead to generation of stray light, can be prevented.

(Description of Advantageous Effect(s) of Second Embodiment)

A respective one of the vehicle headlamps 1L and 1R in the second embodiment is made of the constituent elements and functions described above, and hereinafter, their related advantageous effects will be described.

A respective one of the vehicle headlamps 1L and 1R in the second embodiment is capable of obtaining a good light distribution pattern for low beam LP.

In other words, according to a respective one of the vehicle headlamps 1L and 1R in the second embodiment, at least a part of the lower end part 38A of the reflection surface 31A is positioned on the lower side D than the lower end part 48A of the lens portion 40A. As a result, the reflected light from the vapor deposition bank 36A that is not controlled in light distribution can be prevented from being transmitted through the lens portion 40A of which the lower end part 48A is positioned on the upper side U than the low end part 38A of the reflection surface 31A. In this manner, the reflected light that is not controlled in light distribution can be prevented from being transmitted through the lens 40A which may lead to generation of stray light, and a good light distribution pattern for low beam LP can be obtained.

According to a respective one of the vehicle headlamps 1L and 1R in the second embodiment, the lower end part 38A of the reflection surface 31A that is positioned on the lower side D than the lower end part 48A of the lens portion 40A is a portion of the lens portion 40A that corresponds to the lowly scattering portion 47A configured to lowly scatter the basic light distribution pattern P in the transverse direction. This lowly scattering portion 47A is configured to lowly scatter the reflected light from the vapor deposition hank 36 that is not controlled in light distribution, and then, emit the lowly scattered light to the outside, and thus, the above lowly scattering portion is greatly influenced by stray light. However, according to a respective one of the vehicle headlamps 1L and 1R in the second embodiment, the lower end part 38A of the reflection surface 31A is positioned on the lower side than the lowly scattering portion 47A. As a result, the reflected light from the vapor deposition bank 36A that is not controlled in light distribution can be prevented from being transmitted through the lowly scattering portion 47A of the lens portion 40A of which the lower end part 48A is positioned on the upper side U than the lower end part 38A of the reflection surface 31A. In this manner, the reflected light that is not controlled in light distribution can be prevented from being transmitted through the lens 49A which may lead to generation of stray light with its great influence, and a good light distribution pattern for low beam LP can be obtained.

A respective one of the vehicle headlamps 1L and 1R in the second embodiment is provided with: a light impermeable member configured to shade the reflected light from the vapor deposition bank 36A of the lower end part 38A of the reflection surface 31A that is positioned on the lower side D than the lower end part 48A of the lens portion 40A, in other words, the shading portion 63A of the cover member 6A. As a result, the reflected light from the vapor deposition bank 36A that is not controlled in light distribution is shaded by means of the shading portion 63A. In this manner, the reflected light that is not controlled in light distribution can be prevented from being transmitted through the lens portion 40A which may lead to generation of stray light, and a good light distribution pattern for low beam LP can be obtained.

According to a respective one of the vehicle headlamps 1L and 1R in the second embodiment, even in a case where the lens 4A is changed (replaced) without need to replace the reflector 3A with its replacement, the reflected light from the vapor deposition bank 36A that is not controlled in light distribution can be prevented from transmitted through the lens portion 40A. In this manner, while the reflector 3A is kept unchanged as it is, it is possible to deform (reform) the lens 4A in a various shape (for example, in the shape that rises from the lower side D to the upper side U from the inside to outside of the vehicle C, or alternatively, in the shape that lowers from the upper side U to the lower side D from the inside to outside of the vehicle C).

According to a respective one of the vehicle headlamps 1L and 1R in the second embodiment, the engagement portion 49A configured to engage with the cover member 6A is provided at the periphery of the lens portion 40A, and, of the engagement portion 49A, at least on the incidence surface (that may include the full reflection surface), a scattering surface or a light shading surface such as grain is provided.

Thus, even if reflected light is incident to the engagement portion 49A, full reflection of the reflected light, which may lead to generation of stray light, can be prevented. In particular, as shown in FIG. 21, even if reflected light that is not controlled in light distribution is incident to the engagement portion 49A of the lower end part 48A of the lens portion 40A, full reflection of the reflected light, which may lead to generation of stray light, can be prevented.

According to a respective one of the vehicle headlamps 1L and 1R in the second embodiment, a distance in the forward/backward direction between the lens 4A and the reflector 3A, in other words, a distance from the reflection surface 31A of the reflector 3A to the incidence surface 45A of the lens 4A is short. Thus, even if a shift in relative position between the reflection surface 31A of the reflector 3A and the lens portion 40A of the lens 4A occurs to a certain extent, there will be a less influence as to light distribution control from the basic light distribution pattern P to the light distribution pattern for low beam LP. In other words, light distribution control with its high precision is possible.

(Description of Examples Other Than Second Embodiment)

In the second embodiment, a description will be given with respect to a respective one of the vehicle headlamps 1L and 1R in a case where the vehicle C is intended for use in left side cruising. However, the present invention can be applied to the vehicle headlamps in a case where the vehicle C is intended for use in right side cruising as well.

In addition, in the second embodiment, the reflected light from the vapor deposition bank 36A that is not controlled in light distribution is shaded by means of the shading portion 63A of the cover member 6A. However, in the present invention, in a case where a light impermeable member, for example, an inner panel is disposed on the side of the incidence surface 45A or on the side of the emission surface 46A of the lens 4A, a shading portion may be provided on this inner panel.

Further, in the second embodiment, the emission surfaces 46A of the lens 4A is respectively formed in a plurality of convex surfaces. However, in the present invention, an incidence surface of a lens may be formed in a plurality of convex surfaces, or alternatively, an emission surface and an incidence surface of the lens may be respectively formed in a plurality of convex surfaces.

Furthermore, the second embodiment describes a light distribution pattern for low beam LP that has an oblique cutoff line CL1, a horizontal cutoff line CL2, and an elbow point E as a light distribution pattern. However, in the present invention, as a light distribution pattern, there may be a light distribution pattern that does not have an oblique cutoff line.

(Third Embodiment)

The present invention relates to a vehicle headlamp that is provided with a semiconductor-type light source, a reflector, and a lens that has a plurality of convex surface. In particular, the present invention relates to a vehicle headlamp that is provided in such a manner that an appropriate (ideal) light distribution pattern for low beam (a light distribution pattern for passing) and an appropriate light distribution pattern for high beam (a light distribution pattern for driving) can be obtained.

In such a vehicle headlamp, it has been important to form an appropriate light distribution pattern for low beam and an appropriate light distribution pattern for high beam.

A problem to be solved by the present invention is that it is important that a good light distribution pattern for low beam and a good light distribution pattern for high beam can be obtained.

Figure 23:
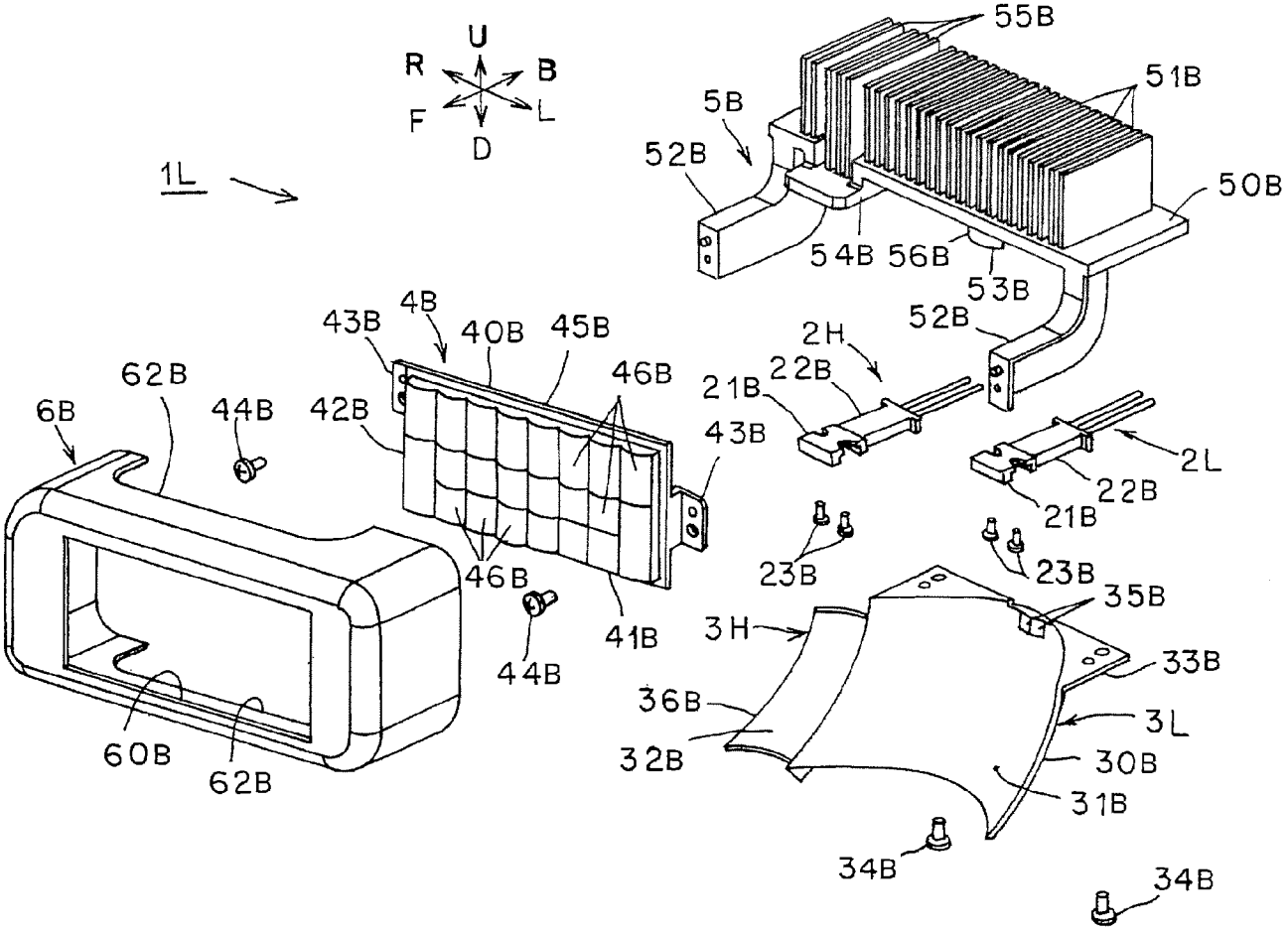
FIG. 23 is an exploded perspective view showing a left side lamp unit (third embodiment)
Figure 24:
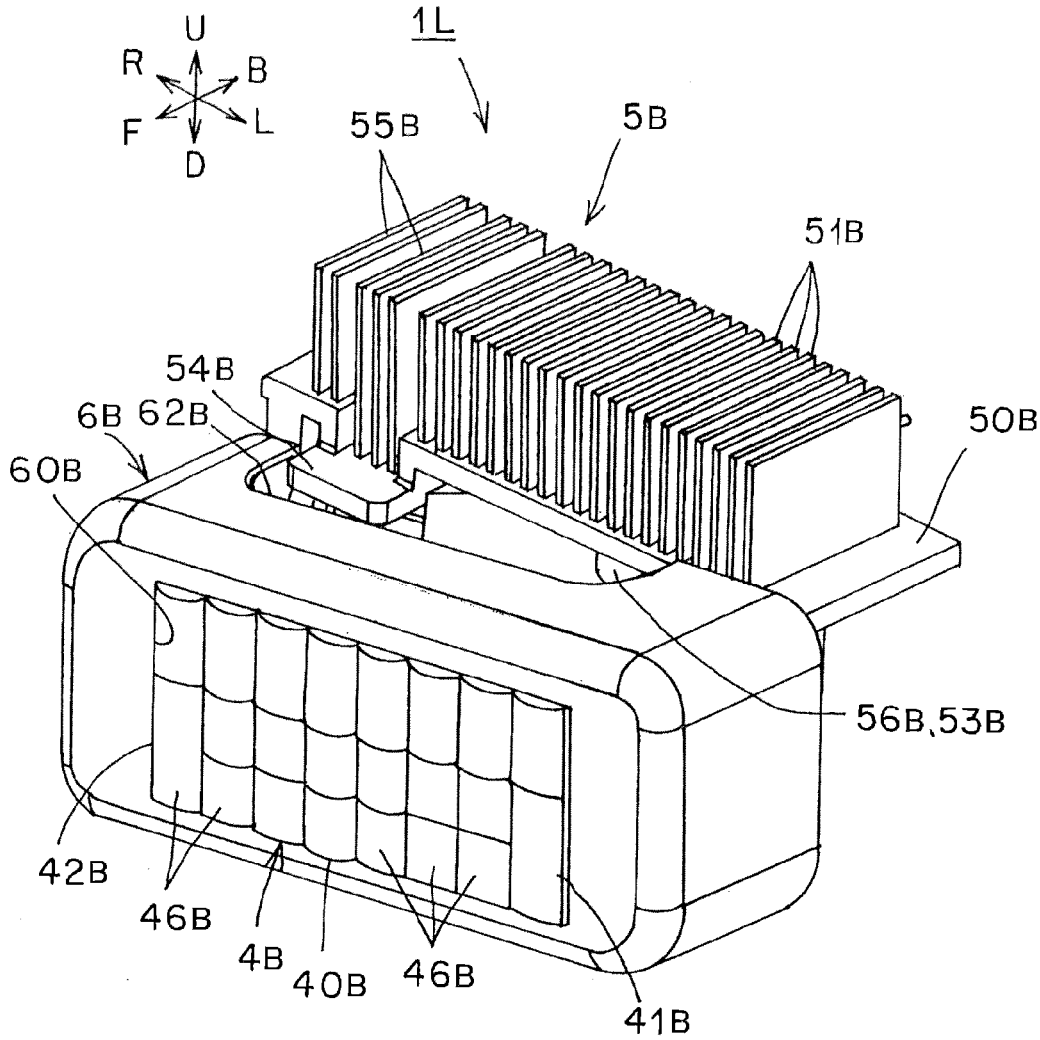
FIG. 24 is a perspective view showing the left side lamp unit (third embodiment)
Figure 25:
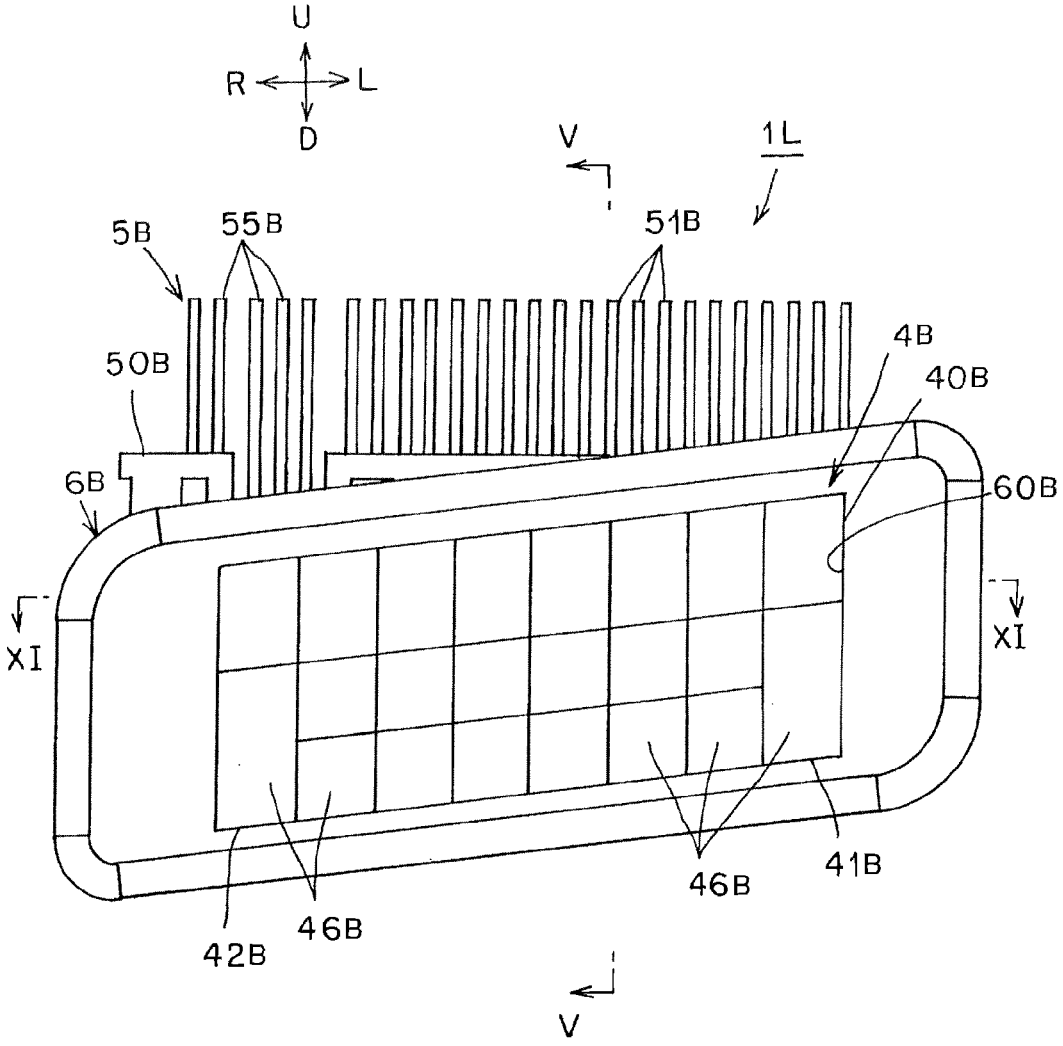
FIG. 25 is a front view showing the left side lamp unit (third embodiment)

The present invention, as shown in FIG. 23 provides a first semiconductor-type light source 2L, a second semiconductor-type light source 2H, a first reflector 3L, a second reflector 3H, and a lens 4B. The first semiconductor-type light source 2L and the second semiconductor-type light source 2H respectively have downward light emission surfaces 24H and 24H. The first reflector 3L and the second reflector 3H respectively have a first reflection surface 31B and a second reflection surface 32B. The lens 4B has a plurality of convex surfaces (emission surfaces 46B), a first lens portion 41B, and a second lens portion 42B. As a result, the present invention is capable of obtaining a good light distribution pattern for low beam LP and a good light distribution pattern for high beam HP.

Hereinafter, a configuration of the vehicle headlamp in the third embodiment will be described. A reference codes 1L and 1R designate the vehicle headlamps in the third embodiment (such as headlamps, for example). The vehicle headlamps 1L and 1R described previously are mounted on both of the left and right end parts of a front portion of a vehicle C for right side cruising. Hereinafter, a left side vehicle headlamp 1L that is to be mounted on a left side L of the vehicle C will be described. It is to be noted that a right side headlamp 1R that is to be mounted on a right side R of the vehicle C is made of the constituent elements that are substantially identical to those of the left side vehicle headlamp 1L.

(Description of Vehicle Headlamp 1L)

The vehicle headlamp 1L, as shown in FIG. 23 to FIG. 26, is provided with: a lamp housing (not shown); a lamp lens (not shown); a first semiconductor-type light source (a semiconductor-type light source for low beam) 2L; a second semiconductor-type light source (a semiconductor-type light source for high beam) 2H; a first reflector (a reflector for low beam) 3L; a second reflector (a reflector for high beam) 3H; a lens 4; a heat sink member 5B; and a cover member 6B.

The first semiconductor-type light source 2L; the second semiconductor-type light source 2H and the first reflector 3L; and the second reflector 3H and the lens 4B and the heat sink member 5B and the cover member 6B constitute lamp units. The lamp housing and the lamp lens define a lamp room (not shown). The lamp units 2L, 2H, 3L, 3H, 4B, 5B, and 6B are disposed in the lamp room, and are mounted to the lamp housing via an optical axis adjustment mechanism for vertical direction (not shown) and an optical axis adjustment mechanism for horizontal direction (not shown).

(Description of First Semiconductor-Type Light Source 2L and Second Semiconductor-type Light Source 2H)

Figure 26:
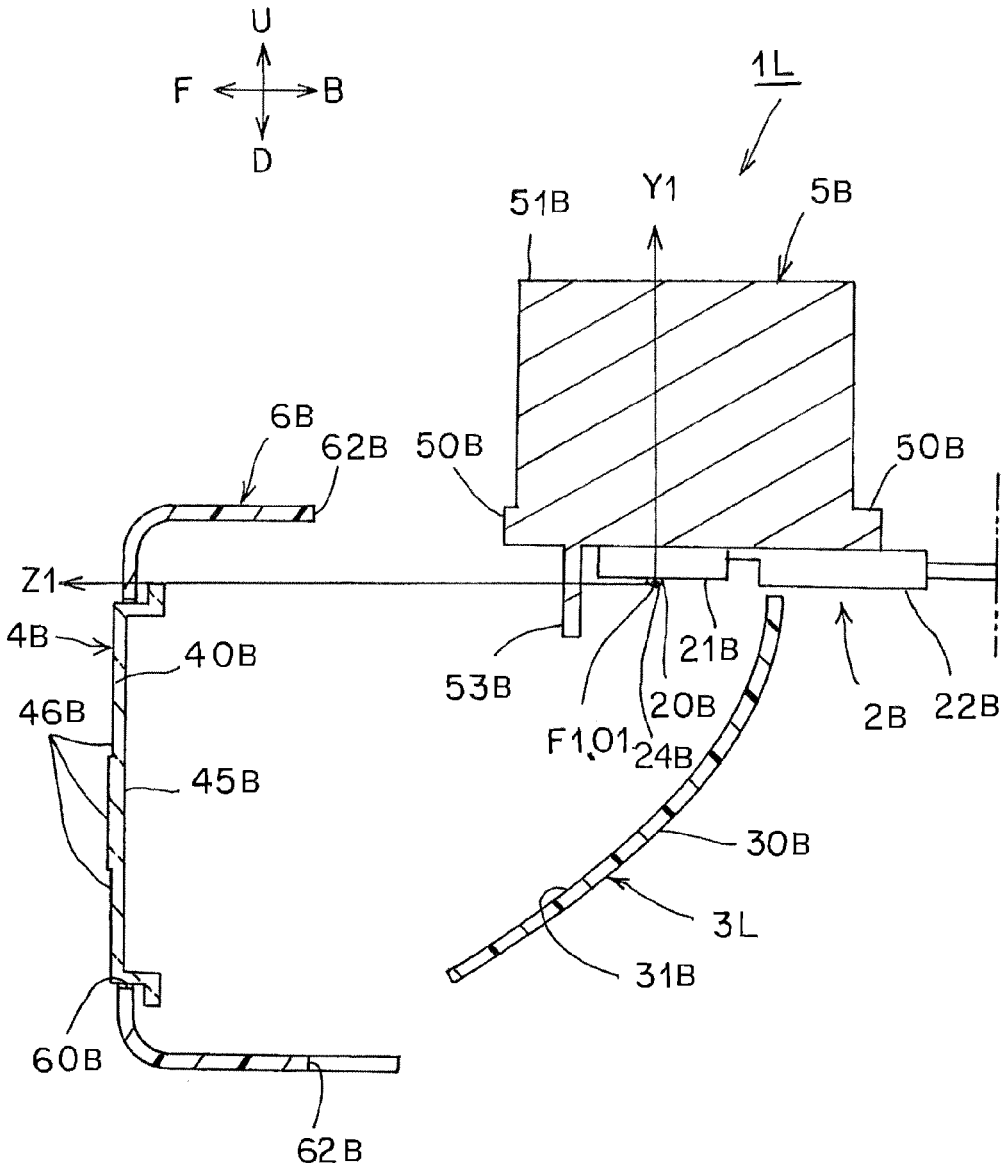
FIG. 26 is a sectional view taken along the line V-V in FIG. 25 (third embodiment)

The first semiconductor-type light source 2L and the second semiconductor-type light source 2H, as shown in FIG. 23 and FIG. 26, are respectively a self-emission semiconductor-type light source such as an LED or an EL (an organic EL), for example, in this example. The first semiconductor-type light source 2L and the second semiconductor-type light source 2H are respectively made of: light emission chips (LED chips) 20L and 20H; packages (LED packages) to seal the light emission chips 20L and 20H with the use of a sealing resin member; a board 21B implementing the packages; and a connector 22B which is mounted to the board 21B, and which supplies a current from a power source (a battery) to the light emission chips 20L and 20H. The board 21B is fixed to the heat sink member 5B by means of a screw 23B. As a result, the first semiconductor-type light source 2L and the second semiconductor-type light source 2H are fixed to the heat sink 5B.

Figure 30:
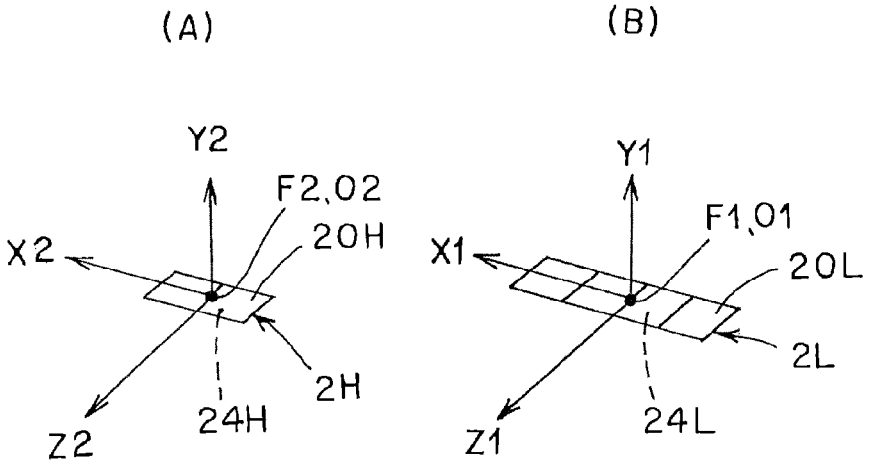
FIG. 30 is an explanatory view showing light emission chips (light emission surfaces) of a first semiconductor-type light source and a second semiconductor-type light source (third embodiment)

The light emission chip 20L of the first semiconductor-type light source 2L, as shown in FIG. 30 (B), forms a planar rectangle shape (a planar elongated shape). In other words, a plurality of, for example, four square chips are arranged in an X1 axis direction (in a leftward and rightward horizontal direction, although not shown). It is to be noted that one elongated chip or one square chip may be used. A surface (a lower surface) on a lower side D of an elongated shape of the light emission chip 20L forms a light emission surface 24L. As a result, the light emission surface is oriented to the lower side D. A center O1 of the light emission surface 24L of the light emission chip 20L is positioned at or near a reference focal point F1 of the first reflector 3L, and is also positioned on or near a reference optical axis (a reference axis) Z1 of the first reflector 3L.

The light emission chip 20H of the second semiconductor-type light source 2H, as shown in FIG. 30 (A), forms a planer rectangle shape (a planer elongated shape). In other words, a plurality of, for example, two square chips are arranged in an X2 axis direction (in a leftward and rightward horizontal direction, although not shown). As a result, the light emission luminous quantity of the second semiconductor-type light source 2H is smaller than the light emission luminous quantity of the first semiconductor-type light source 2L. It is to be noted that one elongated chip or one square chip may be used. A surface (a lower surface) on the lower side D of an elongated shape of the light emission chip 20H forms a light emission surface 24H.

As a result, the light emission surface 24H is oriented to the lower side D. A center O2 of the light emission surface 24H of the light emission chip 20H is positioned at or near a reference focal point F2 of the second reflector 3H, and is also positioned on or near a reference optical axis a reference axis) Z2 of the second reflector 3H.

In FIG. 30, the axes X1, Y1, Z1, X2, Y2, and Z2 constitute a quadrature coordinate (an X-Y-Z quadrature coordinate system). The X axes (X1 and X2) are horizontal axes in a leftward and rightward direction passing through the centers O1 and O2 of the light emission surfaces 24L and 24H of the light emission chips 20L and 20H. As far as the X axes are concerned, the inside of a vehicle C, in other words, in the third embodiment, the right side R is a positive direction, and the outside of the vehicle C, in other words, in the third embodiment, the left side L is a negative direction. In addition, the Y axes (Y1 and Y2) are vertical axes (perpendicular axes, normal lines, and perpendiculars) in a vertical direction passing through the center O1 and O2 of the light emission surfaces 24L and 24H of the light emission chips 20L and 20H. As far as the Y axes are concerned, in the third embodiment, the upper side U is a positive direction, and the lower side D is a negative direction. Further, the Z axes (Z1 and Z2) are respectively reference optical axes Z1 and Z2 of the first reflector 3L and the second reflector 3H, and the axes in a forward and backward direction passing through the center O1 and O2 of the light emission surfaces 24L and 24H of the light emission chips 20L and 20H, the forward and backward direction being orthogonal to the light emission chips 20L and 20H. As far as the X axes (Z1 and Z2) are concerned, in the third embodiment, the foreside F is a positive direction, and the backside B is a negative direction.

(Description of First Reflector 3L and Second Reflector 3H)

The first reflector 3L and the second reflector 3H, as shown in FIG. 23, are integrally made of a first reflection portion 30B, a second reflection portion 36B, and a mount portion 33B. The mount portion 33B is fixed to the heat sink member 5B by means of a screw 34B. As a result, the first reflector 3L and the second reflector 3H are fixed to the heat sink member 5B. It is to be noted that the first reflection portion 30B of the first reflector 3L and the second reflection portion 36B of the second reflector 3H are separately constituted, and a respective one of these reflection portions may be fixed to the heat sink member 5B via the mount portion.

On a surface (an interior surface) of the foreside F of the first reflection portion 30B, a first reflection surface 31B formed on one continuous surface is provided. On a surface (an interior surface) of the foreside F of the reflection portion 36B, a second reflection surface 32B formed on one continuous surface is provided. The first reflection surface 31B and the second reflection surface 32B are respectively reflection surfaces made of parabolic free curved surfaces. As a result, the reflection surface 31B and the second reflection surface 32B (the first reflector 3L and the second reflector 3H) respectively have the reference focal points F1 an F2 and the reference optical axes Z1 and Z2.

The first reflection surface 31B is a reflection surface of a free curved surface to reflect light from the light emission surface 24L of the first semiconductor-type light source 2L as a first basic light distribution pattern (a basic light distribution pattern for low beam, although not shown) having an oblique cutoff line, a horizontal cutoff line, and an elbow point (a cross point between the oblique cutoff line and the horizontal cutoff line or its proximal point). The second reflection surface is a reflection surface of a free curved surface to reflect light from the light emission surface 24H of the second semiconductor-type light source 2H as a second light distribution pattern (a basic light distribution pattern for low beam, although not shown) having a high luminous intensity zone, although not shown.

Figure 27:
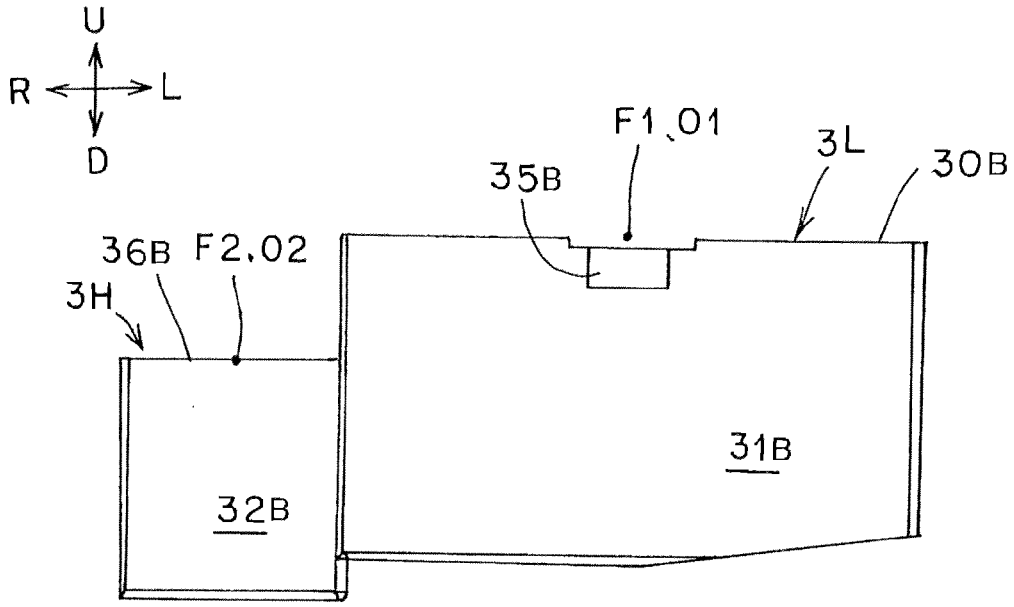
FIG. 27 is a front view showing a first reflector and a second reflector (third embodiment)
Figure 29:
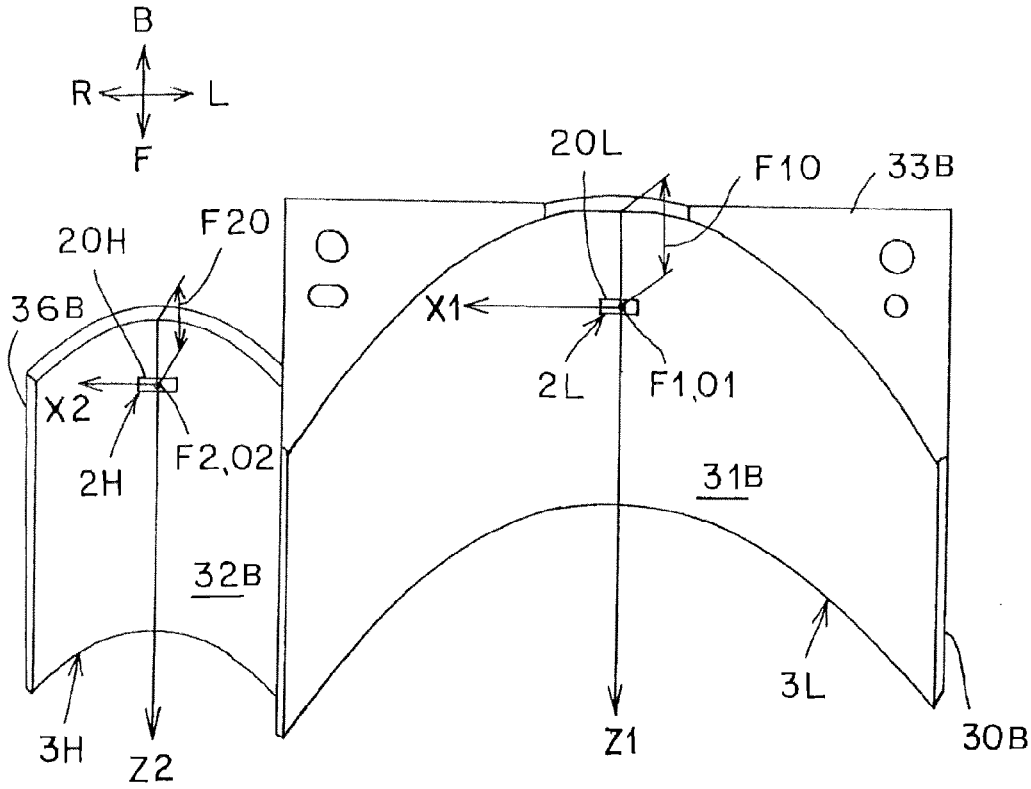
FIG. 29 is a front view showing a first reflector and a second reflector (third embodiment)
Figure 32:
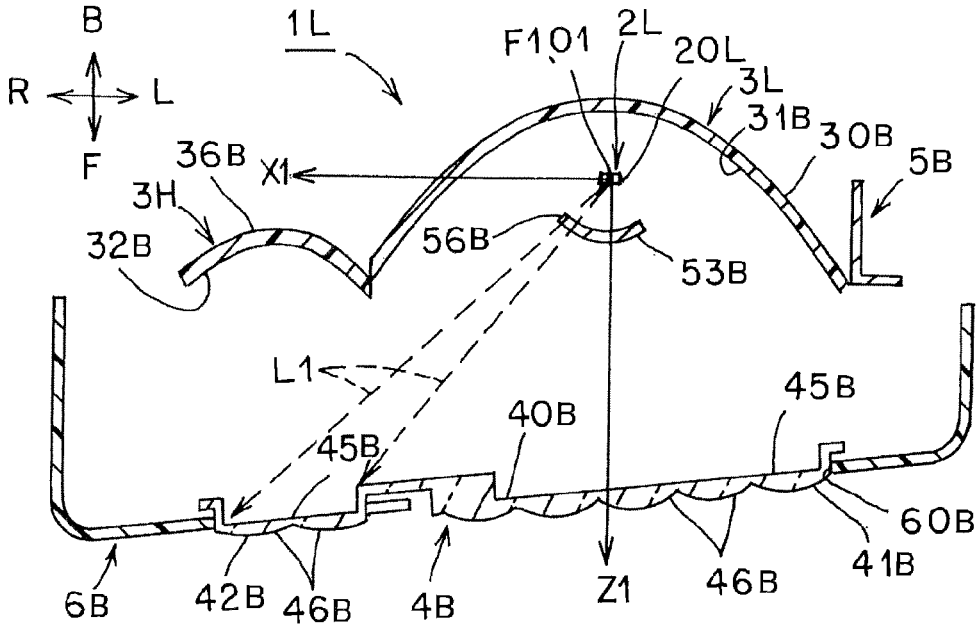
FIG. 32 is a sectional view taken along the line XI-XI in FIG. 25 (third embodiment)

The second reflector 3H (the second reflection portion 36B) is positioned at the inside (the right side R) of the vehicle C more than the first reflector 3L (the first reflection portion 30B) (refer to FIG. 27, FIG. 29, and FIG. 32). The second reflector 3H is positioned at the lower side D of the vehicle C in comparison with the first reflector 3L (refer to FIG. 27). The second reflector 3H is positioned at the foreside F of the vehicle C in comparison with the first reflector 3L (refer to FIG. 29 and FIG. 32). A reference focal point distance F20 of the second reflection surface 32B is shorter than a reference focal point distance F10 of the first reflection surface 31B (refer to FIG. 29).

(Description of Auxiliary Reflection Surface 35B)

An auxiliary reflection surface 35B is provided at a center part of an upper edge of the first reflector, in other words, at a portion corresponding to a shade portion 53B of the heat sink member 5B. The auxiliary reflection surface 35B is intended to reflect a part (not shown) of the light from the semiconductor-type light source 2B so as to cross the shade portion 53B of the heat sink member 5B. The reflected light (not shown) crossing the shade portion 53B of the heat sink member 5B is transmitted through the lens 4B and then the resultant light is emitted forward (foreside F) of the vehicle C as a predetermined light distribution pattern (not shown), or alternatively, the above reflected light is transmitted through a window portion (not shown) that is provided at the cover member 6B and then the resultant light is emitted outside of the vehicle C as a predetermined light distribution pattern (not shown).

(Description of Lens 4B)

The lens 4, as shown in FIG. 23 to FIG. 26, is made of: a lens portion 40B forming an elongated shape in front view; and a mount portion 43B. The mount portion 43B is fixed to the heat sink member 5B by means of a screw 44B. As a result, the lens 4B is fixed to the heat sink member 5B. A distance in the forward and backward direction between the lens 4B and the first reflector 3L and the second reflector 3H is short.

The lens portion 40B is a lens (a thin lens or a prism lens) having a plurality of convex surfaces. The lens portion 40B of the lens 4B tilts (slants) from the foreside F to the backside of the vehicle C from the inside (the right side R) to the outside (the left side L) of the vehicle C in planer view of the vehicle C, and tilts (slants) and (rises) from the lower side D to the upper side U of the vehicle C from the inside (the right side R) to the outside (the left side L) of the vehicle C in front viewing of the vehicle C. It is to be noted that in a case where the lens portion 40B does not slant, the second reflector 3H and the first reflector 3L are positioned on a side by side basis.

An incidence surface 45B is provided on the interior surface of the lens portion 40B of the lens 4B (on a surface of the rear side B). A respective one of emission surfaces 46B and 47B is provided on the exterior surface of the lens portion 4B of the lens 4B (on a surface of the front side F). The incidence surface 45B is formed in a planar or composite quadrature curved surface. The emission surfaces 46B and 47B are respectively made of a plurality of the convex surfaces, and are respectively formed in a convex shaped free curved surface. As a result, the lens portion 40B of the lens 4B is formed in the shape of a cylindrical lens portion (a prism lens portion) of which an axis is in a vertical direction.

Figure 28:
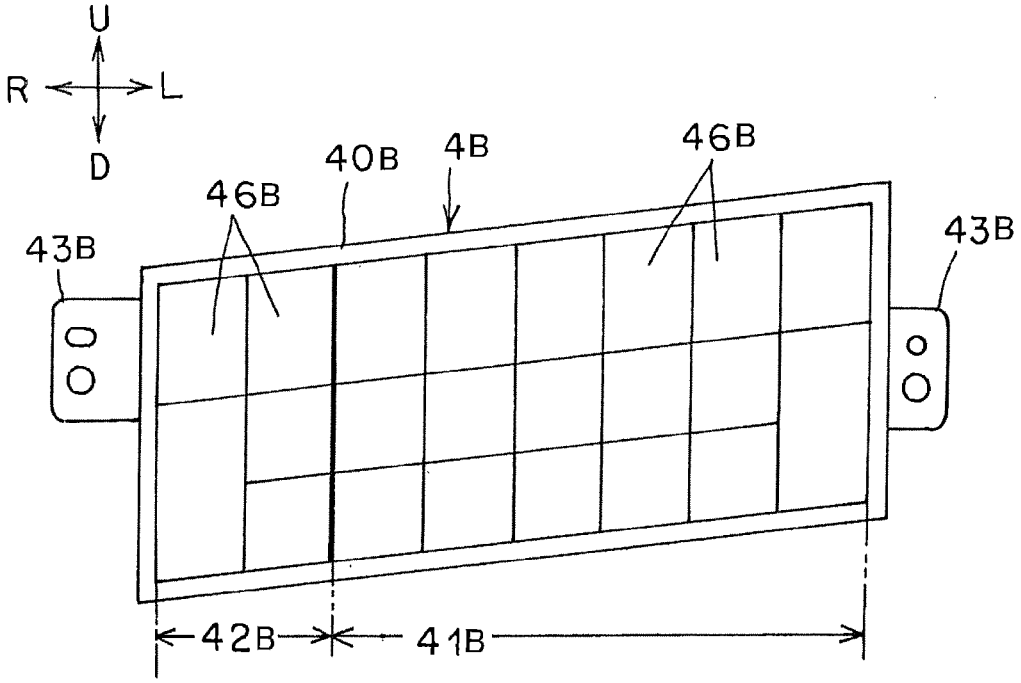
FIG. 28 is a front view showing a lens (third embodiment)

The lens portion 40B of the lens 4B is integrally made of a first lens portion (a lens portion for low beam) 41B and a second lens portion (a lens portion for high beam) 42B. The second lens portion 42B is positioned at the inside (the right side R) more than the first lens portion 41B (refer to FIG. 28). The second lens portion 42B is positioned at the lower side D of the vehicle C in comparison with the first lens portion 41B (refer to FIG. 28). The second lens portion 42B is positioned at the foreside D of the vehicle C in comparison with the first lens (refer to FIG. 32).

The first lens portion 41B is provided in correspondence with the first reflection surface 31B of the first reflector 3L. The first lens portion 41B is a lens portion to light-distribute and control the first basic light distribution pattern from the first reflection surface 31B of the first reflector 3L as a first light distribution pattern shown in FIG. 33 (A), in other words, a light distribution pattern for low beam LP and then emit the resultant light distribution pattern forward of the vehicle C. The light distribution pattern for low beam LP has an oblique cutoff line CL1, a horizontal cutoff line CL2, and an elbow point E (a cross point between the oblique cutoff line CL1 and the horizontal cutoff line CL2 or its proximal point).

The second lens portion 42B is provided in correspondence with the second reflection surface 32B of the second reflector 3H. The second lens portion 42B is a lens portion to light-distribute and control the second basic light distribution pattern from the second reflection surface 32B of the second reflector 3H as a second light distribution pattern P2 shown in FIG. 33 (B) and then emit the resultant light distribution pattern forward of the vehicle C. The second light distribution pattern P2 has a high luminous intensity zone (a hot zone) HZ. The light distribution pattern for low beam LP and the second light distribution pattern P2 are overlapped (combined) with each other, whereby a light distribution pattern for high beam HP shown in FIG. 33 (C) can be obtained.

(Description of Heat Sink Member 5B)

The heat sink member 5B, as shown in FIG. 23 to FIG. 26, and FIG. 31, is integrally made of a first horizontal plate portion 50B, a second horizontal plate portion 54B, a first fin portion 51B, a second fin portion 55B, a mount portion 52B, and the shade portion 53B.

Figure 31:
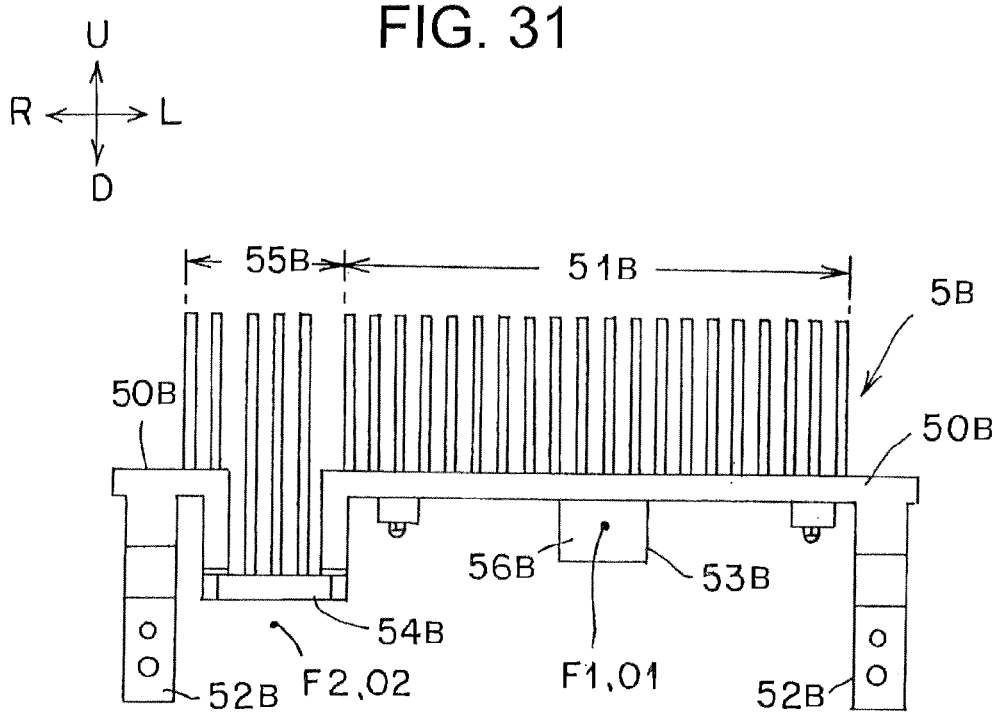
FIG. 31 is a front view showing a heat sink member (third embodiment)

The second horizontal plate portion 54B is positioned at a portion of the inside (the right side R) of the vehicle C of the first horizontal plate portion 50B (refer to FIG. 23 and FIG. 31). The second horizontal plate portion 54B is positioned at the lower side D of the vehicle C in comparison with the first horizontal plate portion 50B (refer to FIG. 23 and FIG. 31). The second horizontal plate portion 54B is positioned at the foreside F of the vehicle C in comparison with the first horizontal plate portion 50B (refer to FIG. 23).

On one surface of a respective one of the first horizontal plate portion 50B and the second horizontal plate portion 54B (on a surface of the lower side D), a respective one of the first semiconductor-type light source 2L and the second semiconductor-type light source 2H is mounted by means of the screw 23. As a result, the second semiconductor-type light source 2H is positioned at a portion of the inside (the right side R) of the vehicle C more than the first semiconductor-type light source 2L (refer to FIG. 29). The second semiconductor-type light source 2H is positioned at the lower side D of the vehicle C in comparison with the first semiconductor-type light source 2L (refer to the centers O1 and O2 of the light emission chip of FIG. 31). The second semiconductor-type light source 2H is positioned at the foreside F of the vehicle C in comparison with the first semiconductor-type light source 2L (refer to FIG. 29).

Of the first horizontal plate portion 50B, on one surface (the surface of the lower side D) of a portion of the outside (the left side L) of the vehicle C, the first reflector 3L that is structured so as to be integrated with the second reflector 3H is mounted by means of the screw 34B.

A plurality of the first fin portions 51B and second fin portions 55B, a respective one of which is formed in the shape of a vertical plate, are integrally provided on the other surface (on a face of the upper side U) of the first horizontal plate portion 50B, the second horizontal plate portion 54B. The first fin portions 51B and the second fin portions 55B are configured to radiate a heat that is generated on the first light emitting chip 20H of the first semiconductor-type light source 2L and the second light emitting chip 20L of the second semiconductor-type light source 2H to the outside.

At a respective one of the left and right end parts of the edges of the foreside F on one surface of the first horizontal plate portion 50B, the mount portion 52B formed in a curved arm shape is integrally provided. On the mount portion 52B, the lens 4B is mounted by means of the screw 44B.

At a center part of the edge of the foreside F on one surface of the first horizontal plate portion 50B, the shade portion formed in a curved shape is integrally provided. The shade portion 53B is intended to prevent the light from the light emission surface 24L of the first semiconductor-type light source 2L from being directly incident to the lens portion 40B of the lens 4B. At the shade portion 53B, a shade portion 56B is provided for shading light L1 that is incident from the first semiconductor-type light source 2L to the second lens portion 42B.

(Description of Cover Member 6B)

The cover member 6B, as shown in FIG. 23 to FIG. 26, forms a hollowed cover shape in which a portion of the foreside F closes and a portion of the backside B opens. The cover member 6B is made of a light impermeable member.

At a portion of the foreside F of the cover member 6B, an insert opening portion 60B forming an elongated shape is provided. The lens portion 40B of the lens 4B is inserted into the insert opening portion 60B. A mount portion (not shown) is integrally provided at an edge of a respective one of the left and right sides of the inside of the insert opening portion 60B at the portion of the foreside F of the cover member 6B. The mount portion is mounted to the mount portion 43B of the lens 4B. As a result, the cover member 6B is fixed to the heat sink member 5B via the lens 4B. A ventilation opening portion 62B is provided at a center part of a respective one of the top and bottom of the opening portion at the backside B of the cover member 6B.

(Description of Functions of Third Embodiment)

The vehicle headlamps 1L and 1R in the third embodiment are respectively made of the constituent elements as described above, and hereinafter, their related functions will be described.

The light emission chip 20L of the first semiconductor-type light source 2L is lit. Afterwards, most of the light that is radiated from the light emission surface 24L of the light emission chip 20L is reflected to the side of the lens 4B by means of the first reflection surface 31 of the first reflector 3L.

The reflected light, namely the light reflected by the first reflection surface 31B, is light-distributed and controlled so as to be a first basic light distribution pattern (not shown) having an oblique cutoff line, a horizontal cutoff line, and an elbow portion, and the resultant light is transmitted through the first lens portion 41B of the lens 4B from an incidence surface 45B to an emission surface 46B. The emitted light, namely the light emitted from the first lens portion 41B, as shown in FIG. 33 (A), is light-distributed and controlled so as to be a light distribution pattern for low beam LP having an oblique cutoff line CL1, a horizontal cutoff line CL2, and an elbow point E, and then, the resultant light distribution pattern is emitted forward of the vehicle C.

In addition, the light emission chip 20H of the second semiconductor-type light source 2H is lit. Afterwards, most of the light that is radiated from the light emission surface 20H of the light emission chip 20H is reflected to the side of the lens 4 by means of the second reflection surface 32B of the second reflector 3H.

The reflected light, namely the light reflected by the second reflection surface 32B, is light-distributed and controlled so as to be a second basic light emission pattern (not shown) having a high luminous intensity zone and then the resultant light emission pattern is transmitted through the second lens portion 42B of the lens 4B from the incidence surface 45B to the emission surface 46B. The emitted light, namely the light emitted from the second lens portion 42B, as shown in FIG. 33 (B), is light-distributed and controlled so as to be a second light distribution pattern P2 having a high luminous intensity zone (a hot zone) HZ and then the resultant light emission pattern is emitted forward of the vehicle C.

Figure 33:
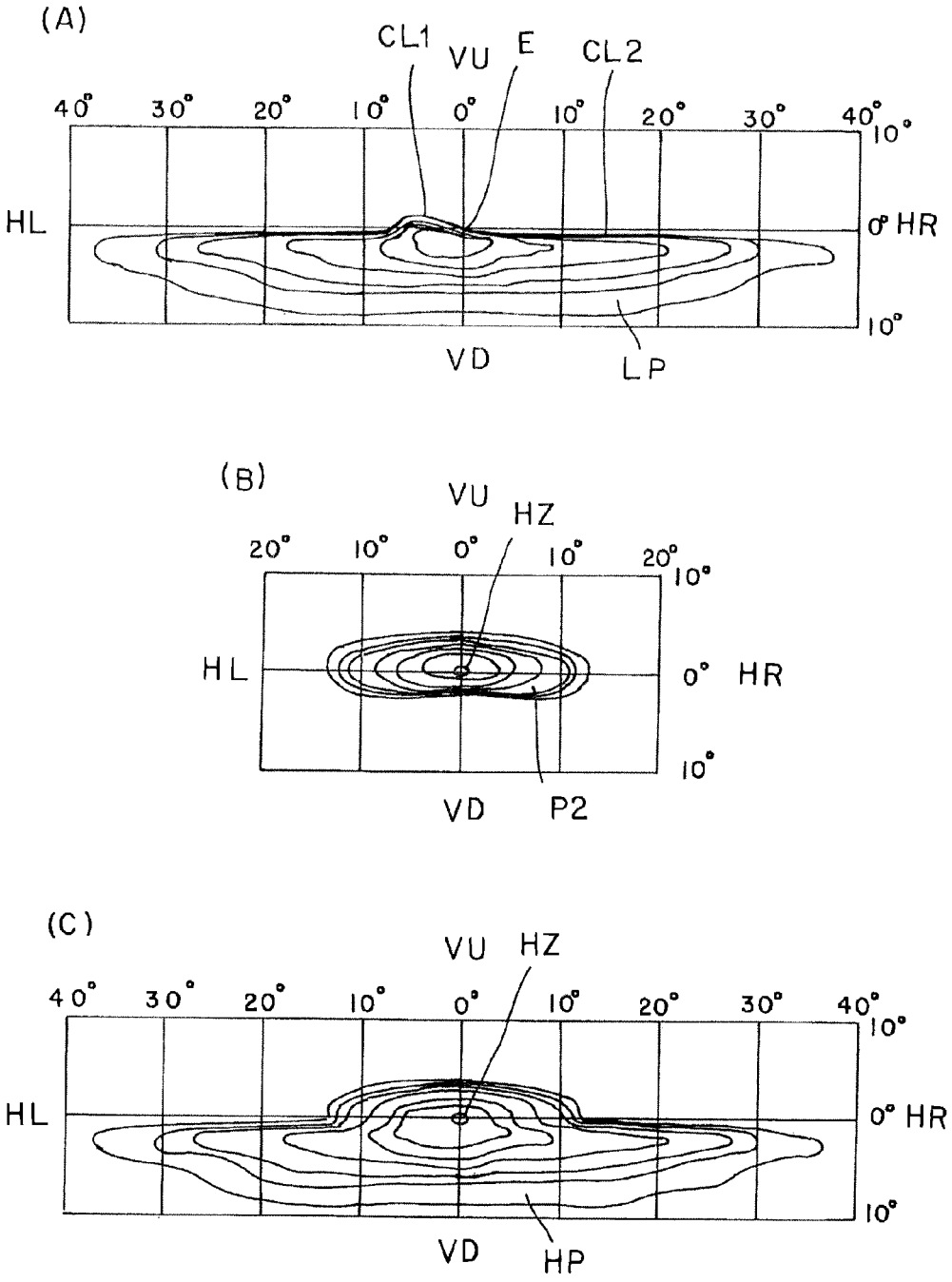
FIG. 33 is an explanatory view showing a light distribution pattern for low beam and a light distribution pattern for high beam, a respective one of which is emitted forward of a vehicle (third embodiment)

The light distribution pattern for low beam LP shown in FIG. 33 (A) and the second light distribution pattern P2 shown in FIG. 33 (B) are overlapped (combined) with each other, whereby the light distribution pattern for high beam HP shown in FIG. 33 (C) can be obtained.

(Description of Advantageous Effects of Third Embodiment)

The vehicle headlamps 1L and 1R in the third embodiment are respectively made of the constituent elements and functions as described above, and hereinafter, their related advantageous effects will be described.

The vehicle headlamps 1L and 1R in the third embodiment are capable of obtaining a good light distribution pattern for low beam LP and a good light distribution pattern for high beam HP.

In other words, the vehicle headlamps 1L and 1R in the third embodiment illuminate only the first semiconductor-type light source 2L, whereby the light distribution pattern for low beam LP shown in FIG. 33 (A) can be obtained, and the first semiconductor-type light source 2L and the second semiconductor-type light source 2H are lit, whereby the light distribution pattern for high beam HP shown in FIG. 33 (C), which is formed when the light distribution pattern for low beam LP shown in FIG. 33 (A), and the second light distribution pattern P2 shown in FIG. 33 (B), can be obtained. As a result, a good light distribution pattern for low beam LP and a good light distribution pattern for high beam HP can be obtained.

The vehicle headlamps 1L and 1R in the third embodiment are respectively provided with a shade portion 56B to shade the light L1 that is incident from the first semiconductor-type light source 2L to the second lens portion 42B; and therefore, when only the first semiconductor-type light source 2L is lit, it is possible to reliably prevent the light L1 from the semiconductor-type light source 2L from being incident to the second lens portion 42B and then emit the incident light as stray light from the second lens portion 42B to the outside. In this manner, a good light distribution pattern for low beam LP can be obtained. In addition, when the first semiconductor-type light source 2L and the second semiconductor-type light source 2H both are lit and then the light distribution pattern for high beam HP is emitted forward of the vehicle C, even if the light (not shown) from the second semiconductor-type light source 2H is incident to the first lens portion 41B and then is emitted from the first lens portion 41B to the outside, there could be no influence on the light distribution pattern for high beam HP. In this manner, the good light distribution pattern for high beam HP can be obtained.

The vehicle headlamps 1L and 1R in the third embodiment are respectively characterized in that the light emission luminous quantity of the second semiconductor-type light source 2H is smaller than the light emission luminous quantity of the first semiconductor-type light source 2L; and therefore, a second fin portion 55B of the heat sink member 5B to radiate a heat from the second semiconductor-type light source 2H to the outside can be downsized, and accordingly, the heat sink member 5B and a lamp unit can be downsized, and further, a heat radiation effect can be improved.

The vehicle headlamps 1L and 1R in the third embodiment are respectively characterized in that the reference focal point distance of the second reflection surface is shorter than the reference focal point distance F10 of the first reflection surface 31B; and therefore, a solid angle at which the light from the second semiconductor-type light source 2H is incident to the second reflection surface 32B increases. As a result, a front side projection area of the second reflection surface 32B can be made smaller than a front side projection area of the first reflection surface 31B (refer to FIG. 27). In this manner, the second reflector 3H can be downsized, and accordingly, the lamp unit can be downsized, and further, the light from the second semiconductor-type light source 2H can be effectively utilized, and a light distribution pattern for high beam HP with its high efficiency can be obtained.

The vehicle headlamps 1L and 1R in the third embodiment are respectively characterized in that the second reflector 3H is positioned at the inside (the right side R) of the vehicle C relative to the first reflector 3L and at the lower side D of the vehicle V and at the foreside F of the vehicle C. As a result, these vehicle headlamps are suitable for use in such a vehicle type that the front part of the vehicle C tilts (slants) from the foreside F to the backside B from the inside (the right side R) to the outside (the left side), and are suitable for use in the lens 4B that tilts (slants) and (rises) from the lower side D to the upper side U of the vehicle C from the inside (the right side R) to the outside (the left side L) of the vehicle C.

The vehicle headlamps 1L and 1R in the third embodiment are respectively characterized in that the lens portion 40B of the lens 4B is integrally made of the first lens portion 41B and the second lens portion 42B; and therefore, its related appearance is improved.

The vehicle headlamps 1L and 1R in the third embodiment are respectively characterized in that a distance in the forward and backward direction between the lens 4 and the first reflector 3L and the second reflector 3H, in other words, a distance from the first reflection surface 31B of the first reflector 3L and the second reflection surface 32B of the second reflector 3H to the incidence surface 45B of the lens 4 is short. Thus, even if a shift in relative position between the first reflection surface 31B of the first reflector 3L and the second reflector surface 3B of the second reflector 3H and between the first lens portion 40B and the second lens portion 42B of the lens 4 takes place to a certain extent, there could be less influential on light distribution and control from the first basic light distribution pattern and the second basic light distribution pattern to the light distribution pattern for low beam LP and the second light distribution pattern P2. In other words, light distribution and control with its high precision is possible.

(Description of Examples Other Than Third Embodiment)

In the third embodiment, a description will be given with respect to a respective one of the vehicle headlamps 1L and 1R in a case where the vehicle C is intended for use in left side cruising. However, the present invention can be applied to the vehicle headlamps in a case where the vehicle C is intended for use in right side cruising as well.

In addition, in the third embodiment, the light emission surface 24L of the light emission chip 20L of the first semiconductor-type light source 2L and the light emission surface 24H of the light emission chip 20H of the second semiconductor-type light source 2H are oriented to the lower side D. However, in the present invention, the light emission surface 24L of the light emission chip 20L of the first semiconductor-type light source 2L and the light emission surface 24H of the light emission chip 20H of the second semiconductor-type light source 2H may be oriented to the upper side U.

Further, in the third embodiment, the emission surfaces 46B of the lens 4B are respectively formed in a plurality of convex surfaces. However, in the present invention, an incidence surface of a lens may be formed in a plurality of convex surfaces, or alternatively, an emission surface and an incidence surface of the lens may be respectively formed in a plurality of convex surfaces.

Furthermore, the third embodiment describes a light distribution pattern for low beam LP having an oblique cutoff line CL1, a horizontal cutoff line CL2, and an elbow point E as a first light distribution pattern. However, in the present invention, as the first light distribution pattern, there may be a light distribution pattern which does not have an oblique cutoff line.

(Fourth Embodiment)

The present invention relates to a vehicle headlamp that is provided with a semiconductor type light source, a reflector, and a lens that has a plurality of convex surface. In particular, the present invention relates to a vehicle headlamp that is provided in such a manner that an appropriate (ideal) light distribution pattern for low beam (a light distribution pattern for passing) can be obtained.

In a conventional vehicle headlamp, there may be a case in which light from a light source is directly incident to a scattering prism lens. In this case, there may be a case in which a ghost image G indicated by the double dotted chain line in FIG. 39 (B) is generated. In this case, there may be a good light distribution pattern cannot be obtained.

A problem to be solved by the present invention is that in the conventional vehicle headlamp, there may be a case in which a good light distribution pattern (for example, a light distribution pattern for low beam) cannot be obtained.

Figure 34:
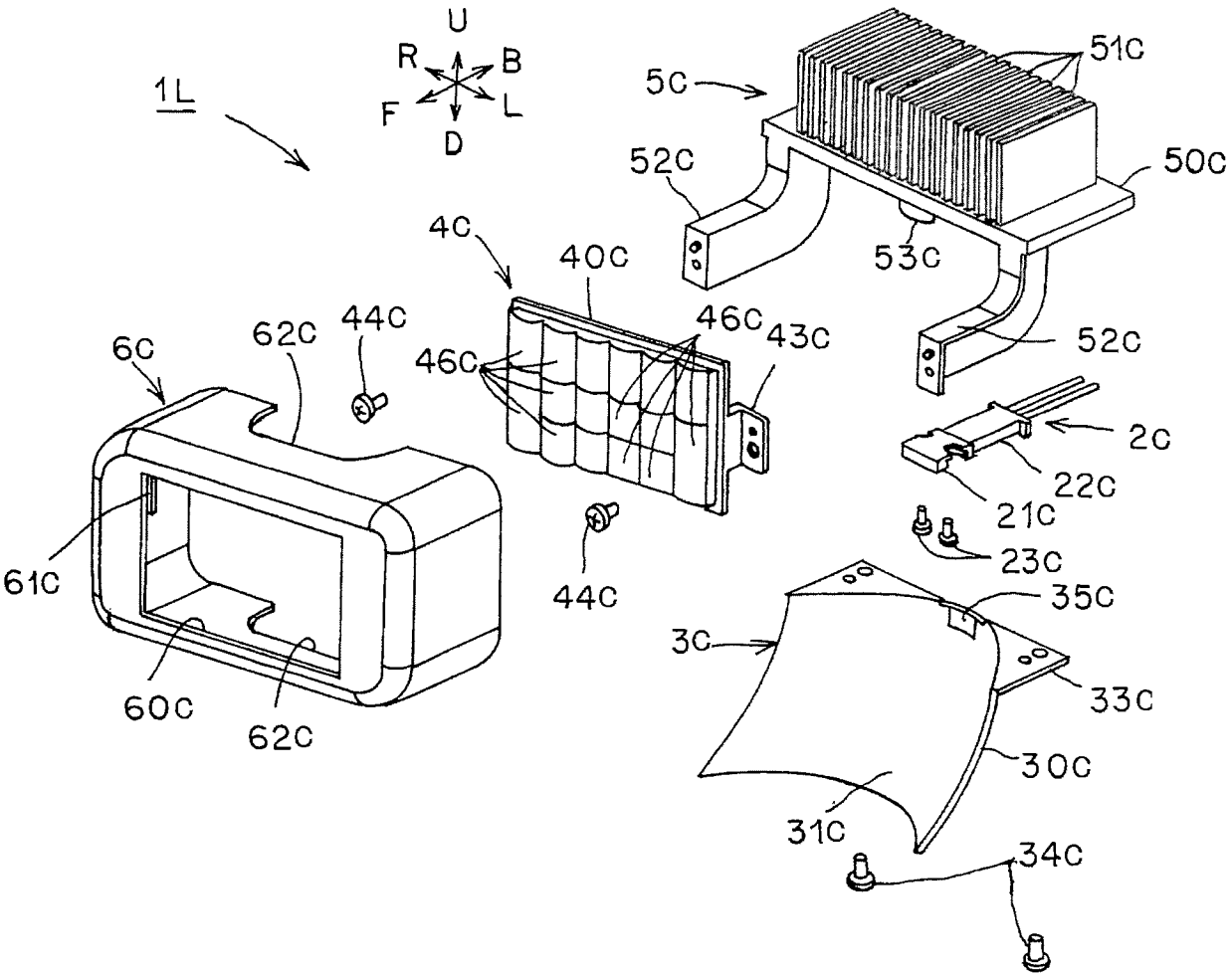
FIG. 34 is an exploded perspective view showing a left side lamp unit (fourth embodiment)
Figure 35:
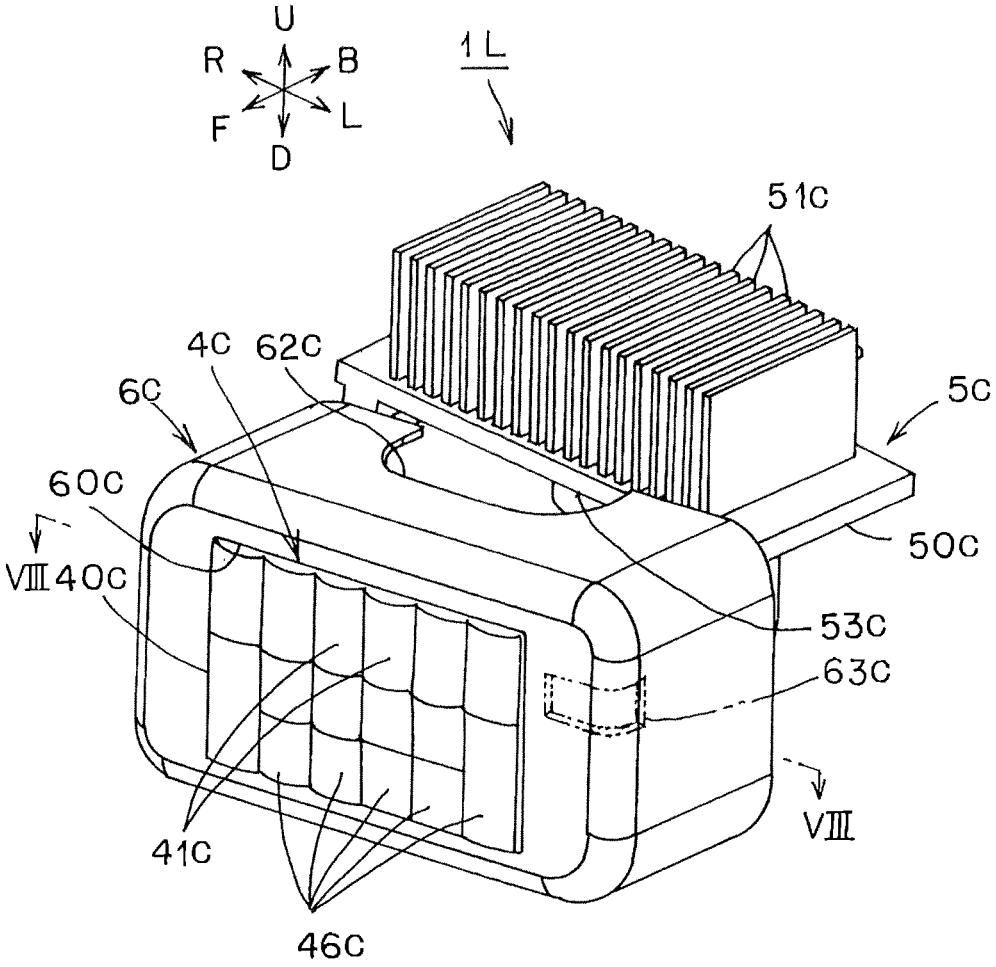
FIG. 35 is a perspective view showing the left side lamp unit (fourth embodiment)

The present invention as shown in FIG. 34, provides a semiconductor-type light source 2C, a reflector 3C, a lens 4C, and a shade portion 53C. The reflector 3C has a reflection surface 31C. The lens 4C has a plurality of convex surfaces (emission surfaces 46C) and a lens portion 40C. On the reflection surface 31C, an auxiliary reflection surface 35C is provided. As a result, according to the present invention, in a lamp unit, a good light distribution pattern for low beam LP can be obtained.

FIG. 34 to FIG. 37 are shows the fourth embodiment of the vehicle headlamp according to the present invention. Hereinafter, a configuration of the vehicle headlamp in the fourth embodiment will be described. A reference codes 1L and 1R designate the vehicle headlamps in the fourth embodiment (such as headlamps, for example). The vehicle headlamps 1L and 1R described previously are mounted on both of the left and right end parts of a front portion of a vehicle C for right side cruising. Hereinafter, a left side vehicle headlamp 1L that is to be mounted on a left side L of the vehicle C will be described. It is to be noted that a right side headlamp 1R that is to be mounted on a right side R of the vehicle C is made of the constituent elements that are substantially identical to those of the left side vehicle headlamp 1L.

(Description of Vehicle Headlamp 1L)

The vehicle headlamp 1L described previously, as shown in FIG. 34 to FIG. 37, is provided with a lamp housing (not shown), a lamp lens (not shown), a semiconductor-type light source 2C, a reflector 3C, a lens 4C, a heat sink member 5C, and a cover member 6C.

The semiconductor-type light source 2C, the reflector 3C, the lens 4C, the heat sink member 5C, and the cover member 6C configure a lamp unit. The lamp housing and the lamp lens define a lamp room (not shown). The constituent elements 2C, 3C, 4C, 5C, and 6C that configure the lamp unit are disposed in the lamp room, and further, are mounted to the lamp housing via an optical axis adjustment mechanism for vertical direction (not shown) and an optical axis adjustment mechanism for transverse direction (not shown).

(Description of Semiconductor-Type Light Source 2C)

Figure 37:
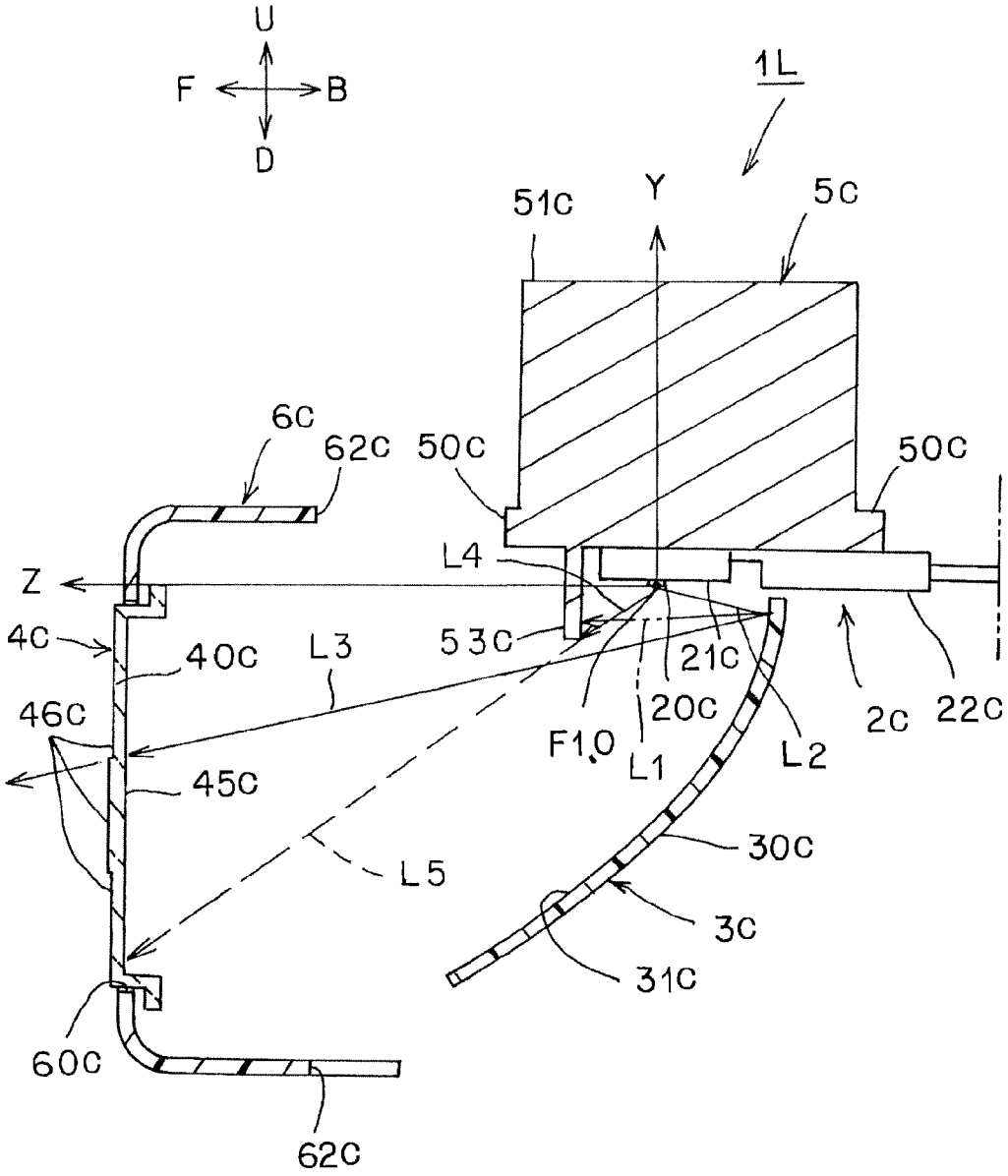
FIG. 37 is a sectional view taken along the line V-V in FIG. 36 (fourth embodiment)

The semiconductor-type light source 2C, as shown in FIG. 34 and FIG. 37, corresponds to a self-emitting semiconductor-type light source such as an LED or an EL (an organic EL), for example. The semiconductor-type light source 2C is made of: a light emitting chip (an LED chip) 20C; a package (an LED package) that seals the light emitting chip 20C with a sealing resin member; a board 21C that mounts the package; a connector 22C that is mounted to the board 21C and that supplies an electric current from a power source (a battery) to the light emitting chip 20C. The board 21C is fixed to the heat sink member 5C by means of a screw 23C. As a result, the semiconductor-type light source 2C is fixed to the heat sink member 5C.

The light emitting chip 20C is formed in a planar rectangular shape (a planar elongated shape). In other words, four square chips are arranged in an X-axis direction (in a horizontal direction). It is to be noted that two, three, or five or more square chips or one elongated chip, or one square chip may also be used. A surface (a lower surface) of the lower side D of the elongated shape of the light emitting chip forms a light emission surface 24C. As a result, the light emission surface 24C is oriented to the lower side D. A center O of the light emission surface 24C of the light emitting chip 20C is positioned at or near a reference focal point F1 of the reflector 2C, and is positioned on or near a reference optical axis (a reference axis) Z of the reflector 3C.

Figure 36:
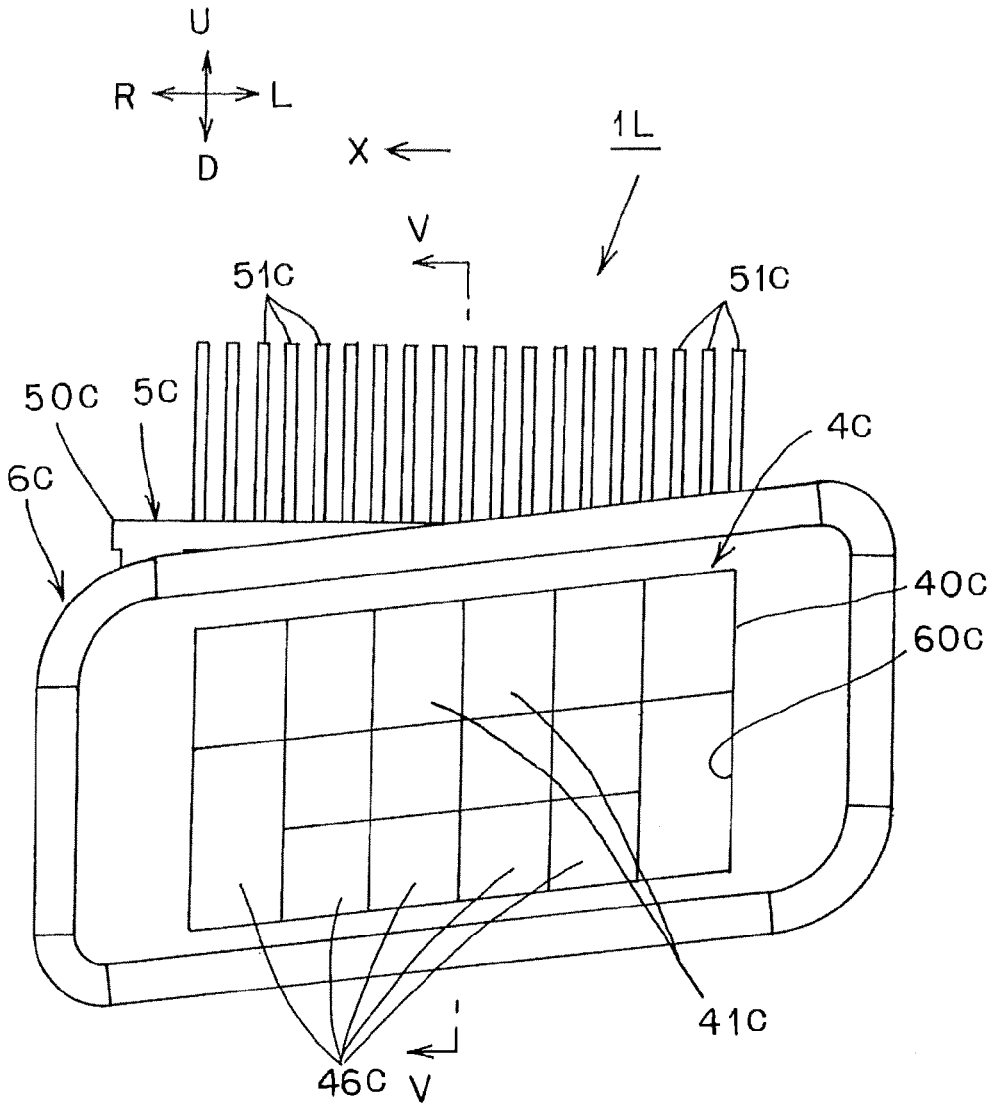
FIG. 36 is a front view showing the left side lamp unit (fourth embodiment)
Figure 38:
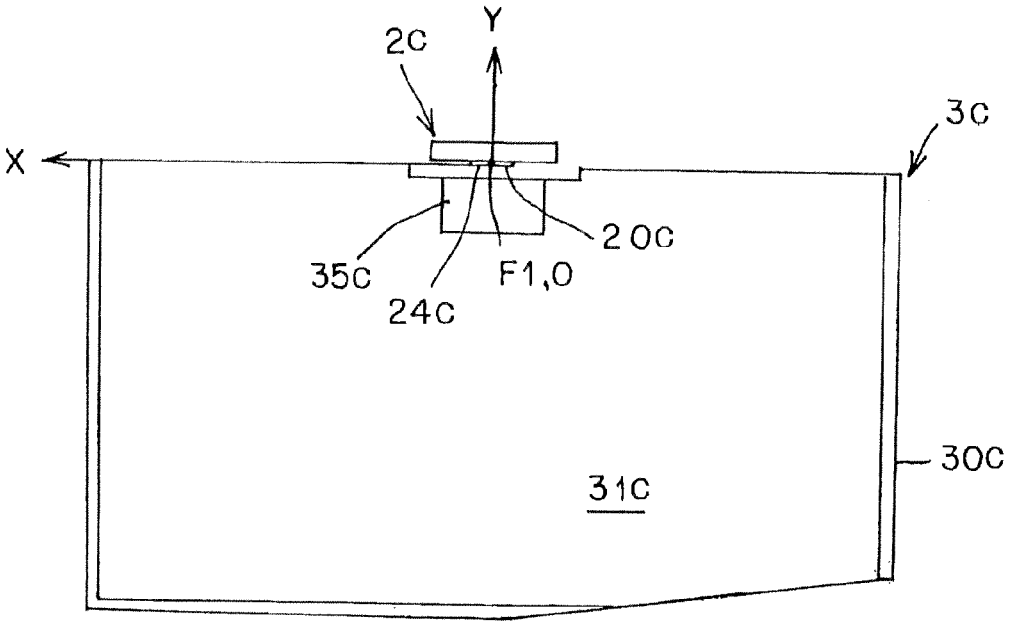
FIG. 38 is a front view showing a reflector (fourth embodiment)

In FIG. 36 to FIG. 38, the X, Y, and Z axes configure an orthogonal coordinate (an X-Y-Z orthogonal coordinate system). The X axis designates a horizontal axis that is defined in a transverse direction that passes through the center O of the light emission surface 24C of the light emitting chip 20C. On the X axis, the inside of the vehicle C, in other words, in the fourth embodiment the right side designates a positive direction, and the outside of the vehicle C, in other words, in the fourth embodiment the left side L designates a negative direction. In addition, the Y axis designates a vertical axis (a vertical line, a normal line, or a perpendicular line) that passes through the center O of the light emission surface 24C of the light emitting chip 20C. On the Y axis, in the fourth embodiment, the upper side designates a positive direction, and the lower side D designates a negative direction. Further, the Z axis designates a reference optical axis Z of the reflector 3C, and designates an axis that is defined in a forward/backward direction that passes through the center O of the light emission surface 24C of the light emitting chip 20C and that is orthogonal to the X axis and the Y axis. On the Z axis, in the fourth embodiment, the front side F designates a positive direction, and the rear side B designates a negative direction.

(Description of Reflector 3C)

The reflector 3C, as shown in FIG. 34, is made of a reflection portion 30C and a mount portion 33C. The mount portion 33C is fixed to the heat sink member 5C by means of a screw 34C. As a result, the reflector 3C is fixed to the heat sink member 5C.

On a surface (an interior surface) of a foreside F of the reflection portion 30C, a reflection surface 31C formed of one continuous surface is provided. The reflection surface 31C is a reflection surface made of a parabolic free curved surface. As a result, the reflection surface 31C (the reflector 3C) has the reference focal point F1 and the reference optical axis Z.

The reflection surface 31C is a reflection surface of a free curved surface to reflect most of the light (not shown) from the light emission surface 24C of the semiconductor-type light source 2C as a basic light distribution pattern (not shown) having an oblique cutoff line, a horizontal cutoff line, and an elbow point (a cross point between the oblique cutoff line and the horizontal cutoff line or its proximal point). Here, the basic light distribution pattern is characterized in that at a portion from about 5 degrees to the order of about 10 degrees on the left side of the horizontal line HL-HR of the left and right of a screen, a smooth light distribution pattern is formed to prevent missing of the light.

(Description of Auxiliary Reflection Surface 35C)

Of the reflector 3C (the reflection surface 31C), at a portion at which a part L1 of the reflected light from the reflection surface 31C (refer to the arrow formed of the double dotted chain line in FIG. 37) is shaded by means of a shade portion 53C of the heat sink member 5C, an auxiliary reflection surface 35C is provided to reflect a part L2 from the light from the semiconductor-type light source 2C (refer to the solid arrow in FIG. 37) as reflected light L3 (refer to the solid arrow in FIG. 37) to the lens portion 40C of the lens 4C. In other words, at a center part of an upper edge of the reflector 3C and at a portion corresponding to the shade portion 53C of the heat sink member 5C, the auxiliary reflection surface 35C is provided. The auxiliary reflection surface 35C is intended to reflect the part L2 of the light from the semiconductor-type light source 2C so as to cross the shade portion 53C of the heat sink member 5C.

(Description of Lens 4C)

The lens 4C, as shown in FIG. 34 to FIG. 37, is made of a lens portion 40C, which forms an elongated shape in front view, and a mount portion 43C. The mount portion 43C is fixed to the heat sink member 5C by means of a screw 44C. As a result, the lens 4C is fixed to the heat sink member 5C. A distance in a forward and backward direction between the lens 4C and the reflector 3C is short.

The lens 40C of the lens 4C corresponds to a lens that has a plurality of convex surfaces (a thin lens or a prism lens). The lens portion 40C of the lens 4C tilts (slants) from the inside (the right side R) of the vehicle C to the outside (the left side L), in other words, from the front side F to the rear side B of the vehicle C in the planar viewing of the vehicle C, and tilts (slants) (rises up) from the inside (the right side R) to the outside (the left side) of the vehicle C, in other words, from the lower side D to the upper side U of the vehicle C.

An incidence surface 45C is provided on the interior surface of the lens portion 40C of the lens 4C (on a surface of the rear side B). A respective one of emission surfaces 46C and 47C is provided on the exterior surface of the lens portion 4C of the lens 4C (on a surface of the front side F). The incidence surface 45C is formed in a planar or composite quadrature curved surface. The emission surfaces 46C and 47C are respectively made of a plurality of the convex surfaces, and are respectively formed in a convex shaped free curved surface. As a result, the lens portion 40C of the lens 4C is formed in the shape of a cylindrical lens portion (a prism lens portion) of which an axis is in a vertical direction.

Figure 39:
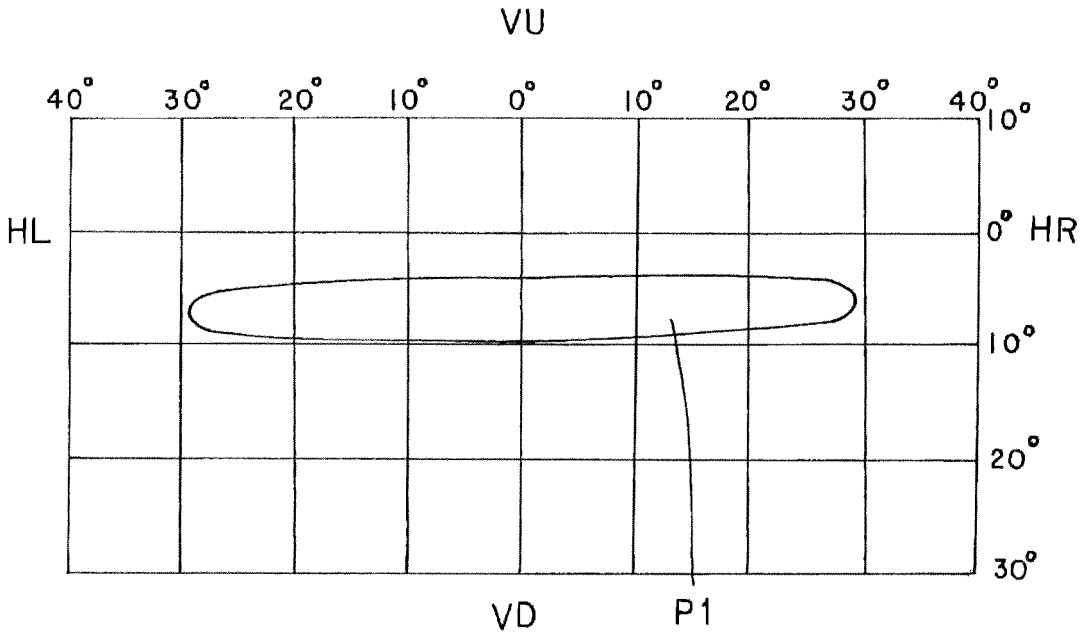
FIG. 39 is an explanatory view showing an auxiliary light distribution pattern and a light distribution pattern for low beam with which the auxiliary light distribution pattern is overlapped (combined) (fourth embodiment)
Figure 39:
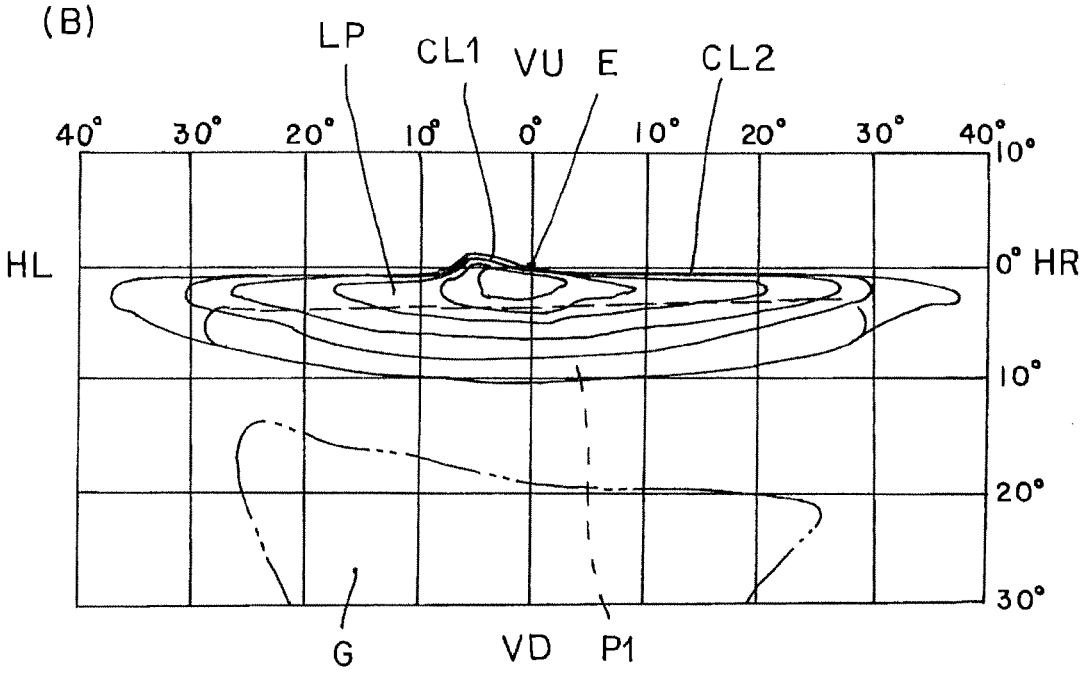

The lens portion 40C radiates the basic light distribution pattern from the reflection surface 31C forward of a vehicle C as a light distribution pattern for low beam LP having an oblique cutoff line CL1, a horizontal cutoff line CL2, and an elbow point E, as shown in FIG. 39 (B).

A part 41 (C) of the lens portion 40C, in this example, an upper center part, in other words, a respective one of the two convex surfaces (the emission surfaces 46C) in the middle of an upper stage is a lens portion to radiate the basic light distribution pattern forward of the vehicle C as the light distribution pattern for low beam LP and to emit the reflected light L3C from the auxiliary reflection surface 35C (the reflected light crossing the shade portion 53C of the heat sink member 5C) as an auxiliary light distribution pattern P1, as shown in FIGS. 39 (A) and FIG. 39 (B). The auxiliary light distribution pattern P1 is transmitted through the part 41C of the lens portion 40C, the transmitted pattern is scattered to the left and right in the forward direction (foreside of the vehicle C, and the scattered pattern is radiated to a portion of a lower side D of the light distribution pattern for low beam LP.

(Description of Heat Sink Member 5C)

The heat sink member 5C, as shown in FIG. 34 to FIG. 37, is made of a horizontal plate portion 50C, a fin portion 51C, a mount portion 52C, and the shade portion 53C. On one surface of the horizontal plate portion 50C (on a surface of the lower side D), the semiconductor-type light source 2C and the reflector 3C are respectively mounted by means of the screws 23C and 24C.

A plurality of the fin portions 51C, a respective one of which is formed in the shape of a vertical plate, are integrally provided on the other surface (on a face of the upper side U) of the horizontal plate portion 50C. The fin portions 51C are configured to radiate a heat that is generated on the light emitting chip 20C of the semiconductor-type light source 2 to the outside.

The mount portion 52C that is formed in the shape of a curved arc is integrally provided at a respective one of the left and right end parts on edges of the front side F of one surface of the horizontal plate portion 50C. On the mount portion 52C, the lens 4C is mounted by means of the screw 44C.

The shade portion 53C that is formed in a curved shape is integrally provided at a center part of an edge of the front side F of one surface of the horizontal plate portion 50C. The shade portion 53C is configured to prevent the light from the light emission surface 24C of the semiconductor-type light source 2C from being directly incident to the lens portion 40 of the lens 4C. The part (L4) of the light from the light emission surface 24C of the semiconductor-type light source 2C is incident directly to the lens portion 40C of the lens 4C, as the direct light L5 (see broken line arrow in FIG. 37). As a result, as shown by two-dot chain line in FIG. 39 (B), if there is a ghost image G occurs below the light distribution pattern in which the auxiliary light distribution pattern P1 is superimposed (composition) on the lower portion of the light distribution pattern LP for low beam, i.e., on the front side of the vehicle C.

(Description of Cover Member 6C)

The cover member 6C, as shown in FIG. 34 to FIG. 37, is formed in a hollow cover shape in which a portion of the front side F closes and a portion of the rear side B opens. The cover member 6C is made of an optically impermeable member.

An insert opening portion 60C that is formed in an elongated shape is provided at a portion of the front side F of the cover member 6C. The lens portion 40C of the lens 4C is inserted into the insert opening portion 60C. A mount portion 61C is integrally provided on an edge of a respective one of the left and right sides inside of the insert opening portion 60C of a portion of the front side F of the cover member 6C. The mount portion 61C is mounted to the mount portion 43C of the lens 4C. As a result, the cover member 6C is fixed to the heat sink member 5C via the lens 4C. A ventilation opening portion 62C is provided at a center part of an edge on a respective one of the top and bottom of the opening portion on the rear side B of the cover member 6C.

(Description of Functions of Fourth Embodiment)

The vehicle headlamps 1L and 1R in the fourth embodiment are respectively made of the constituent elements as described above, and hereinafter, their related functions will be described.

A light emission chip 20C of a semiconductor-type light source 2C is lit. Afterwards, most of the light that is radiated from a light emission surface 24C of the light emission chip 20C is reflected to the side of a lens 4C by means of a reflection surface 31C of a reflector 3C.

The reflected light, namely the light reflected by the reflection surface 31C, is light-distributed and controlled so as to be a basic light distribution pattern having an oblique cutoff line, a horizontal cutoff line, and an elbow point, and the resultant light distribution pattern is transmitted through a lens portion 40C of a lens 4C from an incidence surface 45C to an emission surface 46C. The emitted light, namely the light emitted from the lens 4C is light-distributed and controlled so as to be a light distribution pattern for low beam LP having an oblique cutoff line CL1, a horizontal cutoff line CL2, and an elbow point E, and the resultant light distribution pattern is radiated forward of the vehicle C, as shown in FIG. 39 (B).

A part L2 of the light that is radiated from the light emission surface 24C of the light emission chip 20C is reflected to the side of the lens 4C by means of an auxiliary reflection surface 35C of the reflector 3C. The reflected light L3 crosses the shade portion 53C of the heat sink member 5C, and is transmitted through a part 41C of the lens 40C from the incidence surface 45C to the emission surface 46C. The emitted light, namely the light emitted from the part 41C of the lens portion 40C, as shown in FIG. 39 (A) and FIG. 39 (B), is radiated forward of the vehicle C and to a portion of the lower side D of the light distribution pattern for low beam LP as an auxiliary light distribution pattern P1 that is scattered to the left and right (refer to the dashed line in FIG. 39 (B)).

Afterwards, a part L4 from the light from the light emission surface 24C of the semiconductor-type light source 2C is shaded by means of the shade portion 53C, thus making it possible to prevent the part L4 of the light as direct light L5 from the semiconductor-type light source 2C from being directly incident to the lens portion 40C of the lens 4C. In this manner, generation of the ghost image G can be prevented, and good light distribution pattern for low beam LP can be obtained.

(Description of Advantageous Effects of Forth Embodiment)

The vehicle headlamps 1L and 1R in the fourth embodiment are respectively made of the constituent elements and functions as described above, and hereinafter, their related advantageous effects will be described.

The vehicle headlamps 1L and 1R in the fourth embodiment are respectively capable of obtaining a good light distribution pattern for low beam LP.

In other words, the vehicle headlamps 1L and 1R in the fourth embodiment are respectively characterized in that the semiconductor-type light source 2C is disposed in an opposite direction to a direction in which a light distribution pattern for low beam LP is irradiated more significantly than that of the shade portion 53C, in other words, on the backside B more significantly than that of the shade portion 53C and at a position at which the part L4 of the light from the semiconductor-type light source 2C as the direct light L5 is not directly incident to the lens portion 40C. As a result, it is possible to prevent the direct light L5 from the semiconductor-type light source 2C being directly incident to the lens portion 40C which may result in generation of the ghost image G, and a good light distribution patter for low beam LP can be obtained.

In addition, the vehicle headlamps 1L and 1R in the fourth embodiment are respectively characterized in that, of the reflection surface 31C, at a portion at which a part L1 from the reflected light from the reflection surface 31C is shaded by means of the shade portion 53C, the auxiliary reflection surface 35C is provided for reflecting a part L2 from the semiconductor-type light source 2C to the lens portion 40C, and a part 41C of the lens 40C is a lens portion to radiate a basic light distribution pattern forward of the vehicle C as a light distribution pattern for low beam and to emit the reflected light L3 as an auxiliary light distribution pattern P1 from the auxiliary reflection surface 35C. As a result, the auxiliary light distribution pattern P1 that is scattered to the left and right is overlapped (combined) with each other at the portion of the lower side D of the light distribution pattern for low beam LP, and a further good light distribution pattern for low beam LP can be obtained.

The vehicle headlamps 1L and 1R in the fourth embodiment are respectively characterized in that a distance in the forward and backward direction between the lens 4C and the reflector 3C, in other words, a distance from the reflection surface 31C of the reflector 3C to the incidence surface 45C of the lens 4C is short. Thus, even if a shift in relative position between the reflection surface 31C of the reflector 3C and the lens portion 40C of the lens 4C takes place to some extent, there could be less influential on light distribution control from a basic light distribution pattern to the light distribution pattern for low beam LP. In other words, light distribution control with its high precision is possible.

(Fifth Embodiment)

Figure 40:
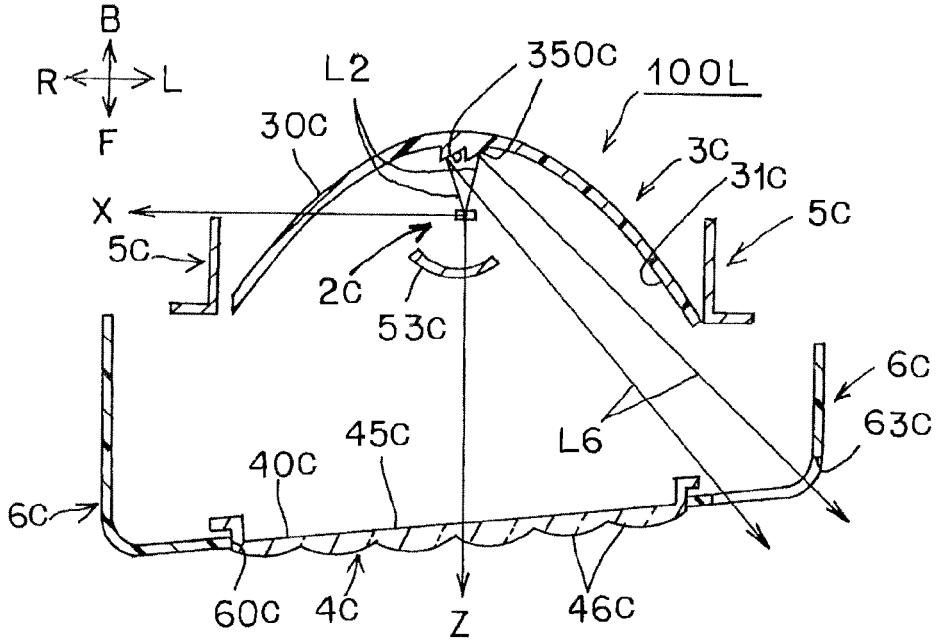
FIG. 40 is a transverse sectional view showing a fifth embodiment of a vehicle headlamp according to the present invention (a horizontal sectional view and a sectional view that corresponds to a sectional view taken along the line in FIG. 35) (fifth embodiment)
Figure 41:
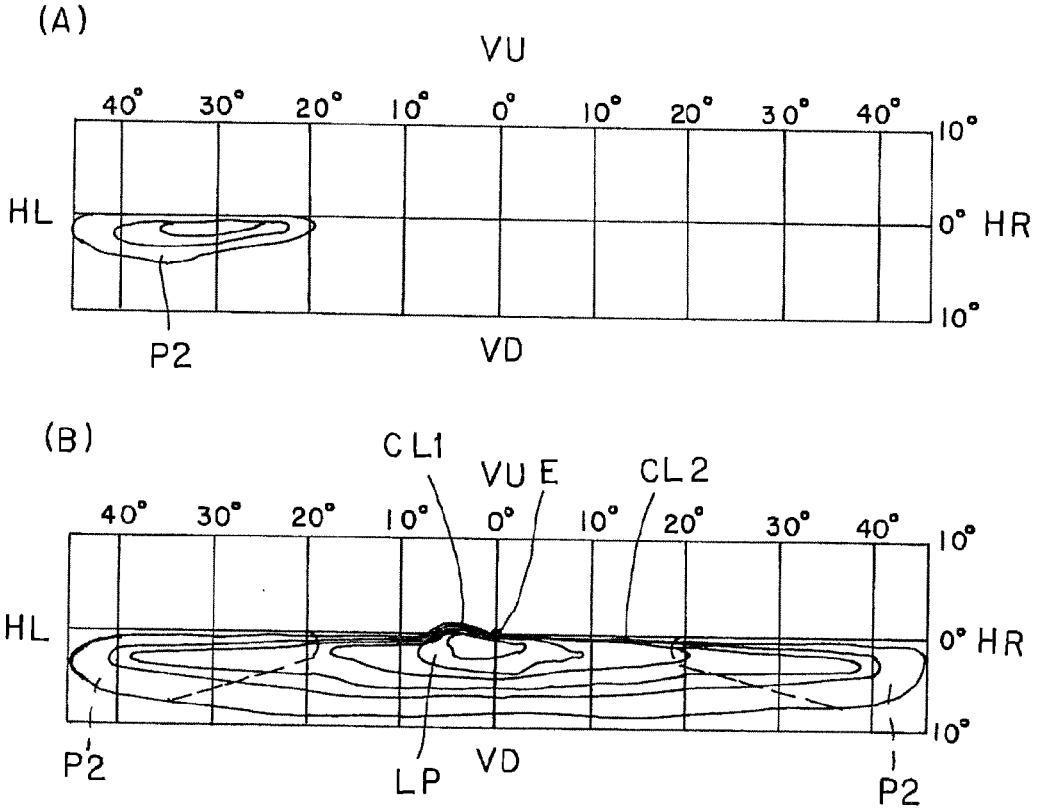
FIG. 41 is an explanatory view showing an auxiliary light distribution on a left side and a light distribution pattern that is obtained in such a manner that the auxiliary light distribution patterns on both of the left and right sides are overlapped (combined) with each other (fifth embodiment)

FIG. 40 and FIG. 41 each show a fifth embodiment of a vehicle headlamp according to the present invention. Hereinafter, the vehicle headlamp in the fifth embodiment will be described. In the figures, like constituent elements of FIG. 34 to FIG. 39 are designated by like reference numerals.

A vehicle headlamp 100 of the fifth embodiment, as is the case with the vehicle headlamps 1L and 1R mentioned previously, is provided with a lamp housing (not shown), a lamp lens (not shown), a semiconductor-type light source 2C, a reflector 3C, a lens 3C, a heat sink member 5C, and a cover member 6C.

The cover member 6C of a light impermeable member is provided at the periphery of a lens portion 40C of the lens 4C. A window portion 63C is provided at a side part of the cover member 6 (at the left side part in the case of a left side vehicle headlamp 100L, or alternatively, at the right side part in the case of a right side vehicle headlamp (not shown)). Of a reflection surface 31C of the reflector 3C, at a portion at which the reflected light from the reflection surface 31C is shaded by means of a shade portion 53C of the heat sink member 5C, an auxiliary reflection surface 350C is provided for reflecting a part L2 from the semiconductor-type light source 2C to the window portion 63C, and radiating the reflected light L6 as an auxiliary light distribution pattern P2 from the window portion 63C.

The auxiliary light distribution pattern P2 radiated from the left side vehicle headlamp 100L, as indicated by the dashed line in respective one of FIG. 41 (A) and FIG. 41 (B), is radiated in the range of about 20 degrees to about 45 degrees of the left side of a screen. On the other hand, the auxiliary light distribution pattern P2 radiated from a right side vehicle headlamp is radiated in the range of about 20 degrees to about 45 degrees of the right side of the screen (refer to the dashed line in FIG. 41 (B)). The left and light auxiliary light distribution patterns P2, as shown in FIG. 41 (B), are overlapped (combined) with each other at the portions on both of the left and right sides of the light distribution pattern for low beam LP.

The vehicle headlamp 100L of the fifth embodiment is made of the constituent elements as described above, thus making it possible to achieve their functions and advantageous effects similar to those of a respective one of the vehicle headlamps 1L and 1R of the fourth embodiment mentioned previously. In particular, according to the vehicle headlamp 100L of the fifth embodiment, since the left and right auxiliary light distribution patterns P2 are overlapped (combined) with each other at the portions of both of the left and light sides of the light distribution pattern for low beam LP, the left and right shoulder edges and a cross point can be illuminated, and a good light distribution pattern for low beam LP can be obtained.

(Sixth Embodiment)

Figure 42:
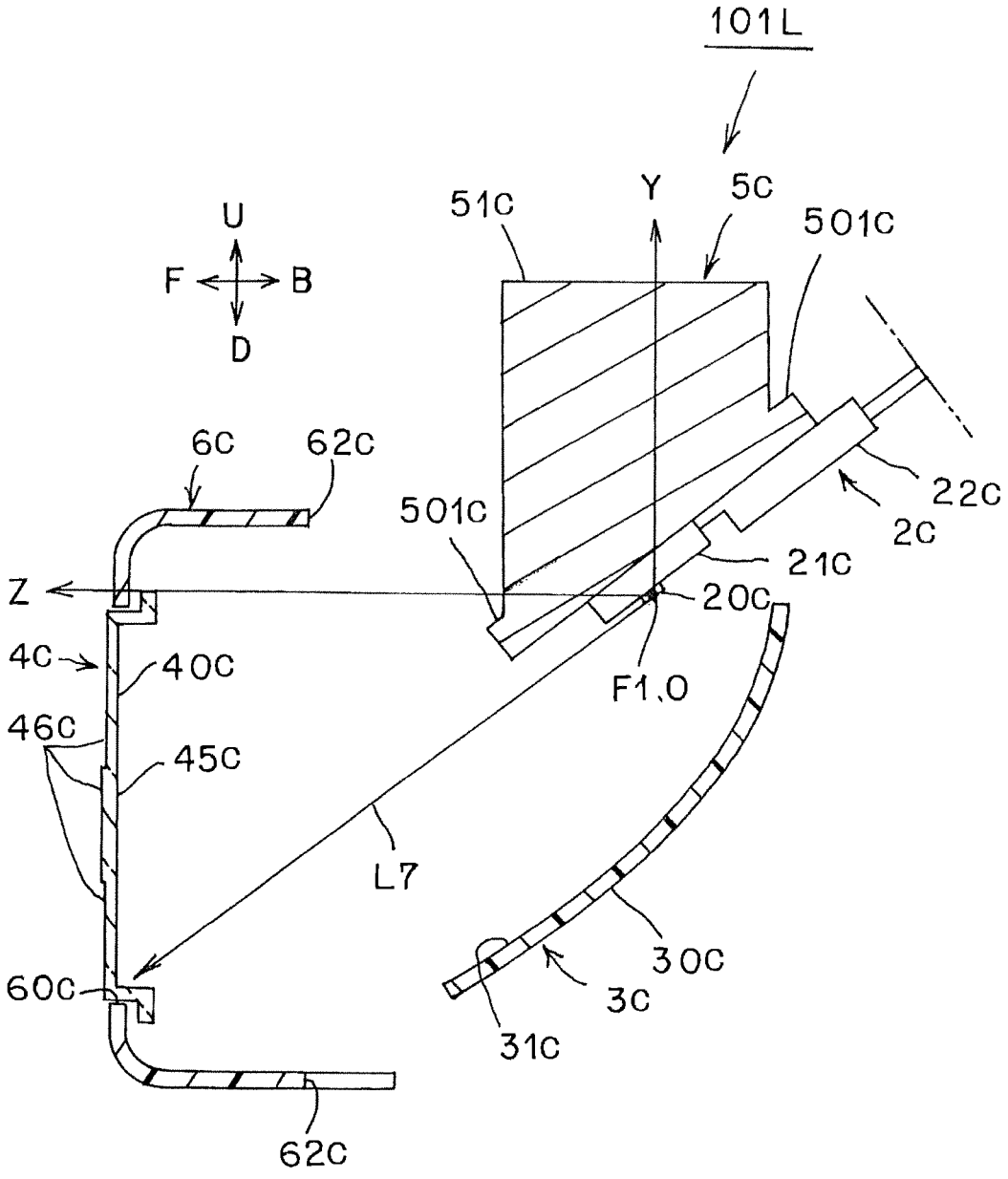
FIG. 42 is a vertical sectional view showing a sixth embodiment of a vehicle headlamp according to the present invention (a perpendicular sectional view and a sectional view that corresponds to a sectional view taken along the line V-V in FIG. 36) (sixth embodiment).

FIG. 42 shows a sixth embodiment of a vehicle headlamp according to the present invention. Hereinafter, the vehicle headlamp in the sixth embodiment will be described. In the figure, like constituent elements of FIG. 34 to FIG. 41 are designated by like reference numerals.

The vehicle headlamp 101L of the sixth embodiment, as is the case with the vehicle headlamps 1L and 1R of the fourth embodiment and the vehicle headlamp 100L of the fifth embodiment mentioned previously, is provided with a lamp housing (not shown), a lamp lens (not shown), a semiconductor-type light source 2C, a reflector 3C, a lens 4C, a heat sink member 5C, and a cover member 6C.

According to the vehicle headlamp 101L of the sixth embodiment, in the heat sink member 5C, an oblique plate portion 501C is provided so as to be tilted from a foreside F to a backside B and from a lower side D to an upper side U. The semiconductor-type light source 2C is mounted to a tilt surface of the oblique plate portion 501C. The semiconductor-type light source 2C is provided at a position at which light L7 from the semiconductor-type light source 2C is not directly incident to a lens portion 40C of the lens 4C.

The vehicle headlamp 101L of the sixth embodiment is made of the constituent elements as described above, thus making it possible to achieve its functions and advantageous effects similar to those of the vehicle headlamps 1L and 1R of the fourth embodiment mentioned above and the vehicle headlamp 100L of the fifth embodiment. In particular, according to the vehicle headlamp 101L of the sixth embodiment, since a semiconductor-type light source 2C is disposed at a position at which light L7 from the semiconductor-type light source 2C is not directly incident to a lens portion 40C, a good light distribution pattern for low beam LP can be obtained.

(Description of Examples Other Than Fourth, Fifth, and Sixth Embodiments)

The fourth, fifth, and sixth embodiments describe the vehicle headlamps 1L and 1R in a case where the vehicle C is intended for use in left side cruising. However, the present invention can also be applied to a vehicle headlamp in a case where the vehicle C is intended for use in right side cruising.

In addition, in the fourth, fifth, and sixth embodiments, the light emission surface 24C of the light emission chip 20C of the semiconductor-type light source 2C is oriented to the lower side D. However, in the present invention, the light emission surface 24C of the light emission chip 20C of the semiconductor-type light source 2C may be oriented to the upper side U, the left side L, the right side R, and an oblique direction or the like.

Further, in the fourth, fifth, and sixth embodiments, the emission surface 46C of the lens 4C form a plurality of convex surfaces. However, in the present invention, an incidence surface of a lens may form a plurality of convex surfaces, or alternatively, an emission surface and an incidence surface of a lens may form a plurality of convex surfaces.

Furthermore, the fourth, fifth, and sixth embodiments describe a light distribution pattern for low beam LP as a light distribution pattern. However, in the present invention, as a light distribution pattern, there may be a light distribution pattern other than the light distribution pattern for low beam LP, for example, a light distribution pattern for high beam (a light distribution pattern for cruising).

What is claimed is:

1. A vehicle headlamp comprising:

a semiconductor-type light source;

a reflector; and a lens, wherein the semiconductor-type light source has a downward or upward light emission surface, the reflector has:

a first reflection surface that is configured to reflect light from the light emission surface of the semiconductor-type light source as a basic light distribution pattern that has an oblique cutoff line; and a second reflection surface that is configured to reflect light from the light emission surface of the semiconductor-type light source as a basic light distribution pattern that has a horizontal cutoff line, and the lens has:

a first lens portion that has a plurality of convex surfaces, and that is configured to emit the basic light distribution pattern that has the oblique cutoff line; and a second lens portion that is configured to scatter the basic light distribution pattern that has the horizontal cutoff line from the second reflection surface and then emit the scattered basic light distribution pattern forward of a vehicle.

2. The vehicle headlamp according to claim 1, wherein the first lens portion has a convex shaped free curved surface that is the convex surface which is provided in correspondence with the first reflection surface and of which a plane or a curvature radius is large, and the second lens portion has a convex shaped free curved surface that is a convex shaped free curved surface which is provided in correspondence with the second reflection surface and of which a curvature radius is smaller than a curvature radius of the first lens portion.

3. The vehicle headlamp according to claim 1, wherein the first reflection surface is provided in a predetermined longitude range and in a predetermined latitude range of the reflector, the predetermined longitude range is a range from a longitude of 0 degree leading up to a longitude angle that corresponds to a tilt angle of the oblique cutoff line on a cruising lane side in a state in which a longitude line passing through a cross point between a reference optical axis of the reflector and the reflector is defined as a longitude of 0 degrees, and the predetermined latitude range is a range that is equal to or larger than a latitude angle at which a positional shift in a vertical direction of the light emission surface of the semiconductor-type light source is permissible in a state in which a cross line between a surface that includes the reference optical axis of the reflector and the reflector is defined as a latitude of 0 degrees.

4. The vehicle headlamp according to claim 1, wherein the lens tilts from a front side to a rear side of a vehicle from an inside to an outside of the vehicle in a planar view of the vehicle, and a plurality of the convex shaped free curved surface is made by bending a surface of an inside of the vehicle to a side of a light emission direction with respect to a center axis that is parallel to the reference optical axis of the reflector and then bending a surface outside of the vehicle to an opposite side to the light emission direction with respect to the center axis.

5. A vehicle headlamp comprising:

a semiconductor-type light source;

a reflector; and a lens, wherein the semiconductor-type light source has a downward light emission surface, the reflector has a reflection surface that is configured to reflect light from the light emission surface of the semiconductor-type light source as a basic light distribution pattern that has a cutoff line, the lens has a lens portion that has a plurality of convex surfaces, the lens portion being configured to emit the basic light distribution pattern from the reflection surface forward of a vehicle as a light distribution pattern having a cutoff line, the reflection surface is formed by means of vapor deposition, and at least a part of a lower end part of the reflection surface is positioned at a lower side than a lower end part of the lens portion.

6. The vehicle headlamp according to claim 5, wherein the lower end part of the reflection surface that is positioned at the lower side than the lower end part of the lens portion is a portion that is configured to emit a spot light distribution of the basic light distribution pattern.

7. The vehicle headlamp according to claim 5, wherein the vehicle headlamp comprises a light impermeable member to shade reflected light from the lower end part of the reflection surface that is positioned on the lower end side of the lens portion.

8. The vehicle headlamp according to claim 7, wherein an engagement portion configured to engage with the light impermeable member is provided on the lens portion, and a scattering surface or a light shading surface is provided at least on an incidence surface of the engagement portion.

9. A vehicle headlamp comprising:

a first semiconductor-type light source and a second semiconductor-type light source;

a first reflector and a second reflector; and a lens, wherein the first semiconductor-type light source and the second semiconductor-type light source has a downward or upward light emission surface;

the first reflector has a first reflection surface to reflect light from the light emission surface of the first semiconductor-type light source as a first basic light distribution pattern having a cutoff line;

the second reflector has a second reflection surface to reflect light from the light emission surface of the second semiconductor-type light source as a second basic light distribution pattern having a high luminous intensity zone; and the lens has a plurality of convex surfaces, and has a first lens portion to emit the first basic light distribution pattern from the first reflection surface forward of a vehicle as a first light distribution pattern having a cutoff line; and a second lens portion to emit the second basic light distribution pattern from the second reflection surface forward of the vehicle as a second light distribution pattern having a high luminous intensity zone, wherein the second reflector is positioned in a horizontal direction relative to the first reflector, the first lens and the second lens, respectively, are positioned in a horizontal direction corresponding to the first reflector and the second reflector.

10. The vehicle headlamp according to claim 9, comprising a shade portion to shade light that is incident from the first semiconductor-type light source to the second lens portion.

11. The vehicle headlamp according to claim 9, wherein a light emission luminous quantity of the second semiconductor-type light source is smaller than a light emission luminous quantity of the first semiconductor-type light source.

12. The vehicle headlamp according to claim 9, wherein a reference focal point distance of the second reflection surface is shorter than a reference focal point distance of the first reflection surface.

13. The vehicle headlamp according to claim 9, wherein the second reflector is positioned in an inside direction of a vehicle having the vehicle headlamp relative to the first reflector.

* * * * *